US007167099B2

(12) United States Patent
Kadwell et al.

(10) Patent No.: US 7,167,099 B2
(45) **Date of Patent: *Jan. 23, 2007**

(54) COMPACT PARTICLE SENSOR

(75) Inventors: Brian J. Kadwell, Holland, MI (US); Greg R. Pattok, Holland, MI (US)

(73) Assignee: Gentex Corporation, Zeeland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/958,956

(22) Filed: Oct. 5, 2004

(65) Prior Publication Data

US 2005/0057366 A1 Mar. 17, 2005

Related U.S. Application Data

(63) Continuation of application No. 09/844,229, filed on Apr. 27, 2001, now Pat. No. 6,876,305, which is a continuation-in-part of application No. 09/804,543, filed on Mar. 12, 2001, now Pat. No. 6,326,897, which is a continuation of application No. 09/456,470, filed on Dec. 8, 1999, now Pat. No. 6,225,910.

(51) Int. Cl.
*G08B 21/00* (2006.01)

(52) U.S. Cl. ..... 340/630; 340/632; 356/338; 356/342; 250/573; 250/574; 250/575

(58) Field of Classification Search ..... 340/630, 340/632; 356/338, 342; 250/573–575
See application file for complete search history.

(56) References Cited

U.S. PATENT DOCUMENTS 3,312,826 A 4/1967 Finkle
3,566,385 A 2/1971 Lawson
3,708,675 A 1/1973 Tashiro et al.
3,921,158 A 11/1975 Anderson
3,922,655 A 11/1975 Lecuyer
3,968,379 A 7/1976 Crane
3,980,997 A 9/1976 Berns et al.
3,982,130 A 9/1976 Trumble
3,994,603 A 11/1976 Paschedag
4,001,800 A 1/1977 Franks
4,063,227 A 12/1977 Peterson
4,104,619 A 8/1978 Hesler
4,121,110 A 10/1978 Solomon
4,131,888 A 12/1978 Galvin
4,175,865 A 11/1979 Horvath et al.

(Continued)

FOREIGN PATENT DOCUMENTS

CH 000642473 4/1984

(Continued)

*Primary Examiner*—Julie Bichngoc Lieu
(74) *Attorney, Agent, or Firm*—Price, Heneveld, Cooper, DeWitt & Litton, LLP

(57) ABSTRACT

A compact particle sensor for detecting suspended particles includes a housing, a light source, a light receiver and a plurality of optical elements. The housing provides a test chamber and includes at least one opening for admitting particles into the test chamber, while simultaneously substantially preventing outside light from entering the test chamber. The light source is positioned for supplying a light beam within the test chamber. The plurality of optical elements are positioned to direct the light beam from the light source to the receiver, which is positioned to receive the light beam supplied by the light source.

49 Claims, 31 Drawing Sheets

U.S. PATENT DOCUMENTS

| | | | |
|---|---|---|---|
| 4,185,278 | A | 1/1980 | Lintlemann et al. |
| 4,221,485 | A | 9/1980 | Schulze |
| 4,241,282 | A | 12/1980 | Tresch et al. |
| 4,249,169 | A | 2/1981 | Malinowski |
| 4,266,219 | A | 5/1981 | Foster et al. |
| 4,266,220 | A | 5/1981 | Malinowski |
| 4,300,133 | A | 11/1981 | Solomon |
| 4,316,184 | A | 2/1982 | Nagel |
| 4,319,234 | A | 3/1982 | Rice |
| 4,374,329 | A | 2/1983 | Schoenfelder et al. |
| 4,405,919 | A | 9/1983 | Scheidweiler |
| 4,420,746 | A | 12/1983 | Malinowski |
| 4,469,953 | A | 9/1984 | Fujisawa et al. |
| 4,539,556 | A | 9/1985 | Dederich et al. |
| 4,614,968 | A | 9/1986 | Rattman et al. |
| 4,647,785 | A | 3/1987 | Morita |
| 4,675,661 | A | 6/1987 | Ishii |
| 4,678,921 | A | 7/1987 | Nakamura et al. |
| 4,680,576 | A | 7/1987 | Bauer |
| 4,700,079 | A | 10/1987 | Ito |
| 4,739,177 | A | 4/1988 | Borden |
| 4,754,150 | A | 6/1988 | Orioka et al. |
| 4,758,733 | A | 7/1988 | Mochizuki |
| 4,769,550 | A | 9/1988 | Dolnick |
| 4,851,819 | A | 7/1989 | Kawai et al. |
| 4,857,895 | A | 8/1989 | Kaprelian |
| 4,870,394 | A | 9/1989 | Corl et al. |
| 4,901,056 | A | 2/1990 | Belavia |
| 4,906,978 | A | 3/1990 | Best et al. |
| RE33,213 | E | 5/1990 | Borden |
| 5,053,754 | A | 10/1991 | Wong |
| 5,103,096 | A | 4/1992 | Wong |
| 5,117,219 | A | 5/1992 | Tice et al. |
| 5,138,562 | A | 8/1992 | Shaw et al. |
| 5,247,283 | A | 9/1993 | Kobayashi et al. |
| 5,341,214 | A | 8/1994 | Wong |
| 5,369,397 | A | 11/1994 | Wong |
| 5,400,014 | A | 3/1995 | Behlke et al. |
| 5,451,931 | A | 9/1995 | Muller et al. |
| 5,473,314 | A | 12/1995 | Mochizuki et al. |
| 5,523,743 | A | 6/1996 | Rattman et al. |
| 5,546,074 | A | 8/1996 | Bernal et al. |
| 5,552,765 | A | 9/1996 | Vane et al. |
| 5,565,984 | A | 10/1996 | Girvin |
| 5,568,130 | A | 10/1996 | Dahl |
| 5,576,697 | A | 11/1996 | Nagashima et al. |
| 5,581,241 | A | 12/1996 | Kaufman et al. |
| 5,592,147 | A | 1/1997 | Wong |
| 5,629,671 | A | 5/1997 | Morita |
| 5,646,597 | A | 7/1997 | Hamburger et al. |
| 5,673,020 | A | 9/1997 | Okayama |
| 5,691,704 | A | 11/1997 | Wong |
| 5,699,043 | A | 12/1997 | Vane et al. |
| 5,705,988 | A | 1/1998 | McMaster |
| 5,708,414 | A | 1/1998 | Peltier et al. |
| 5,719,557 | A | 2/1998 | Rattman et al. |
| 5,721,529 | A | 2/1998 | Vane et al. |
| 5,726,633 | A | 3/1998 | Wiemeyer |
| 5,751,218 | A | 5/1998 | Winterble et al. |
| 5,767,776 | A | 6/1998 | Wong |
| 5,896,088 | A | 4/1999 | Brooks, Jr. |
| 5,898,377 | A | 4/1999 | Adachi |
| 5,926,098 | A | 7/1999 | Wiemeyer et al. |
| 5,973,326 | A | 10/1999 | Parry et al. |
| 6,008,729 | A | 12/1999 | Hamburger et al. |
| 6,049,446 | A | 4/2000 | Ha et al. |
| 6,087,947 | A | 7/2000 | Hamburger et al. |
| 6,239,710 | B1 | 5/2001 | Oppelt |
| 6,362,743 | B1 | 3/2002 | Tanguay et al. |
| 6,515,589 | B1 | 2/2003 | Schneider et al. |
| 6,778,091 | B1 | 8/2004 | Qualey, III et al. |
| 2002/0089426 | A1 | 7/2002 | Qualey, III et al. |

FOREIGN PATENT DOCUMENTS

| | | | |
|---|---|---|---|
| EP | 0175940 | | 2/1986 |
| JP | 353082199 | | 7/1978 |
| JP | 354044582 | | 4/1979 |
| JP | 358018148 | | 2/1983 |
| JP | 407103892 | * | 4/1995 |

* cited by examiner

COMPACT PARTICLE SENSOR

This application is a continuation of U.S. patent application Ser. No. 09/844,229 (now U.S. Pat. No. 6,876,305), entitled "COMPACT PARTICLE SENSOR," by Applicants Brian J. Kadwell et al., filed on Apr. 27, 2001, which is a continuation-in-part of U.S. patent application Ser. No. 09/804,543 (now U.S. Pat. No. 6,326,897), entitled "SMOKE DETECTOR," by Applicants Brian J. Kadwell et al., filed on Mar. 12, 2001, which is a continuation of U.S. patent Ser. No. 09/456,470 (now U.S. Pat. No. 6,225,910), entitled "SMOKE DETECTOR," by Applicants Brian J. Kadwell et al., filed on Dec. 8, 1999, the disclosures of which are hereby incorporated herein by reference in their entirety.

BACKGROUND OF THE INVENTION

The present invention is generally directed to a sensor for detecting suspended particles and, more particularly, to a compact particle sensor.

Obscuration sensors have been utilized as smoke detectors in closed structures such as, houses, factories, offices, shops, ships and aircraft to provide an early indication of fire.

Historically, obscuration sensors have included an obscuration emitter and a light receiver spaced at a substantial distance, such as one meter or across a room, to achieve a desired sensitivity. In general, the longer the light beam path, the more likely a smoke particle will interrupt the beam and, hence, the more sensitive the obscuration sensor. Thus, there has been a tradeoff between sensitivity and compactness.

Obscuration sensors have normally been utilized to detect black smoke with particles in the range of 0.05 to 0.5 microns, which are generally produced by rapidly accelerating fires. Traditionally, obscuration or direct sensors have aligned an obscuration emitter and a light receiver such that light generated by the emitter shines directly on the receiver. When a fire exists, smoke particles interrupt a portion of the beam thereby decreasing the amount of light received by the light receiver.

A scatter sensor, commonly known as an indirect or reflected detector, is another type of sensor that has been utilized to detect smoke. A typical scatter sensor has a scatter emitter and a light receiver positioned on non-colinear axes such that light from the emitter does not shine directly onto the receiver. In smoke detectors that have included a scatter sensor, the smoke detector has included a test chamber that admits a test atmosphere, while at the same time blocking ambient light. A light receiver within the test chamber receives light provided by an emitter located within the chamber. The light level received provides an indication of the amount of smoke in the test atmosphere. Smoke particles in a test chamber reflect or scatter light from the emitter to the receiver. Most scatter sensors generally work well for gray smoke but have a decreased sensitivity to black smoke.

Obscuration sensors have been proposed that utilize a mirror within a test chamber to reflect a light beam provided by an obscuration emitter to increase the path length traveled by the light beam to improve the overall sensitivity of the obscuration sensor. In this type of obscuration sensor, the emitter and the receiver have not been located on the same axis. That is, the emitter and the receiver have been located on non-colinear axes such that light from the emitter did not shine directly onto the receiver. However, proposed obscuration sensors that have implemented a mirror have incorporated the mirror and the components in the same plane, which would yield an apparatus with relatively large dimensions in order to achieve a desirable sensitivity. Further, such sensors have implemented fixed alarm thresholds and, as such, have generally been incapable of adapting to changing environmental conditions and responding appropriately to different particle reflectivities.

What is needed is a sensitive, low cost, compact particle sensor that is equally sensitive to both low and high reflectivity particles that can be implemented within a relatively small volume.

SUMMARY OF THE INVENTION

The present invention is directed to a compact particle sensor for detecting suspended particles. In one embodiment, the compact particle sensor includes a housing, a light source, a light receiver and a plurality of optical elements. The housing provides a test chamber and includes at least one opening for admitting particles into the test chamber, while simultaneously substantially preventing outside light from entering the test chamber. The light source is positioned for supplying a light beam within the test chamber. The plurality of optical elements are positioned to direct the light beam from the light source to the receiver, which is positioned to receive the light beam supplied by the light source.

These and other features, advantages and objects of the present invention will be further understood and appreciated by those skilled in the art by reference to the following specification, claims and appended drawings.

DETAILED DESCRIPTION OF THE PREFERRED EMBODIMENTS

General Considerations

Figure 1A:
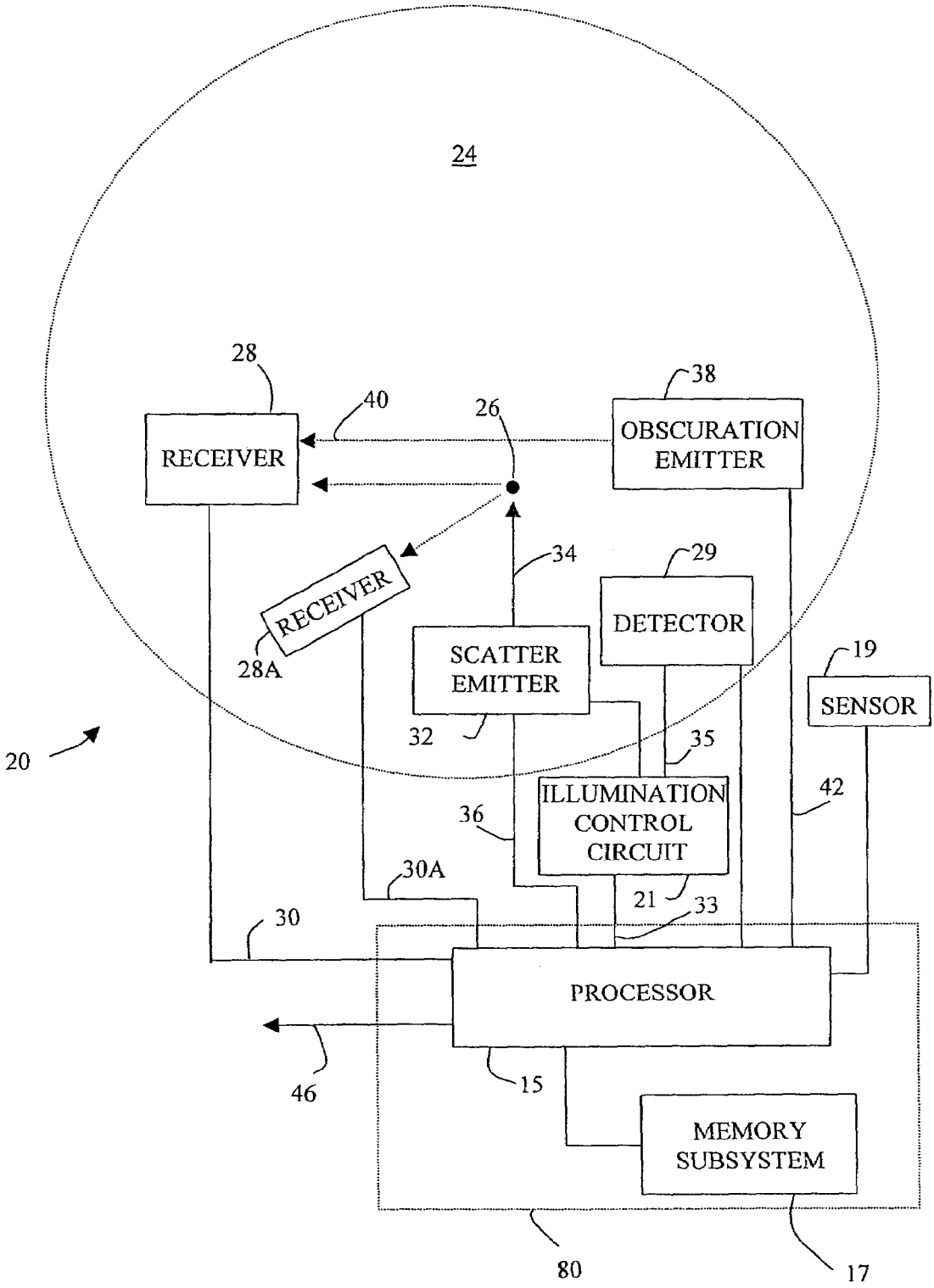
FIG. 1A is an electrical schematic, in block diagram form, of an exemplary compact particle sensor that includes an obscuration sensor and a scatter sensor, according to one embodiment of the present invention.

A weakness of many contemporary smoke detectors is their reliance on a single measured characteristic of smoke particles to indicate the presence, or lack, of smoke in a test chamber of the smoke detector. This is generally true for both ionic and optical methods of detecting smoke. In the case of the optical scatter technique of detection, the characteristic of concern is the ability of the smoke to reflect light. Although the wavelengths of light emanating from a light source may be controlled to enhance the desired response, the reflected light provides a single indicator. In the case of the optical obscuration technique, the measured characteristic of the smoke is its ability to attenuate light emanating from a light source. Again, the wavelength of light may be chosen to enhance this effect.

The ability of smoke to either reflect or attenuate light is generally determined by more than just the density of the particles suspended in the measurement medium, usually a test atmosphere. That is, the particle size, shape, texture, opacity, temperature and color all affect the reflectivity of a given density of smoke and, hence, the ability to reflect or block a given spectrum of light. This limits the ability of the smoke detector to determine particle density accurately. Most simple smoke detectors merely sound an alarm based on exceeding a pre-set light intensity threshold at the receiver and are incapable of discerning what caused the received signal. The cause of the received signal may, for example, be a high concentration of dull black particles or a low concentration of reflective white particles. However, in a typical smoke detector, the relation between particle density and received light is lost.

For the sake of explanation, a moderately to highly reflective particle is referred to herein as a "gray" particle and a minimally reflective particle is referred to as a "black" particle. However, these definitions should not lead to an inference that only particles of a certain visible nature satisfy the reflectivity requirements.

If a scatter sensor is set to sound an alarm at a predetermined density of gray smoke, the scatter sensor generally requires a much greater density of black smoke to sound an alarm, based on achieving the same reflectivity reading. Conversely, if an obscuration sensor is set to alarm at a predetermined attenuation due to black smoke, it generally requires a greater density of gray smoke to achieve the same degree of attenuation to sound the alarm. While gray smoke particles block a light beam of an obscuration sensor, as black smoke particles do, they also create a higher percentage of forward light scatter. Unfortunately, the forward-scattered light that reaches the receiver detracts from the obscuration effects of the smoke. These effects are problematic for single-mode obscuration sensors attempting to measure when the particle density in the test chamber has reached a predetermined threshold. While single-mode obscuration sensors function, particle density accuracy is a compromise chosen at the time the sensor is calibrated.

Placing both techniques of particle detection (i.e., scatter and obscuration) in a single particle sensor enhances the ability of the particle sensor to detect smoke without increasing false alarms, as compared to a sensor that implements either technique alone. With proper analysis of the scatter and obscuration sensor readings, both of which measure the same (or near-same) test atmosphere, a more consistent measurement of particle density entering the test chamber is possible. This provides a benefit in early warning detectors, such as a smoke alarm. Good sensitivity is possible at low levels of particle density, despite varying degrees of particle reflectivity, without increasing the likelihood of false alarms. As such, the alarm threshold is not a fixed, single measurement threshold. Rather, the alarm threshold is preferably based on two or more measurements interacting to create a dynamically adjustable alarm threshold.

Although this description primarily focuses on photodetection methods, which produce an output based on reflectivity or transmittance changes, it should be recognized that virtually any combination of sensor technologies can be combined to produce a dynamically adjusted threshold. For example, ion detection technology (i.e., ionization detectors) reacts quickly to fire precursors from fires that produce black smoke. As such, combining an ion sensor with a scatter sensor and varying the sensitivity of the scatter sensor based on the ion sensor will also generally produce an enhanced effect over either technique alone. Alternatively, the sensitivity of an ion sensor can be varied based on the scatter sensor. In addition, the sensitivity of the scatter sensor can also be varied based on other sensor technologies (e.g., chemical and/or temperature sensors). For example, the sensitivity can be varied based on one of a predetermined temperature, a predetermined rate of change in temperature, a predetermined chemical level and a predetermined rate of change in chemical level.

Today, commercially available products that combine an ionization detector and a scatter detector use fixed thresholds. As such, either detector may cause an alarm independent of the other detector. Thus, false alarms are also more likely based on combining the weaknesses of both technologies. As discussed herein, implementing dynamic threshold adjustment requires confirmation from both sensors that at least some level of smoke is present before sounding an alarm.

As discussed above, a disadvantage of obscuration sensors is that the output per unit of particle density is directly related to the length of the beam path through the measured media. This is especially problematic when trying to sense very low levels of particle density. At the low level of particle density required to perform an early warning smoke detector function, path lengths of less than six inches become almost unusable with cost-effective electronic circuits. The percentage change between an alarm and non-alarm condition typically requires less than a two percent change. This has generally required sophisticated, expensive circuitry to avoid false alarms. Further, simply making a straight beam longer is undesirable because it makes the overall package size of the finished product rather large and requires critical mechanical alignment.

According to an embodiment of the present invention, the beam length is increased to a distance compatible with inexpensive circuitry, while maintaining an acceptably small product size. It has been found that redirecting the light path using optical elements such as mirrors, prisms, lenses and the like, does not diminish the ability of the obscuration sensor to detect particles. The portion of the radiated beam that travels through the measured media may be summed in length and shown as equivalent to straight path performance.

However, a loss of beam brightness does occur with each reflection at a rate that is dependent on the efficiency of the optical elements. However, this loss of efficiency does not generally result in a loss of sensitivity when detecting particles. It does, however, place a practical limit as to how many reflections are allowed. The detecting means must receive adequate illumination to produce an output level appropriate for the associated circuitry, for the life of the product. Environmental contaminants such as dust, which may accumulate on the optical elements, should be accounted for in a commercial product. As in all smoke detectors, if the contaminants accumulate to the extent that the illumination reaching the receiver is inadequate, the product must be cleaned to restore normal function.

As previously mentioned, smoke detection involves sensing very small particles in the range of 50 to 1000 nanometers. In the case of most black smoke sources, the particle size is skewed toward the very low end of that range. The average particle size is small compared to the wavelength of infrared or visible light sources, which span the range of 430 to 1100 nanometers. This small size diminishes the ability of a particle to obscure the light source (e.g., an obscuration emitter). Light sources having a majority of the radiated energy near the 430 nanometer wavelength typically provide greater sensitivity to particles this small. As such, shorter wavelength light is, therefore, more likely to detect the smallest particles of concern. It is presumed that this effect continues into the non-visible wavelengths shorter than 430 nanometer and continues until the particles are no longer opaque to the light source. The wavelength effect is generally not as pronounced in a scatter sensor.

Simply placing an emitter in a location outside the field of view of a receiver produces a scatter sensor if the emitted photoenergy crosses the field of view of the receiver in the test chamber. Particles within the test chamber reflect the light off-axis and towards the receiver. As a practical matter, a very specific physical orientation of emitter and receiver produces the maximum sensitivity to the presence of particles in the test chamber. Identifying this orientation maximizes the sensor output and reduces the cost of the mating electronics.

An obscuration emitter may be almost any type of emitter that radiates light in the wavelength appropriate for particle sizes being detected. This includes incandescent and fluorescent lamps, LED and laser diodes, and the like. Narrow-band emitters have certain advantages in that reflectivity may be optimized for the task at hand. Wideband emitters also work, however, their performance as an emitter is a statistical distribution of how the energy in the band is distributed.

Although not necessary for the obscuration function, it is desirable to direct most of the radiated energy from the source to the receiver. This minimizes the stray reflections that may occur, as well as minimizing energy consumption. To accomplish this, a collimated beam of light may be created from a small light emitting area using various optical elements. If the light source emits energy in a coherent collimated fashion, no external optical elements are required to produce a beam. A laser is an excellent light source if cost and emitted wavelengths are appropriate for the device being constructed.

Practically speaking, light sources do not behave as ideal theoretical models. That is, light sources have a definite surface area and shape, such that a true point source is rarely achieved. Many light sources have a mechanical structure that blocks a portion of the available light. Structures such as connecting wires, bonding pads and support posts, required in a real world emitter, create shadows within the emitted light, causing localized intensity variations in an otherwise homogenous emission pattern. In addition, most light sources emit light in a non-coherent fashion, so laser-like beams are not available from commonly available low-cost emitters. The light source may also emit light in such a way as to create localized concentrations, or "hot spots" of light rays that vary with the distance from the light source. These realities create significant optical and mechanical problems when attempting to create an obscuration sensor. Any small movement between the emitter and the receiver can cause the "hot spots" and shadowed areas of a real-world light source to also move in relation to the receiver. Examples of these movements are external vibrations, thermal expansion-contraction of the device, or distortions caused by physically mounting the device to a wall or the like. If these shadows move in relation to the receiver, they can cause variations in the average light flux density being received. In a simple detection circuit, this variation is indistinguishable from variations caused by particles entering the space between the emitting and receiving means. To keep cost low, it is desirable to minimize the effects of defects in the emission pattern of a light source. More expensive sensor arrays, such as a charge-coupled device (CCD) video sensor, can be used to analyze the light pattern, but this adds unnecessary design complexity for many applications.

As is well known, the electromagnetic spectrum spans a wide range of wavelengths. However, the vast majority of cost effective emitters for use in an obscuration sensor span the range of approximately 430 to 1100 nanometers. Since the goal in many cases is to produce a product visible to humans (light visible to the human eye occupies the very narrow range of 400 to 700 nanometers), many emitters are available in this range. Another common use for emitters is in applications where the human eye cannot perceive that the emitter is producing illumination. Products such as remote controls exploit this fact to unobtrusively communicate between electronic devices. Products that occupy the 700 to 1100 nanometer band are called infrared (IR) emitters. Thus, the choice of emitter wavelength for an obscuration or scatter sensor is generally one of availability, as well as optimization.

As previously mentioned, it should be understood that many optical elements may be used to create an obscuration sensor. Lenses, prisms, mirrors and apertures may be used to direct light where it is needed. In general, the use of optical elements should be minimized for cost, energy efficiency and mechanical stability reasons.

Since an obscuration sensor measures light intensity, any ambient or operating temperature-induced variations in the electrical efficiency of the emitter generally result in a false particle or anti-particle reading. As such, some combination of temperature compensation hardware and software must typically be used to prevent false indications of particles in the sample space. If an LED is the light source, two technologies that normally stand out as having a lower temperature co-efficient are GaP and InGaN devices, which have lower temperature induced effects and are normally easier to compensate. It should be understood that almost any manner of light source packaging (including surface mount components) can be utilized.

Another consideration for practical use of low cost light sources is that the initial brightness may vary widely from device to device. The reasons for these variations are many. Two major sources of variation are the inherent electrical efficiency of the emitting material itself, and mechanical alignment to the optical system in the device package. Any variations caused by other optical elements, such as mirrors or lenses, should also be taken into account. A successful design must generally null out any variations that exceed the compensation ability of the measurement circuits. Traditionally, this has generally been performed during the manufacturing process with a potentiometer that is used to set an initial brightness.

There are many commercially available photosensitive devices that can act as a receiver in an obscuration or scatter sensor. Silicon photodiodes and photocells are examples of receivers that are bulk area sensors that are sensitive to light striking anywhere on their surface. Some receivers consist of an array of very small photosensitive receivers that can detect variations in wavelength, hue, brightness, etc. over the surface of the sensor. Other receivers have self-contained amplifier or A/D circuitry that allow the device to directly communicate with the logic stage of a particle detector using no other circuitry.

One of the most basic, reliable and accurate photoreceivers is the silicon photodiode, which is basically a silicon diode physically optimized for generating electrical current in response to light. Small electrical currents are produced by photons penetrating the surface and creating electron mobility. The effect is very proportional to the intensity of the light over a very wide brightness range. The larger the surface area of the diode, the greater the photocurrent produced.

These devices are packaged in a variety of ways. One of the more appropriate packages for a particle sensor receiver is the T1¾ package, also used to package LEDs. The T1¾ package collects light from a relatively large lens (e.g., a 5 millimeter diameter lens), and converges that light onto a small (e.g., a 1 mm square) photosensitive surface. This produces optical amplification of the light flux density at the active surface of the diode, producing more current than without the lens. This is normally an important feature for a scatter receiver, which must resolve very low levels of light. It is also important for the obscuration receiver, but for reasons other than light intensity.

Other devices which provide similar characteristics to the T1¾ package include packages such as the T1 (3 millimeter diameter) and TopLED (1 millimeter) surface mount packages, which offer further miniaturization opportunities, but at a reduction of photocurrent. Packages, such as, the EG&G VTP1188 (8 millimeter diameter) offer even more photocurrent than the T1¾ package at an increased cost and size. An older LED device, the Jumbo LED, actually provides a suitable photodiode housing, but is not commonly available as a photodetector.

If a lens is utilized, the active receiver surface is ideally placed with its centerline in alignment with the centerline of the lens. Sometimes this is not practical, as is the case with the T1¾ PIN diode design. The attraction of this plastic package is that large volumes of photodiodes are available. The disadvantage of the T1¾ as a receiver package is that the physical size of a photodiode is generally much larger than the LED emitter for which the package was optically designed. To maximize the surface area of the diode, the lead frame design forces the chip to be placed off-center from the lens. This placement creates an optical peak sensitivity centerline that is not the same as the physical centerline of the T1¾ package. To gain maximum efficiency as a photodetector, the physical placement should be based on the optical centerline and not the physical centerline, as is customary. In the case of the MID-54419 device from Unity Optoelectronics Technology, the peak optical efficiency centerline is tilted about 15 degrees with respect to the physical centerline.

On-chip amplification removes much of the objection to very small photocurrents. It is recognized that a smaller silicon area is practical if the photocurrent is amplified locally before being sent to the next stage. Digital diodes incorporate much of the logic required to create a signal that may be directly read by a microprocessor, or other digital logic device. A negative to this approach involves the problems of non-homogenous light sources. The smaller active area decreases mechanical stability in some designs.

It is recognized that arrays of photoreceivers may be used to further analyze changes in the received signal that go beyond an average light intensity reading. However, cost and complexity are generally too burdensome for many applications for particle sensors. On the other hand, the ability to recognize mechanical movement and distinguish that from particles in the test chamber is one desirable feature possible with an array.

Silicon photodiodes exhibit a wavelength of light versus sensitivity characteristic. PIN diodes are typically most sensitive in the 900 nanometer infrared region, with diminished sensitivity as the wavelength varies up or down. This peak efficient region may be altered somewhat by the manufacturer, but there remains a characteristic efficiency curve. Since a scatter function is relatively insensitive to wavelength of the emitter, and the receiver must resolve very low levels of light, it is generally desirable to use a scatter emitter that is matched to the peak response region of the receiver. This usually means using an infrared emitter for the scatter emitter. Since the obscuration sensor functions best with short wavelengths of light, it is generally desirable to select a wavelength for the obscuration emitter that produces an acceptable sensitivity to small particles, while staying within the acceptable range for the receiver. The emitter brightness must generally increase to compensate for any mismatch with the most sensitive light wavelength region of the receiver, which reduces the energy efficiency of the sensor.

Photodiodes exhibit a temperature characteristic that is generally dependent on the wavelength of light being received. The efficiency in converting light into electron flow varies with temperature and wavelength of the incoming light. As such, a stable design should generally incorporate a temperature compensation scheme that is matched to the light frequencies involved. At an ideal light frequency, the photodiode is not temperature dependent. If the design can accept this wavelength, the temperature stability of the sensor is increased.

As previously mentioned, to achieve the goal of an obscuration sensor with adequate sensitivity to low levels of particle intrusion, yet remain within a small circular area typically required for a smoke detector, optical elements are used to redirect the light beam. These elements may include lenses, prisms, planar mirrors, non-planar mirrors, and apertures. The goal of the redirection is to increase the optical path length, from light source to light receiver, over that provided by a straight path. This increase in path length increases the percentage change in received light, for a given density of particles in the optical path. The path length required depends on the application. For high-density particle detection, a short, straight path is adequate. For low-density detectors, such as early warning smoke detectors, a long optical path is preferred to achieve adequate sensitivity. For the purpose of early warning smoke detection, it has been found that path lengths greater than about six inches are desirable for adequate sensitivity.

The requirements of the optical system for an obscuration detector that detects low levels of particle intrusion into the folded optical path are difficult to achieve in a mass-produced product. The choice of optical elements may significantly affect reliability. Minimal, low cost materials are desirable to maintain costs below an acceptable level. High quality optical devices, while desirable, are usually quite expensive as optically pure materials with precision surface tolerances and quality finishes are expensive to manufacture. As such, it is desirable to construct an obscuration sensor using standard tolerance materials that do not require manual adjustment.

Specific Implementations

One embodiment of the present invention is directed to a compact particle sensor (e.g., a smoke detector) that utilizes a plurality of optical elements, e.g., planar and non-planar (for example, concave, conical, spherical, parabolic, etc.) mirrors, a light source (e.g., a light emitting diode (LED) and a laser diode) and a light receiver. While the discussion herein primarily focuses on mirrors, it should be appreciated that other optical elements may be utilized to direct light from a light source to a light receiver. As used herein, the term 'light source' or 'emitter' generally means any structure capable of emitting visible light, ultraviolet (UV) radiation, or infrared (IR) radiation. In a preferred embodiment, a scatter sensor is implemented in conjunction with an obscuration sensor. Among other things, the scatter sensor can advantageously be utilized to calibrate and/or adjust the sensitivity of the obscuration sensor. In at least one implementation, spherical mirrors are used to reduce light loss between the light source and the light receiver, which typically results in a lower electrical power requirement.

Utilizing spherical mirrors may eliminate the need for a lens system external to the light source and typically improves mechanical predictability of the light beam, as compared to an assembly with planar mirrors. Various embodiments of the present invention advantageously place the light source and light receiver in a different plane than that of the mirrors, which obviates the concern that the light source and the receiver will block the light beam, within the test chamber. Various embodiments of the present invention generally collimate the light provided by a light source, which is advantageous when non-homogenous light sources, such as LEDs, are utilized.

Preferably, the optical elements (e.g., mirrors) are incorporated within a molded plastic structure. When mirrors are utilized, a reflective coating, e.g., aluminum, is sputtered onto each mirror structure and an anti-oxidant or protective coating is generally applied to the reflective coating to prevent oxidation. While the discussion herein is primarily directed to obscuration sensors that are utilized to detect smoke particles suspended in a test atmosphere, with modifications the present invention is also broadly applicable to the detection of particles suspended in a liquid or a non-opaque solid. It should be understood that a greater number or lesser number of symmetrically arranged optical elements, other than those described herein, may be implemented, according to the present invention.

As is shown in FIG. 1A, a preferred compact obscuration sensor 20 (e.g., a smoke detector) includes a processor 15 that is coupled to a memory subsystem 17 (including an application appropriate amount of volatile and non-volatile memory). One of ordinary skill in the art will appreciate that the processor 15 and the memory subsystem 17 can be incorporated within a microcontroller 80, if desired. As shown, the processor 15 is also coupled to an obscuration emitter 38 and a scatter emitter 32. As an alternative or in addition to the inclusion of the obscuration emitter 38, a detector (e.g., an ionization detector) 29 may be implemented. When implemented, the ionization detector serves to detect low reflectivity (e.g., black smoke) particles and is preferably utilized to adjust the sensitivity of the scatter emitter 32. It should be appreciated that the scatter emitter 32 can also be utilized to adjust the sensitivity (i.e., an alarm threshold or illumination) of the obscuration emitter 38 (or the detector 29), if desired. As shown in FIG. 1A, the detector 29 is coupled to the processor 15 and an illumination control circuit 21. The circuit 21 may function to increase or decrease the drive current to the emitter 32 responsive to an output signal provided by the detector 29 on output 35. Alternatively, the processor 15 may vary an alarm threshold associated with the emitter 32, based on the output signal provided by the detector 29. It should be readily appreciated that the circuit 21, or another illumination control circuit (not shown), may be utilized in conjunction with the emitter 38 (to vary the drive current of the emitter 38).

Under the processor 15 control, the emitter 38 emits light (e.g., a light beam 40) and the emitter 32 emits light (e.g., a light ray 34). As is discussed further below, the light beam 40, emitted from the emitter 38, is reflected from a plurality of optical elements (not shown in FIG. 1A) located within test chamber 24, as the light beam (i.e., obscuration emitter light) 40 travels from the emitter 38 to a light receiver 28.

Unless completely or partially obscured by a particle (e.g., an exemplary smoke particle 26) or particles within the test chamber 24, the light beam 40 (or a portion of it) eventually strikes the light receiver 28. In a preferred embodiment, the receiver 28 is a silicon photodiode manufactured and made commercially available by Unity Optoelectronics Technology (Part No. MID-54419). A suitable scatter emitter 32 is manufactured and made commercially available by Unity Optoelectronics Technology (Part No. MIE-526A4U). A suitable obscuration emitter 38 is manufactured and made commercially available by Unity Optoelectronics Technology (Part No. MVL-5A4BG).

A suitable alternative light receiver is described in U.S. patent application Ser. No. 09/307,191 (now U.S. Pat. No. 6,359,274), by Robert H. Nixon, Eric R. Fossum and Jon H. Bechtel, filed May 7, 1999, and entitled "PHOTODIODE LIGHT SENSOR," which is assigned to the assignee of the present invention. The entire disclosure provided in U.S. patent application Ser. No. 09/307,191 (now U.S. Pat. No. 6,359,274) is hereby incorporated herein by reference.

An output 30 of the receiver 28 is coupled, via an output signal line 30, to the processor 15, such that the processor 15 can determine the amount of smoke located within the chamber 24. In a preferred embodiment, the processor 15 is also programmed to periodically cause the emitter 32 to emit light. A portion of the light (e.g., the light ray 34) may be reflected to a light receiver 28A or the light receiver 28, when the light ray (i.e., scatter emitter light) 34 strikes the exemplary smoke particle 26 within the chamber 24. If desired, the light receiver 28A can be omitted from the design, in which case the light receiver 28 detects the portion of the light ray 34 that is scattered from the exemplary smoke particle 26. When implemented, the scatter emitter 32 is preferably located such that the light it emits is not reflected to the receiver 28A or 28 by the optical elements. An exemplary system that utilizes one light receiver to detect light transmitted by both an obscuration emitter and a scatter emitter is further described in U.S. patent application Ser. No. 09/456,470 (now U.S. Pat. No. 6,225,910), which is assigned to the assignee of the present invention. As is common in the electronic field, the electronic components associated with the sensor 20 are preferably interconnected by a printed circuit board (PCB) (see FIGS. 1B–1C).

As shown in FIG. 1A, a sensor 19 is also coupled to the processor 15. The sensor 19 may be a chemical or temperature sensor or both, whose output can also be used to adjust the sensitivity of the scatter sensor. Alternatively, the sensor 19 may replace the detector 29 and provide an input to the circuit 21 so as to directly control the intensity of the emitter 32. An alarm output 46 is provided by the processor 15. The alarm output 46 may be directly coupled to an audible alarm or, for example, to a fire panel.

Figure 1B:
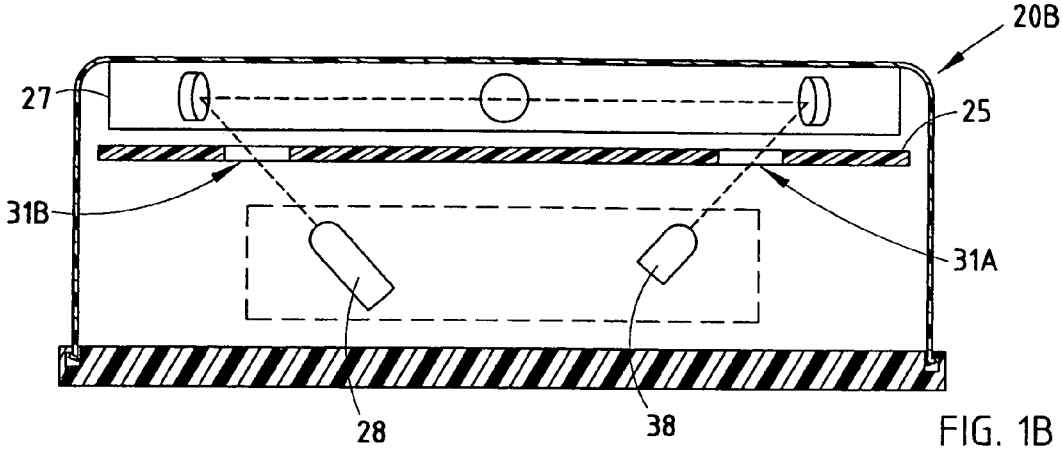
FIGS. 1B–1C are cross-sectional views of particle sensors that incorporate an optical element assembly on opposite sides of a printed circuit board (PCB), according to embodiments of the present invention.
Figure 1C:
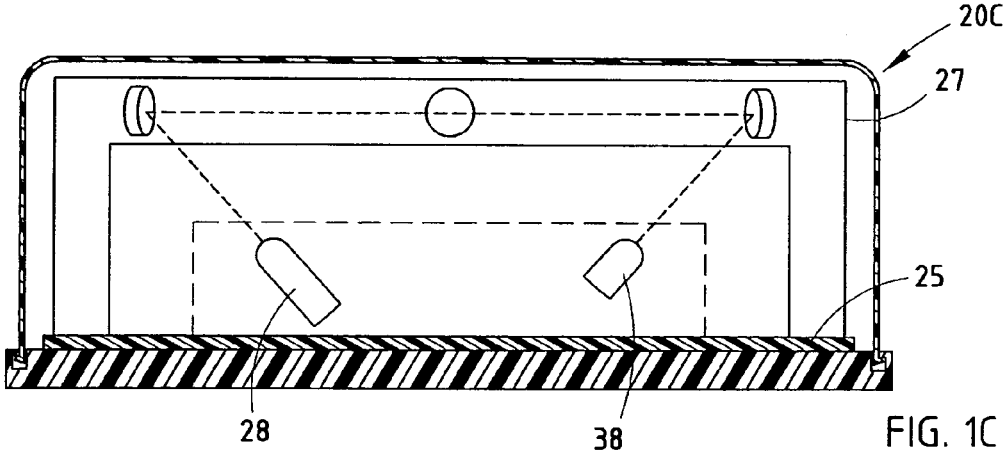

As shown in FIGS. 1B–1C, the obscuration emitter 38 and the receiver 28 may be located on either side (i.e., a component or a solder side) of a PCB 25 that interconnects the majority of the electronic components of smoke detectors 20B and 20C. FIG. 1B depicts a light beam passing from the obscuration emitter 38, through a hole 31A in the PCB 25 and into an optical element assembly 27, where the beam is reflected between components of the assembly 27, before being directed to the receiver 28 through a hole 31B in the PCB 25. Locating the emitter 38 and the receiver 28, as shown in FIG. 1B, facilitates easier installment of an external plug (e.g., providing power and connection to a fire panel), as the external plug can be placed on the component side of the PCB 25. FIG. 1C shows a smoke detector 20C where the assembly 27, the emitter 38 and the receiver 28 reside on the component side of the PCB 25. This embodiment generally requires that the external plug be located on the solder side of the PCB 25.

Figure 1D:
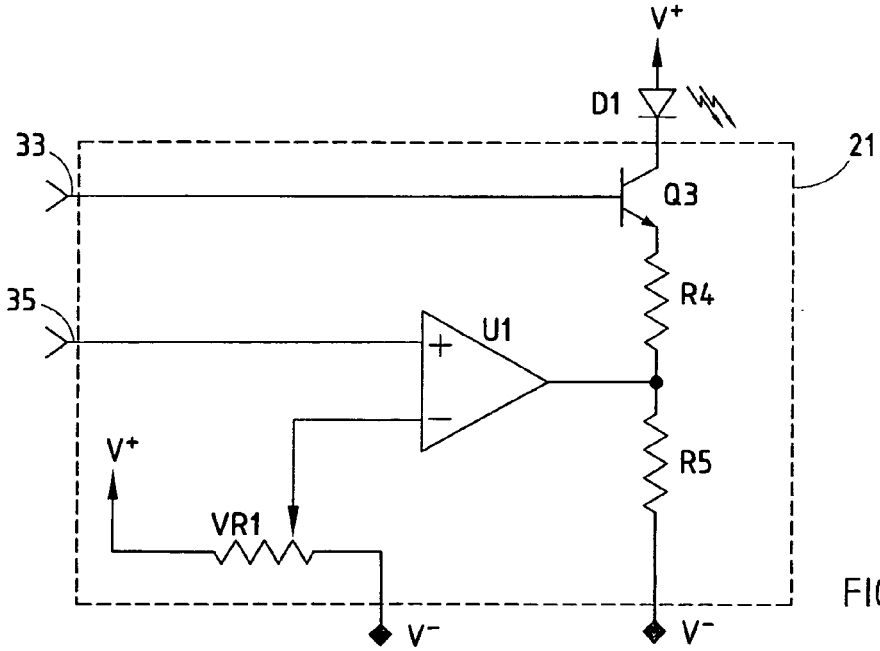
FIG. 1D is an electrical schematic of an exemplary illumination control circuit, according to the present invention.

Turning to FIG. 1D, an exemplary electrical diagram of the illumination control circuit 21 is shown. The processor 15 provides a control signal, on control line 33, to enable transistor Q3 and thus provide a current path from supply $V^+$ (e.g., VDD) through light emitting diode D1 (i.e., the scatter emitter 32) and resistors R4 and R5 to supply $V^-$ (e.g., ground). When current flows through the diode D1 it, emits light. The intensity of the light emitted by diode D1 is generally controlled by the value of the resistors R4 and R5 and the value of the supplies $V^+$ and $V^-$. As shown, a potentiometer VR1 sets the threshold for operational amplifier U1. When an output signal on the output 35 exceeds the threshold set by potentiometer VR1, the amplifier U1 conducts and the resistor R5 is shorted to supply $V^-$, which increases the current through the diode D1 and thus the intensity of the light emitted by the diode D1. Thus, in this manner the detector 29 may alter the sensitivity of the scatter emitter 32. It should be readily appreciated that circuitry other than that disclosed herein can be utilized to increase the current flow through the diode D1 and that the sensitivity of the emitter 32 can be altered in other ways.

Figure 2A:
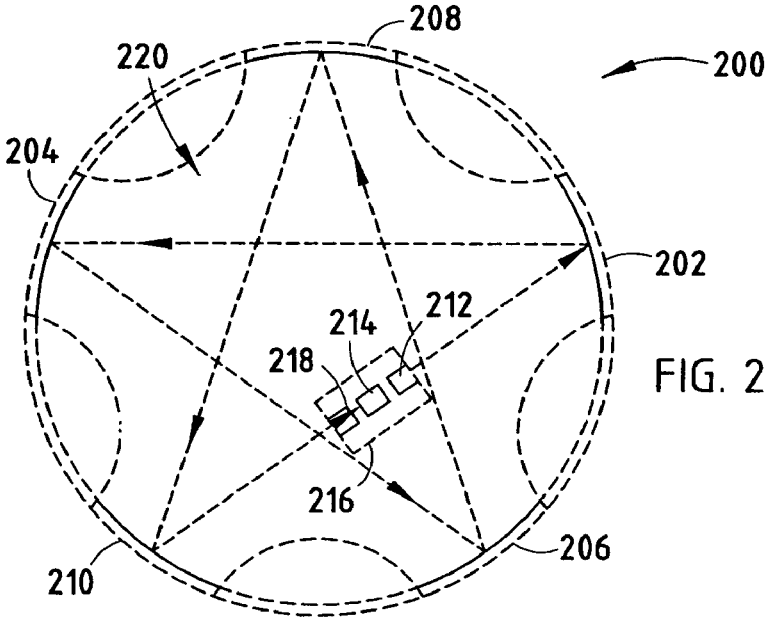
FIG. 2A is a top view of a compact particle sensor that includes non-planar mirrors, a light source and a light receiver that are implemented in the same plane, according to one embodiment of the present invention.

FIG. 2A illustrates a top view of a compact particle sensor 200 (with portions of the housing, e.g., a cover and a base, not shown), which provides about a twelve inch beam length, according to another embodiment of the present invention. For simplicity, many of the figures depicting non-planar mirrors show the mirrors as having the same radius as the circle in which they are positioned. It should be understood that the radius of a given non-planar mirror may be larger or smaller than the radius of the circle in which the mirror is positioned, as dictated by the particular application. As shown, the obscuration sensor 200 implements five non-planar (preferably, spherical mirrors) mirrors 202, 204, 206, 208 and 210, which are arranged in a circle and share a common focal point in the geometric center of the circle. The five spherical mirrors preferably have about a three inch radius of curvature and are equally spaced, at about seventy-two degrees, around the circumference of the circle. An obscuration emitter (light source) 212, located within test chamber 220, is preferably placed at an eighteen degree angle to the horizontal centerline of the mirror 202. Preferably, the sensor 200 also includes a scatter emitter 218, which can advantageously be utilized in the operation of the sensor 200. A light beam provided by the emitter 212 strikes the mirror 202 and is reflected to the mirror 204, which reflects the beam to the mirror 206. The mirror 206 then reflects the beam to the mirror 208, which reflects the beam to the mirror 210, which reflects the beam to a light receiver (detector) 214. As shown in FIG. 2A, the emitter 212, the receiver 214 and the emitter 218 are preferably positioned within a molded mounting block 216, which is positioned so as to not obstruct the light beam reflected by the mirrors 202, 204, 206, 208 and 210.

Figure 3A:
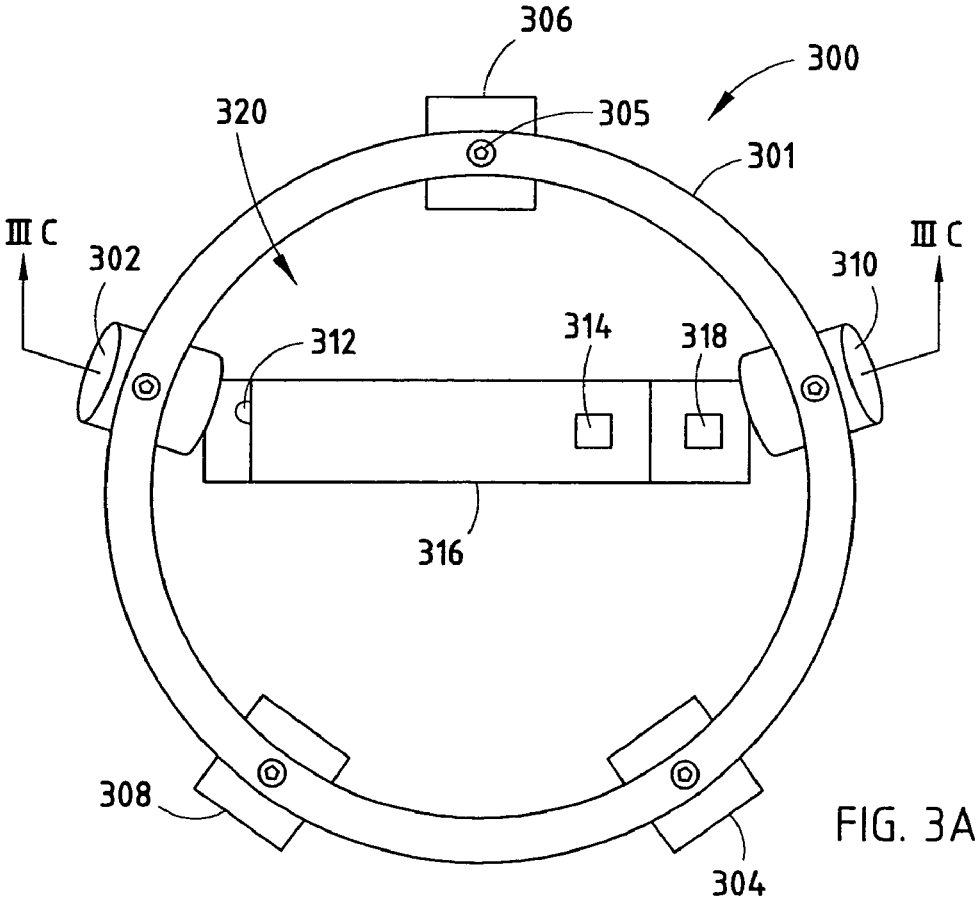
FIGS. 3A–3C are top, isometric and cross-sectional views, respectively, of a compact particle sensor that includes mirrors located in a first plane with a light source and a light receiver located in a second plane, according to another embodiment of the present invention.
Figure 3B:
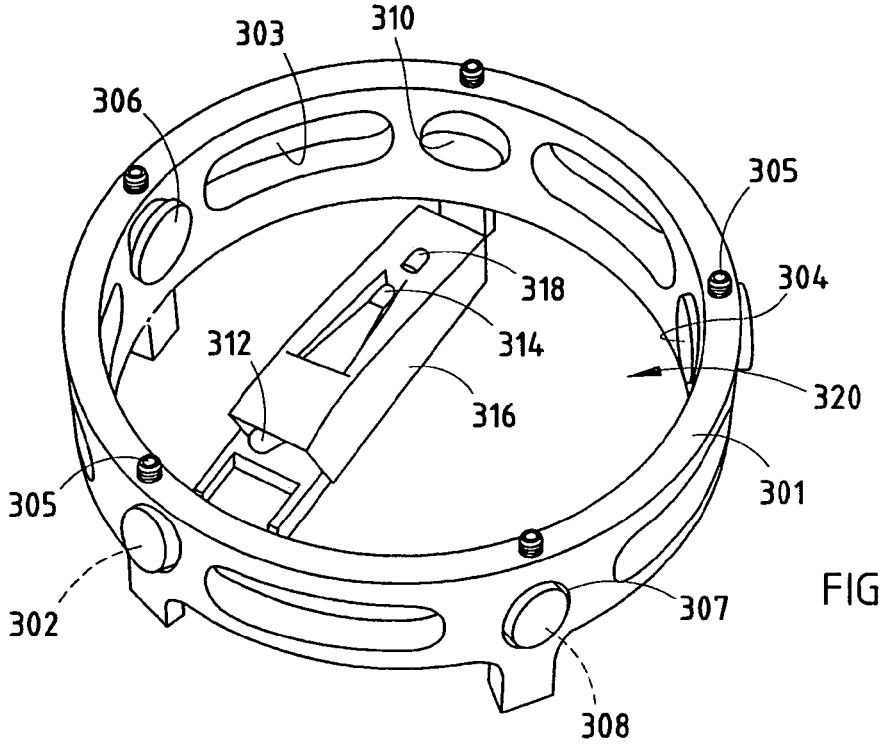
Figure 3C:
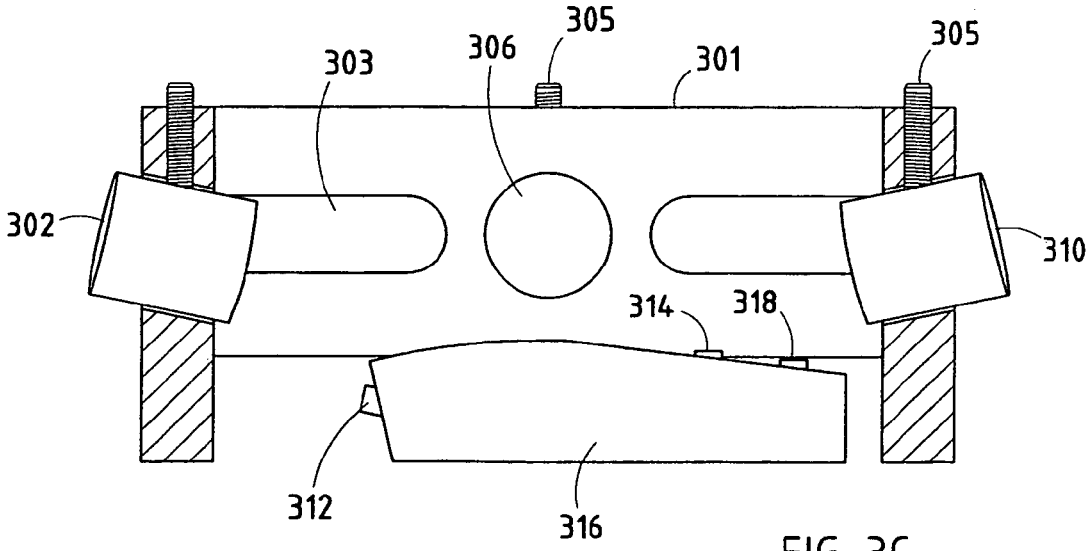

FIGS. 3A–3C depict an exemplary particle sensor 300 (with portions of the housing, e.g., a cover and a base, not shown), which implements non-planar mirrors located in a different plane from a light receiver and an obscuration emitter. As shown, the sensor 300 includes a circular ring 301 that is machined from a metal, e.g., aluminum, and has an inside diameter of approximately three and one-eighth inches. In this embodiment, the mirrors 304, 306 and 308 are machined from aluminum, have about a three and one-eighth inch radius of curvature and are aligned to share a central radial axis with the ring 301. The ring 301 includes a plurality of openings 303, which admit particles into a test chamber 320. In this embodiment, the mirror 302 is also machined from aluminum, has about a two inch radius and is rotated about twelve and one-half degrees downward (with respect to the horizontal plane of the ring) to receive a light beam provided by an obscuration emitter (light source) 312. Preferably, the sensor 300 also includes a scatter emitter 318, which can advantageously be utilized in the operation of the sensor 300. The mirror 310 is also machined from aluminum and has the same radius as mirrors 304, 306 and 308. However, the mirror 310 is preferably rotated about twelve and one-half degrees downward (with respect to the horizontal plane of the ring) to provide the light beam to a light receiver (detector) 314.

As with the sensor 200 of FIG. 2A, the mirrors 302, 304, 306, 308 and 310 are preferably spherical mirrors, which are placed in a symmetrical fashion around the ring 301. However, only the mirrors 304, 306 and 308 are placed with their focal points at a common center point (i.e., the center of ring 301). When five mirrors are utilized, a seventy-two degree angular spacing is maintained between the mirrors. Preferably, each of the mirrors 302, 304, 306, 308 and 310 is about one-half inch in diameter. Each of the mirrors 302, 304, 306, 308 and 310 are appropriately positioned through one of a plurality of holes 307 in ring 301 and are each secured by one of a plurality of screws 305. The obscuration emitter 312, e.g., a light emitting diode (LED), is preferably located at about twenty-five degrees to the horizontal plane of the ring 301.

The focal point of the emitter 312 is preferably aimed directly at the center of the mirror 302 and is located at about one inch from the surface of the mirror 302. The emitter 312 is also offset by about eighteen degrees from the central axis of the mirror 302 in the vertical plane. In one embodiment, a two millimeter aperture (not separately shown in FIGS. 3A–3C) is placed about seven millimeters in front of the emitter 312. When the emitter 312, as previously described, is utilized, the mirror 302 is preferably adjusted to have about a two inch spherical radius. The light receiver 314 is preferably placed about twenty-five degrees from the horizontal and about eighteen degrees from the central axis of the mirror 310 in the vertical plane. A light beam provided by emitter 312 is reflected from the mirror 302 to the mirrors 304, 306, 308 and 310, respectively, approximately one-half inch above the emitter 312. The light beam is then reflected from the mirror 310 at the same angle as it entered the ring 301, focused about a point substantially in-line with the focal point of the mirror 302. The light beam is essentially collimated as it exits the mirror 310.

The choice of spherical mirrors yields a light beam, which generally alternately collimates and converges/diverges after each reflection (depending on the light source utilized). The positioning of the mirrors 302, 304, 306, 308 and 310 is preferably maintained within about one-half degree in order for the sensor 300 to optimally function. The sensor 300, shown in FIGS. 3A–3C, provides a compact obscuration sensor with improved sensitivity that can be implemented within about a three and one-eighth inch diameter. As shown in FIGS. 3A–3C, the emitter 312, the emitter 318 and the light receiver 314 are retained within a molded mounting block 316, which is attached to a base (not shown). Mounting the emitter 312, the emitter 318 and the light receiver 314 within the mounting block 316 maintains the orientation of the components, with respect to the mirrors 302, 304, 306, 308 and 310, such that the sensor 300 operates reliably.

Figure 4A:
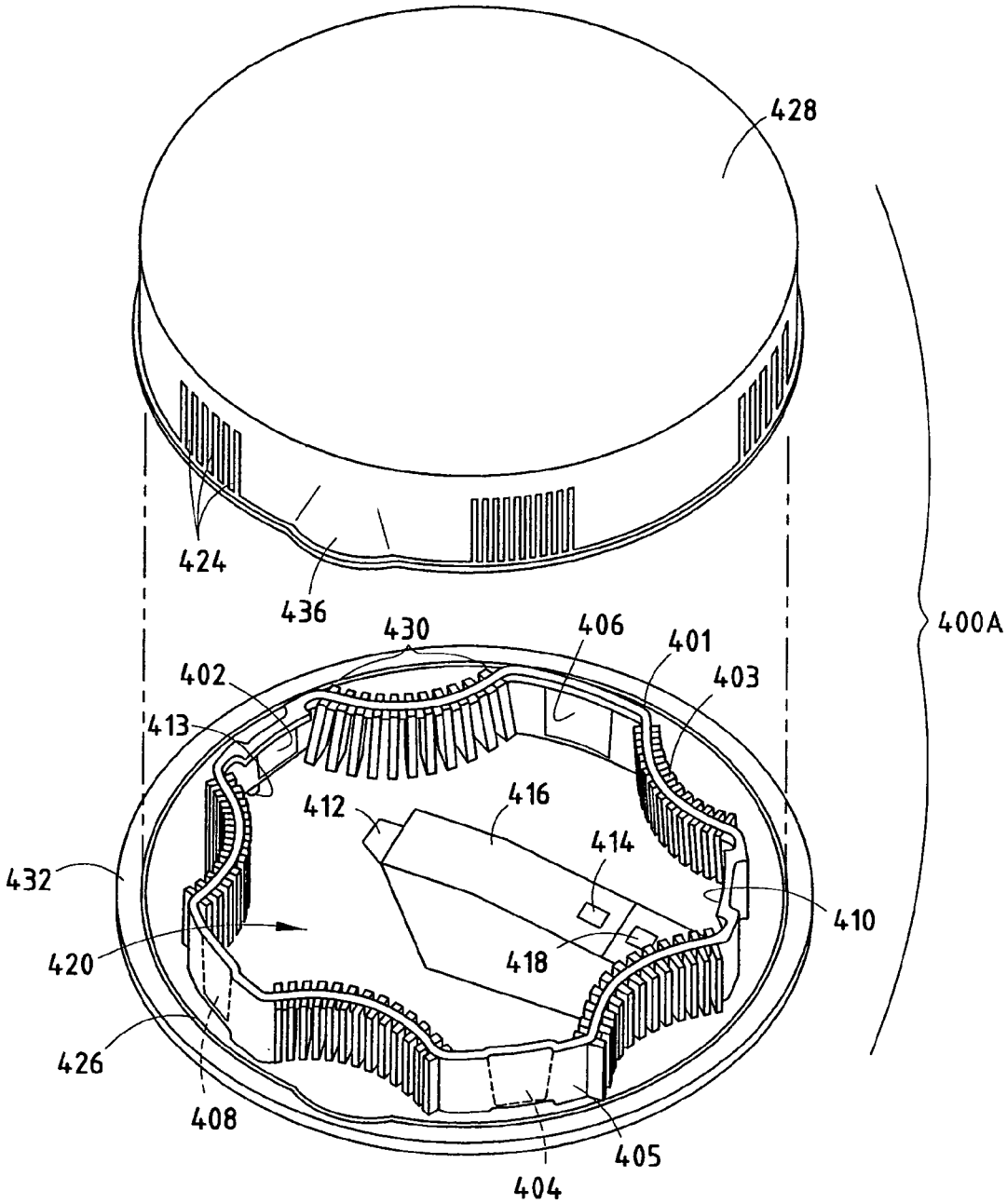
FIG. 4A is an exploded view of a compact particle sensor that includes a plurality of mirrors located in a first plane with a light source and a light receiver located in a second plane, according to a different embodiment of the present invention.

FIG. 4A depicts a particle sensor 400A, which implements non-planar mirrors located in a different plane from that of its light receiver and light source. The sensor 400A preferably includes a ring 401 that is molded from a plastic, e.g., ABS, and has an inside diameter of approximately three and one-eighth inches. As shown in FIG. 4A, the ring 401 includes five non-planar structures 405 that are utilized to create mirrors 402, 404, 406, 408 and 410. Each of the structures 405 preferably includes a post 413 that extends from its bottom edge to engage a base 432. When installed, a lip of cover 428 engages a channel 426 formed in the base 432. The cover 428 may include a key 436, which ensures proper installation of the cover 428 into the channel 426 of the base 432. It will be appreciated that the height of the cover 428 should be sufficient to avoid interference with the operation of sensor 400A. In this embodiment, the key 426 desirably locates a plurality of gratings 424 opposite an appropriate one of the structures 405 such that ambient light does not enter the test chamber 420. A baffle assembly 403, which allows smoke particles to enter the chamber 420, is retained by the ring 401. Forming the baffle assembly 403 with scooped areas 430 advantageously facilitates entry of smoke particles into the test chamber 420.

The mirrors 402, 404, 406, 408 and 410 are preferably formed by sputtering a metal, e.g., aluminum, onto an interior surface of the non-planar structures. To preserve the reflectivity of the mirrors 402, 404, 406, 408 and 410 an anti-oxidant or protective coating may be applied to the face of the mirrors 402, 404, 406, 408 and 410. Preferably, the mirrors 404, 406 and 408 have about a three and one-eighth inch radius of curvature and share a central radial axis with the ring 401.

In a preferred embodiment, the mirror 402 has a two inch radius of curvature and is formed about twelve and one-half degrees downward (with respect to the horizontal plane of the ring 401) to receive a light beam provided by an obscuration emitter (light source) 412, located in another plane. The mirror 410 preferably has the same radius of curvature as the mirrors 404, 406 and 408. However, the mirror 410 is preferably formed about twelve and one-half degrees downward (with respect to the horizontal plane of the ring 401) to provide the transmitted light beam to the light receiver (detector) 414, located in substantially the same plane as the emitter 412. As shown in FIG. 4A, the emitter 412, a scatter emitter 418 and a light receiver 414 are positioned within a preformed molded mounting block 416, which is attached to the base 432. Mounting the emitter 412, the emitter 418 and the light receiver 414 within the mounting block 416 maintains the orientation of the components, with respect to the mirrors 402, 404, 406, 408 and 410, and the base 432 such that the sensor 400A operates reliably.

The mirrors 402, 404, 406, 408 and 410, which are preferably spherical mirrors, are arranged around the ring 401 at an angular spacing of about seventy-two degrees. Similar to the sensor 300, of FIGS. 3A–3C, the sensor 400A has the mirrors 404, 406 and 408 placed with their focal points at a common center point (i.e., the center of the ring 401). Preferably, each of the mirrors 402, 404, 406, 408 and 410 is about one-half inch in diameter. As previously mentioned, each of the mirrors 402, 404, 406, 408 and 410 is formed on one of a plurality of structures 405, which are attached to the ring 401, and held in position by their respective post 413, which are configured to be retained within a hole (not shown separately) in base 432. As previously stated, the series of baffles 403 are retained by the ring 401. The obscuration emitter 412, e.g., a light emitting diode (LED), is preferably located at twenty-five degrees to the horizontal plane of the ring 401.

The focal point of the emitter 412 is ideally aimed directly at the center of the mirror 402 and is preferably located about one inch from the surface of the mirror 402. The emitter 412 is preferably offset by about eighteen degrees from the central axis of the mirror 402 in the vertical plane. In one embodiment, a two millimeter aperture (not separately shown in FIG. 4A), which can be integrally formed with the emitter 412, is placed about seven millimeters in front of the emitter 412. When the emitter 412, as previously described, is utilized, the mirror 402 has a two inch spherical radius. The light receiver 414 is preferably placed about twenty-five degrees from the horizontal and about eighteen degrees from the central axis of the mirror 410 in the vertical plane. A light beam provided by the emitter 412 is reflected from the mirror 402 to the mirrors 404, 406, 408 and 410, respectively, approximately one-half inch above the emitter 412 and the light receiver 414. In this manner, the light beam is then reflected from the mirror 410, at the same angle as it entered the ring 401, focused about a point substantially identical to the focal point of the mirror 402.

As with the embodiment shown in FIGS. 3A–3C, the choice of mirrors yields a light beam, which generally alternately collimates and converges/diverges after each reflection. The positioning of the mirrors is preferably maintained within about one-half degree in order for the sensor 400A to function optimally. The sensor 400A provides a relatively low-cost, manufacturable, compact obscuration sensor that is implemented within a three and one-eighth inch diameter circle.

Figure 4B:
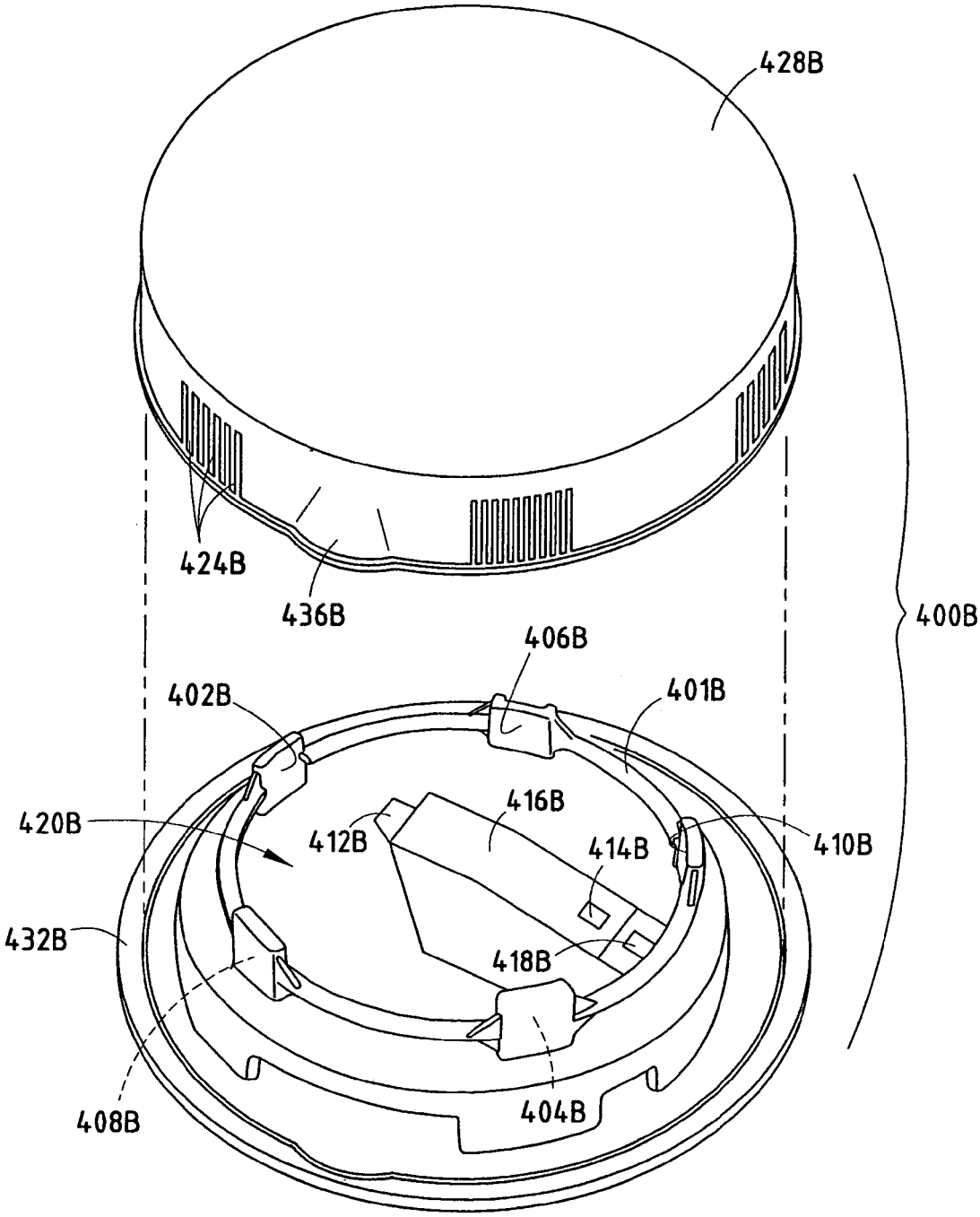
FIG. 4B is an exploded view of a compact particle sensor, according to still a different embodiment of the present invention.

FIG. 4B depicts an obscuration sensor 400B that is similar to the sensor 400A with a primary difference being that the ring 401B is formed in a circle. Forming the ring 401B in a circle generally provides more mechanical stability for mirrors 402B, 404B, 406B, 408B and 410B as compared to forming the ring with scooped portions, as shown in FIG. 4A. It should be appreciated that a baffle assembly (not shown) preferably attaches to the ring 401B and serves the same function as the baffle assembly 430 of the sensor 400A.

Figure 4C:
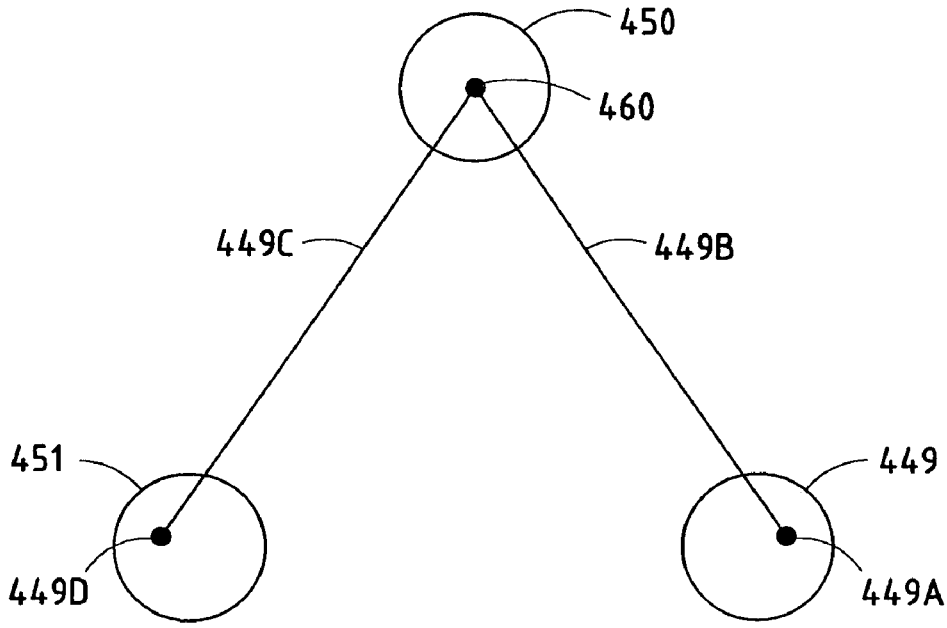
FIG. 4C is a simplified diagram of a folded path obscuration sensor, according to another perspective.

FIG. 4C depicts a reflective element 450, which receives light from a preceding element 449 and reflects at least a substantial portion of it to a succeeding element 451. The preceding element 449 may be either another reflective element in a sequence of reflective elements or a light source or a specified cross-section of a beam emanating from a light source and the succeeding element 451 may be either a succeeding reflective element in a sequence of reflective elements or a light metering element. In the case that the element 451 is a light metering element, the depicted target area 460 may be different than the actual active area of the metering element in order to provide tolerance for misalignment or other aberrations in the optical system. The three elements shown are preferably part of a larger system containing multiple mirrors or other effective elements which fold the optical path from an emitter to a receiver to generally increase the total length of the optical path from the emitter to the receiver while confining it to a space having limited dimensions. The total path length which may be contained by a given enclosure may be increased by increasing the number of reflective elements in the path. However, the reflectance of a reflective element is not 100 percent and is subject to further reduction due to surface contamination or degradation of the reflecting surface due to time and environmental exposure. Over the life of the device, the efficiency in transmitting light from the emitter to the receiving sensor must remain high enough to provide enough light at the receiving sensor for accurate measurement of the received light level. The purpose of the system is to measure or to at least compare to a reference level the attenuation in the transmitted light level due to the attenuating or obscuration effects of smoke or other substance which is present in the sampled room air or other medium which is being monitored.

To maximize the number of mirrors which may be used, the reflectance of each should be as high as can be reasonably attained and each reflective element should direct as much of the light which is received from the preceding member of the chain to the succeeding member of the chain as is reasonably possible. Choose element 450 as a representative reflective element in the chain. One way for element 450 to achieve the objective to reflect as much of the light from the preceding element to the succeeding element as is reasonably possible is for it to reflect an image of the area of 449 D onto the area of 451. In detail, when element 450 is so designed, substantially every ray 449B which emanates from a point 449A on element 449 and which strikes reflective element 450 is, after a reflective loss, reflected as ray 449C onto the point 449D, which is the image of point 449A on element 451. With the stated imaging property, the result is substantially the same for every ray which emanates from every point on element 449 and which falls on element 450 so that substantially all such light which is not absorbed or scattered by element 450 is directed to element 451. We may recursively step through the sequence of reflective elements beginning with the one to which light from the source is directed and ending with the one which reflects light to the sensor. In each case, the imaging criteria applied to element 450 is applied to the design of the selected element. When this design sequence is complete, substantially all of the light which is directed to the first reflective element from the source and which is not lost due to imperfect reflection or other aberration or by attenuation of the medium being monitored is finally directed to the area selected to illuminate the sensor. Note that as long as the imaging constraint is met, it is not necessary to have all mirrors the same size and also note that in configurations where path lengths are not all the same, active mirror areas will not be the same. Note also that relative beam path lengths will largely control the sizes of succeeding image areas. The size of each reflective element should be large enough to fully include the image which is reflected from the previous stage and is preferably larger to accommodate mechanical tolerances.

In what follows, the discussion above will be related to the FIGS. 5A–5E. A spherical mirror is a relatively good imaging device whose focal length is approximately equal to one-half of the radius of the mirror. Lens analysis will show that a radius which is approximately equal to the diameter of the circle on which the mirrors 502, 504, and 506 are placed will bring the image of the preceding mirror surface approximately into focus on the face of the succeeding mirror surface when each of the mirrors 502, 504, and 506 is considered as the reflective element. Ideally, the radii of mirrors 502 and 510 should be somewhat less than the radii of the other mirrors to image the face of the emitter 512E on mirror 504 and the active portion of mirror 508 on the area to illuminate for the sensor 514E. A ray tracing program may be used to refine the radii for each of the mirrors and optionally to determine aspheric shapes for the mirror surfaces which may improve performance. Note in FIGS. 5A–5C the tendency of the rays to be nearly parallel in one path and to cross over in an adjacent path. First, this places some preference on whether an odd or even number of mirrors are used, but does not necessarily limit the design to use only an odd or an even number of mirrors. For a regular pattern, an odd number of uniformly spaced mirror positions has an added advantage that when the star pattern in which the beam path is arranged is traversed, light emanating from the one mirror may be reflected back to an adjacent mirror as, for example, with the light from mirror 510 reflected by mirror 508 to mirror 506. When considering mirror 508 as a lens, the relatively close proximity of mirror 510 to mirror 506 keeps the angles of incidence and reflection from the surface normals of the mirror 508 small tending to minimize aberrations.

Figure 5A:
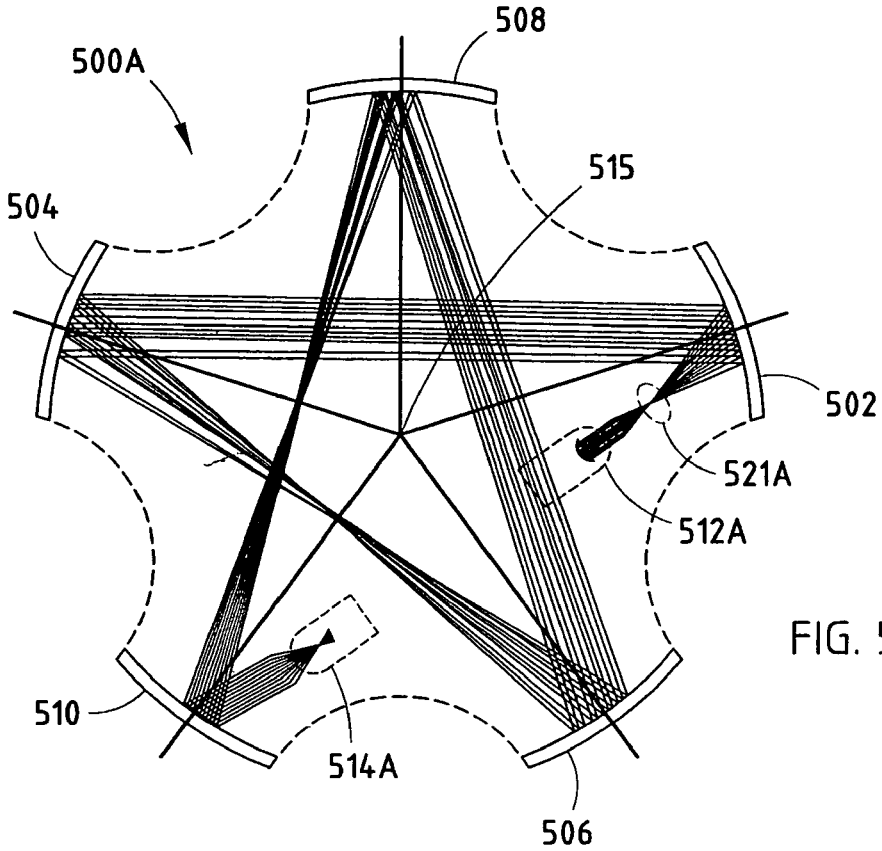
FIGS. 5A–5E are isometric views of a compact particle sensor that includes a plurality of non-planar mirrors located in multiple planes with a light source and a light receiver located in the same plane, which is different from the plane in which the non-planar mirrors are located, according to yet another embodiment of the present invention.

Especially when the area of the source is small, rays in alternate paths will be nearly parallel. An alternate way to obtain a well collimated beam is to use a laser diode as a source. Such a source may be utilized in this design but does carry a cost premium at the present time. The intent of the optical structure is to efficiently transmit the beam through a long path length, not to transmit an image even though imaging optics have been used in a preferred embodiment. The nearly parallel rays obtained by use of the laser or the small area source open the possibility to substantially alter the length of the path or paths having the nearly parallel rays with relatively small changes required in other optical elements. As a side issue, this may also have a beneficial diffusing effect on the light which traverses the optical path and finally impinges on the sensor. With the flexibility to alter path length one or more of the parallel ray paths may be extended in overall length and then redirected or "folded" into a compact pattern by inserting one or more planar mirrors in the respective path. Such flat mirrors may, for example, be used in place of one or more of the non-planar mirrors and the overall structure and mirror placement may be made similar to that which is depicted in FIG. 5A. Thus, although the preferred configuration uses non-planar mirrors, the design is certainly not limited to non-planar mirrors particularly when planar mirrors or reflectors are used in conjunction with other non-planar optical elements which may be either of a reflecting or non-reflecting type. As one specific example, a refractive lens may be used to collimate the rays from the emitter and all of the mirrors may be planar. In another specific example, the first mirror may be non-planar and designed to collimate the beam and any or all of the succeeding mirrors may be planar. This having been noted, once the tooling is prepared, there is little or no penalty in molding cost except possibly for the tooling in using the non-planar versus planar mirrors. It also appears that the design where most or all of the mirrors are non-planar tends to direct the light along the desired path making the design more forgiving of tolerance variations than the design with the highly collimated beam which is redirected by a number of planar mirrors. Furthermore, the design using non-planar mirrors does not require the very small area emitter to achieve the degree of collimation required for comparable performance which uses multiple flat mirrors and an extended collimated path in the beam.

Figure 5B:
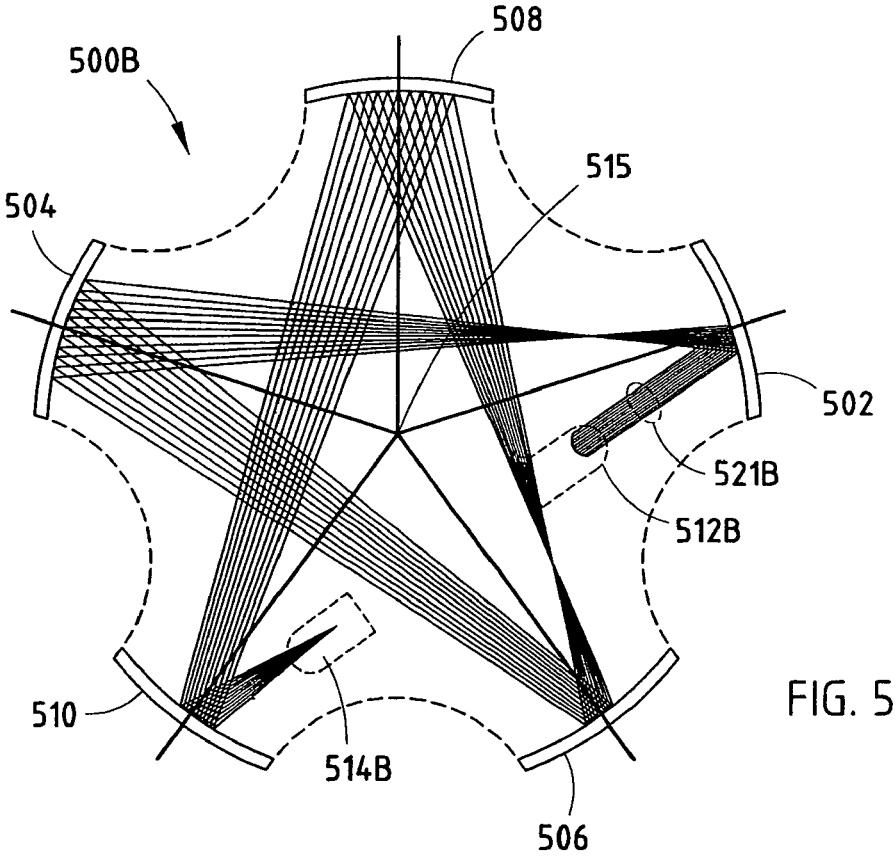
Figure 5C:
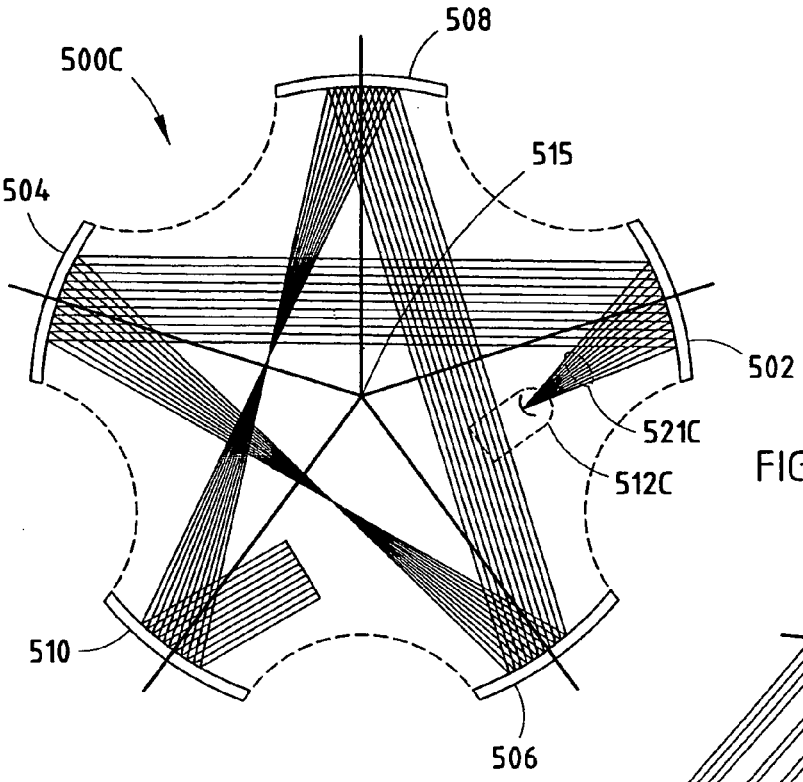

Referring again to FIGS. 5A–5E, various embodiments of the present invention that share certain characteristics and provide a particle sensor 500 (with portions of its housing, e.g., a cover and a base, not shown), which provides about a twelve to fourteen inch beam length within the confines of about a three inch circular diameter are shown. FIGS. 5A–5C show the sensor 500 with five non-planar mirrors 502, 504, 506, 508 and 510, which are distributed in a symmetrical fashion about a three inch circle. However, unlike the sensor 400A, the mirrors 502, 504, 506, 508 and 510 of the sensor 500 are tilted and offset vertically with respect to a central vertical line to create a vertical ascending and descending spiral light beam.

Figure 5D:
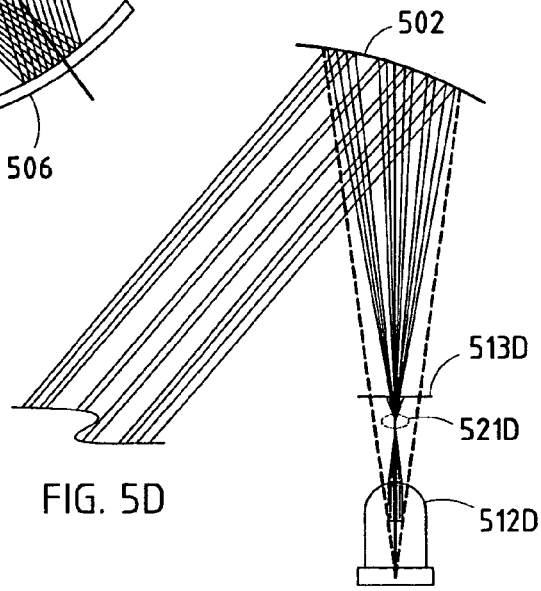

As is shown in FIG. 5A, the mirror 502 collimates a light beam 521A from an obscuration emitter (light source) 512A, when the light beam 521A, provided by the emitter 512A, is uncollimated. As is shown in FIG. 5B, when the mirror 502 receives a collimated light beam 521B, from an obscuration emitter 512B, the light beam 521B is focused on a light receiver (detector) 514B (providing the receiver 514B is located at the focal point of the mirror 510). As shown in FIG. 5C, when the mirror 502 receives a light beam 521C from an obscuration emitter 512C that is a point light source, the light beam 521C collimates and converges on alternate reflections. FIG. 5D depicts a light beam 521D with a more complex light pattern, as is typically emitted from an LED 512D that includes an aspheric lens. A two millimeter aperture 513D, which is utilized to limit the light beam 521D, is preferably placed about seven millimeters in front of the LED 512D.

The mirror 502 preferably has a focal length of one-half that of mirrors 504, 506, 508 and 510. The focal point is directed midway from the central line along a seventy-two degree normal line from the mirror 502 to the central point 515. Each of the mirrors 504, 506, 508 and 510 have a radius of approximately three inches and have their focal points along the central line. Preferably, the light source is a homogenous point source. For example, a diffused LED or a non-diffused LED behind an aperture can provide a homogenous point source. The light source is placed on or near the focal point of mirror 502 and is offset by eighteen degrees horizontally below and eight degrees vertically below with respect to normal. The light beam exits mirror 502 at a positive eighteen degrees to the horizontal and a positive eight degrees to the vertical. This provides a thirty-six degree horizontal and sixteen degree vertical trajectory.

The mirror 504 is arranged such that the light beam reflected from the mirror 502 is rendered perpendicular to the vertical centerline after reflection (i.e., a four degree vertical tilt below the centerline). The mirror 504 is aimed directly at mirror 506, which continues the reflection horizontally to mirror 508, which is on the same horizontal plane. The mirror 508 is positioned four degrees below vertical, which causes the light beam 521 to be directed toward the mirror 510. The mirror 510 is also positioned four degrees below vertical, which causes the light beam to be directed down a negative eight degrees to horizontal towards the light receiver 514.

The receiver 514 is placed such that its optical centerline is aimed directly at the center of the mirror 510. The choice of mirror geometry is desirable to maintain the light beam in a non-diverging manner. When the light beam directed toward the mirror 504 is collimated, alternate reflections will converge (odd number reflections) and then collimate (even numbered reflections). Locating the receiver 514 on the focal point of an odd number reflection usually provides a self-aligning characteristic. The sensor 500, as described, implements a helical spiral, which allows the overall sensor 500 to be smaller horizontally. That is, if the receiver 514 and emitter 512 were to be provided on the same horizontal plane as the mirrors 502, 504, 506, 508 and 510, the diameter of the sensor 500 would generally require enlargement to ensure that the physical components (i.e., the emitter and light receiver) did not interrupt the light beam. As will be appreciated, the final focal point is affected by the choice of the mirror 510, which also dictates the placement of the light receiver. Preferably, the sensor 500 is fabricated using plastic injected molding techniques, which allows critical dimensioning to be achieved and mirror alignment to be maintained at a low cost.

Figure 5E:
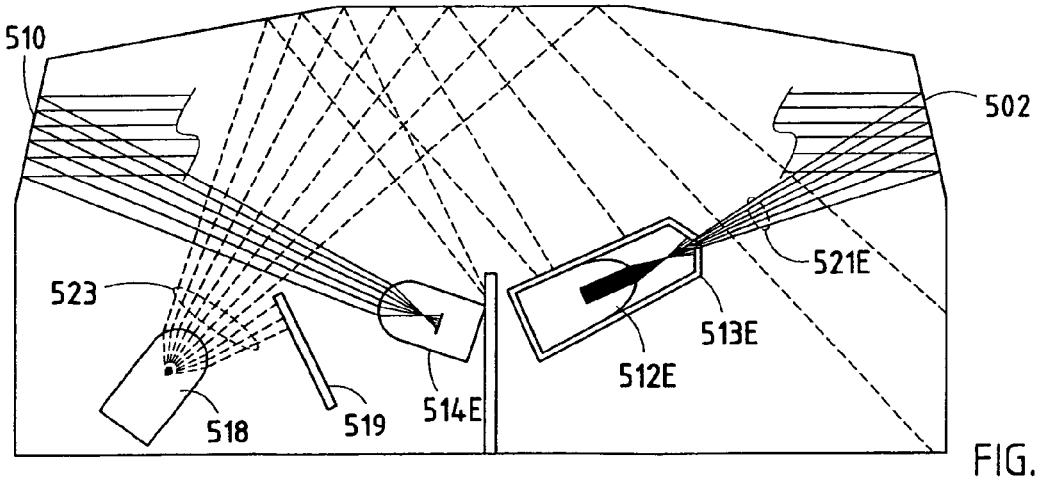

FIG. 5E illustrates a two-dimensional side view of the obscuration sensor 500, of FIGS. 5A–5C, which illustrates the positioning of a scatter emitter 518 with respect to an obscuration emitter 512E and a light receiver 514E. Light rays 523, emitted by a scatter emitter 518 are preferably blocked from directly impinging on the receiver 514E by a partition 519, which is preferably part of a molded mounting block (for example, see FIG. 4A) that retains the emitter 518, the receiver 514E and the emitter 512E.

Figure 5F:
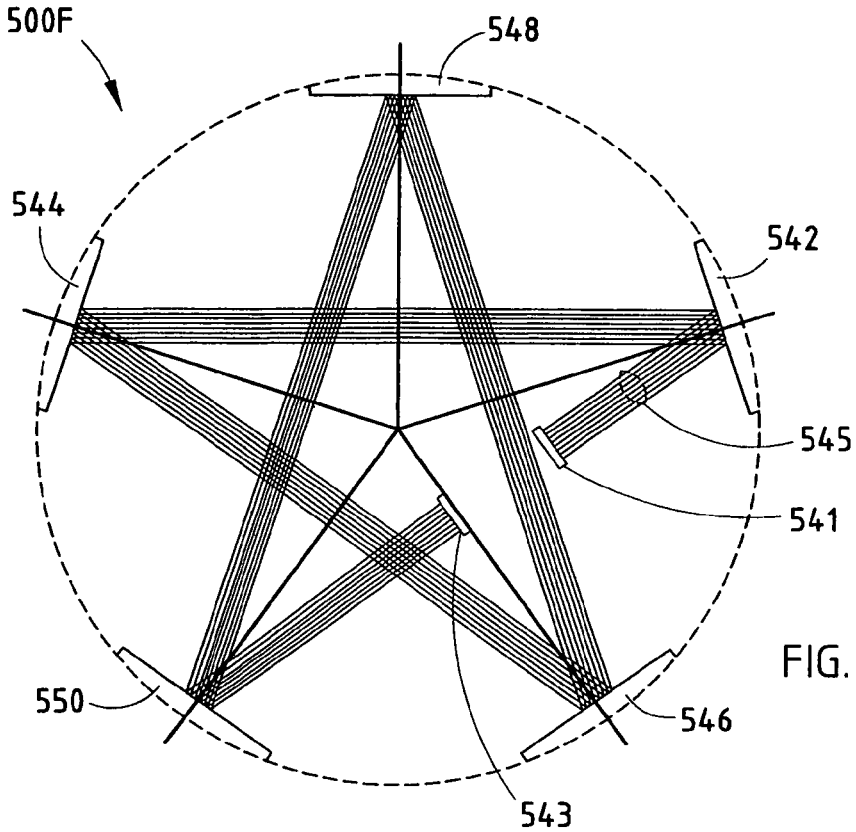
FIGS. 5F–5G are isometric views of compact particle sensors that include a plurality of planar mirrors located in the same plane as a light source and a light receiver.

FIG. 5F depicts an obscuration sensor 500F that includes five planar mirrors 542, 544, 546, 548 and 550, an ideal collimated light source 541 and a light receiver 543. As shown, all of the emitted rays 545 reach the receiver 543, which indicates the sensor 500F exhibits good efficiency and stability. It should be noted that very small mechanical shifts in any of the optical elements changes the amount of light reaching the receiver 543. When the collimated light source 511 is replaced with a point light source, very little light actually reaches the receiver 543. This is due to the fact that the light continues to diverge away from the receiver 543 after each reflection. As such, only a small percentage of the originally emitted light actually reaches the receiver 543. Further, when a point light source is used, the efficiency and stability of the sensor is generally very poor as very small mechanical shifts in any of the optical elements change the amount of light reaching the receiver 543.

Figure 5G:
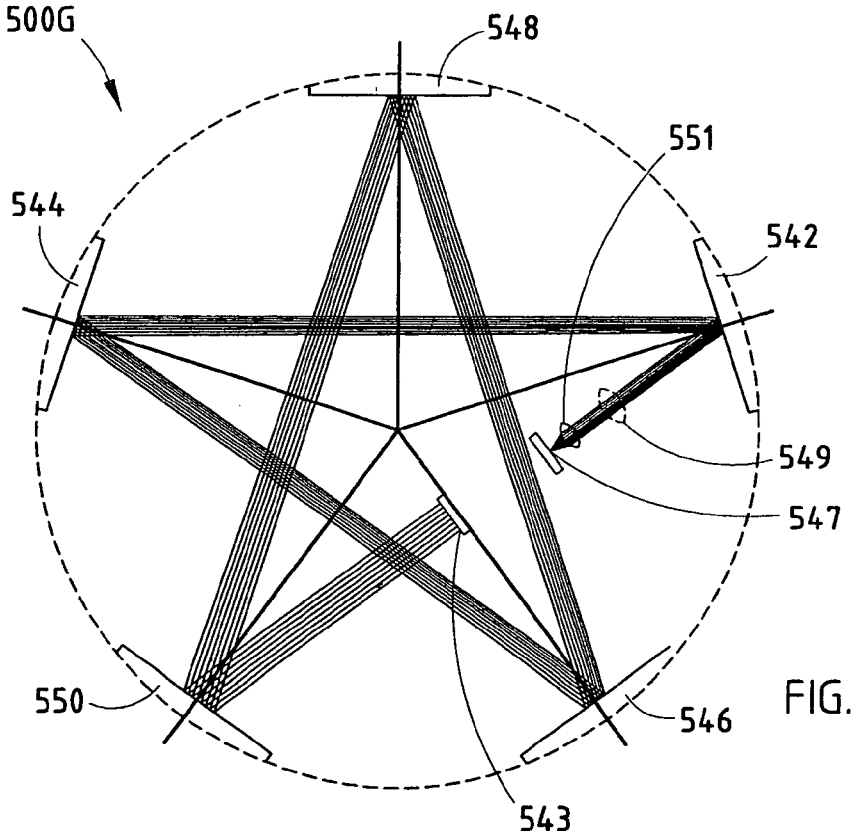

FIG. 5G depicts a sensor 500G that uses a collimating lens 551, added to remove the diverging nature of the point source light rays, in conjunction with a point light source 547. The sensor 500G functions much like the sensor 500F with the exception that the sensor 500G is even more mechanically unstable due to the addition of the lens 551. When a non-ideal emitter is utilized, the lens 551 directs the point source rays 549 efficiently to the receiver 543, while degrading reception of any collimated light rays. As previously discussed, commercially available light sources behave as non-ideal emitters in that they exhibit characteristics of multiple point sources emanating from multiple points and also produce collimated light. Further, actual light sources, such as LEDs, utilize reflectors and lenses that distort the ideal source even further. While designs using only planar mirrors with a single lens can function as an obscuration sensor, the mechanical stability, repeatability and efficiency of such a design is generally unsuitable for low-cost, high-volume production.

To address the constraints imposed by non-ideal light emitters and high volume production, another technique is generally preferred to redirect the light emitter rays to the light receiver, while maintaining a long optical path through the test chamber. The preferred optical design allows a minimum of modest quality optical components to reliably direct a majority of emitted light to the receiver. Image quality, usually a concern in most optical designs, is normally not a significant concern in this application. However, consistency and efficiency of illumination of the target area is typically a high priority. Further, when non-planar mirrors are implemented, small mechanical shifts in the optical components (i.e., the light source, receiver and mirror assembly) generally reduces the light intensity variation at the receiver in the absence of particles in the test chamber.

Figure 5H:
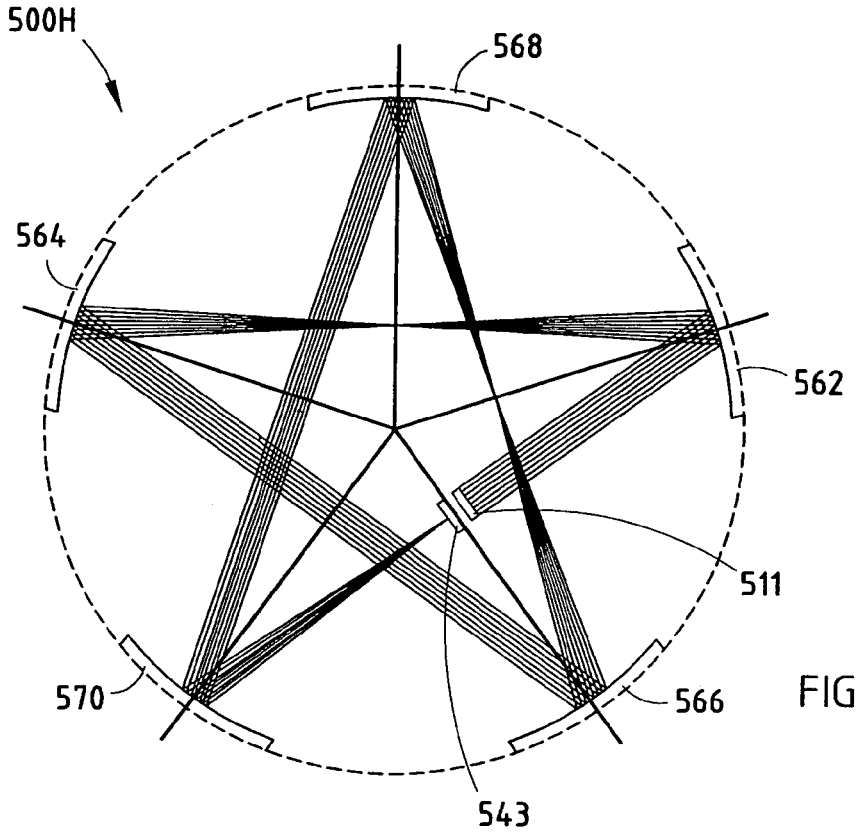
FIGS. 5H–5R are isometric views of compact particle sensors that include a plurality of non-planar mirrors located in the same plane as a light source and a light receiver.
Figure 5I:
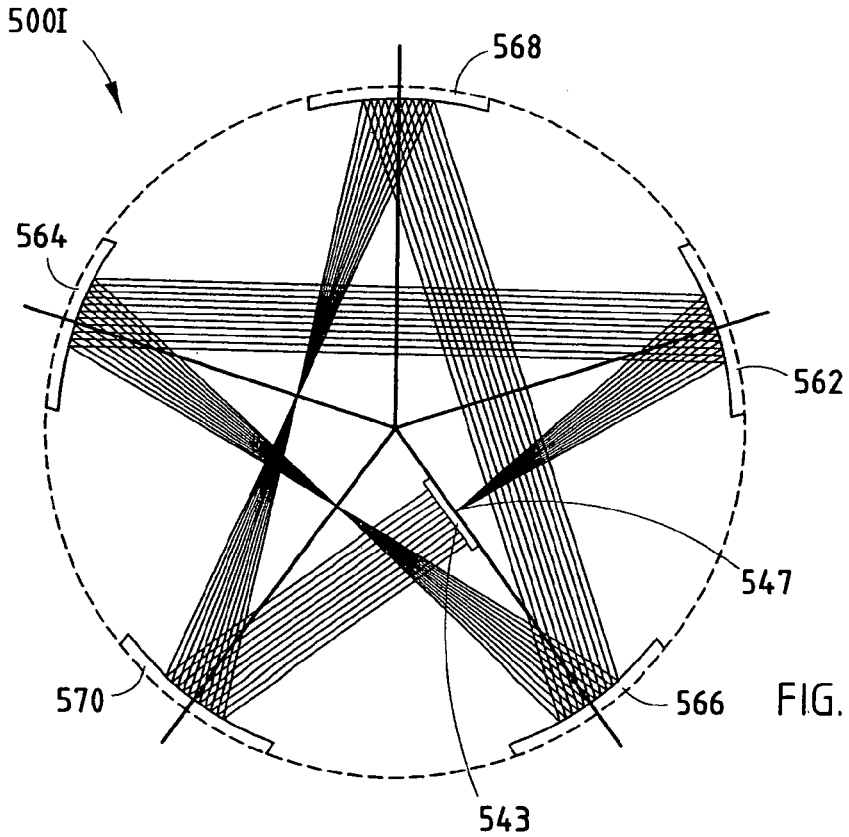

FIGS. 5H–5I depict sensors 500H and 500I, respectively, which each include five non-planar (preferably, spherical) reflective surfaces (e.g., mirrors) 562, 564, 566, 568 and 570 that are placed in circular fashion, in this case, on the same plane. If desired, the light beam may travel through a single plane or multiple planes as it traverses the mirror assembly. As previously discussed, the path is determined by the tilt of the mirrors 562–570 in all three axes. In FIGS. 5H–5I, all of the mirrors 562–570 have their centerlines intersecting at the center of the circle that defines their position in relation to one another. The circular pattern best demonstrates the optical characteristics and is appropriate for a sensor that must generally accept particles from multiple directions. As previously discussed, similar optical benefits are possible with a fewer or greater number of mirrors.

Of interest throughout the following discussion is that the effective beam length is greater than about 2, 3, 4 and 5 times (preferably about 4.5 times) the diameter of the circle that contains the beam, depending on the number of optical elements implemented. This makes it practical to construct an early warning smoke detector with a beam length much greater than six inches, yet still stay within the confines of a package much smaller than six inches.

The five mirrors 562–570 in FIGS. 5H–5I are located at 72° angular increments on the circumference of a circle having radius 'X', where 'X' may be any dimension appropriate to the task at hand. The radius of curvature for each mirror 562–570 is set to be about '2X'. The five mirrors 562–570 may be fashioned from one piece of material, or they may be individual mirrors mounted separately. The surface area of these mirrors may be set as appropriate for the beam diameter that is propagated through the sensor with an oversize factor to account for mechanical tolerances.

FIG. 5H demonstrates the optical characteristics of the sensor 500H, when a collimated light source 511 is used. In this specific arrangement, the light source 511 is placed at about an eighteen degree angle to the physical centerline of the mirror 562 and in the same plane as the mirrors 562–570. A receiver 543 is placed facing away from the path of emitted light, along the same eighteen degree angle, facing the mirror 570. This angle also intersects the centerline of the last mirror 570. The collimated light rays are directed to the mirror 562 and then reflected from mirrors 564, 566, 568 and 570 in a pattern that resembles a five-pointed star. The positioning and spherical radii of the mirrors 562–570 contain the light rays in a non-diverging manner until striking the receiver 543. This results in a very high efficiency with losses primarily dictated by the efficiency of the reflecting surface of the mirrors 562–570. The configuration also provides very little off-axis light to reflect in unintended ways.

FIG. 5I demonstrates a similar physical assembly as that shown in FIG. 5H. However, in FIG. 5I, the collimated light source 511 has been replaced with a point light source 547. It should be noted that virtually all of the rays emitted from the source 547 find their way to the receiver 543, in a similar manner to that of the collimated light source 511. The sensors 500H and 500I of FIGS. 5H–5I demonstrate what could not be accomplished with planar mirrors, or a single lens system used in conjunction with planar minors. That is, the mirror assembly of the sensors 500H and 500I direct a majority of the collimated and point source light rays to the receiver 543, simultaneously, which is significant when dealing with non-ideal light sources with emission patterns that contain elements of both.

Figure 5J:
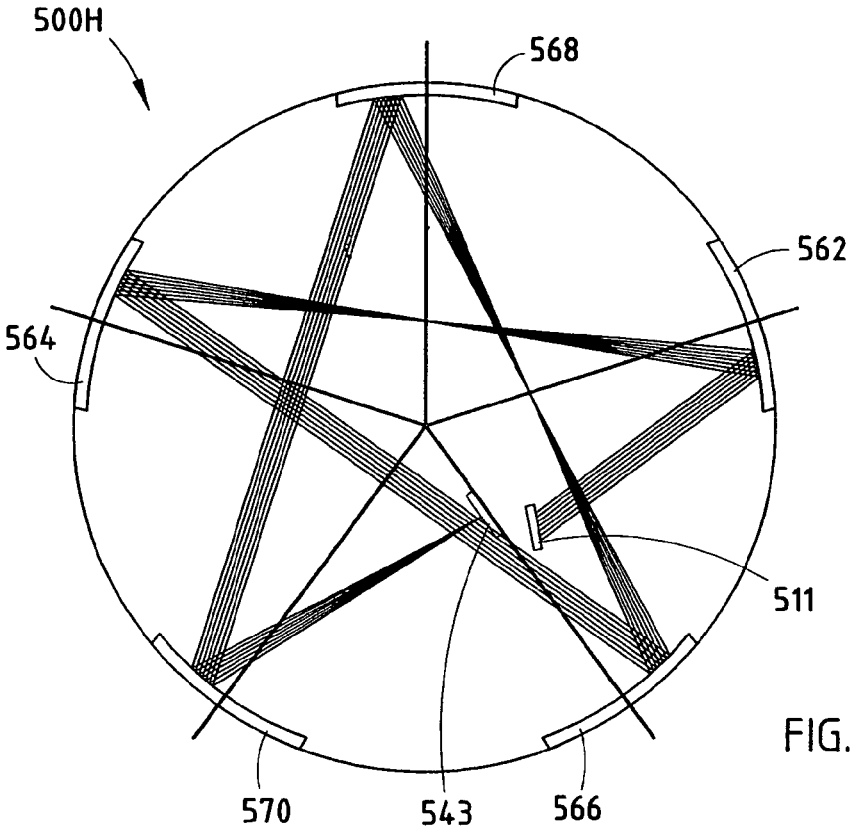
Figure 5K:
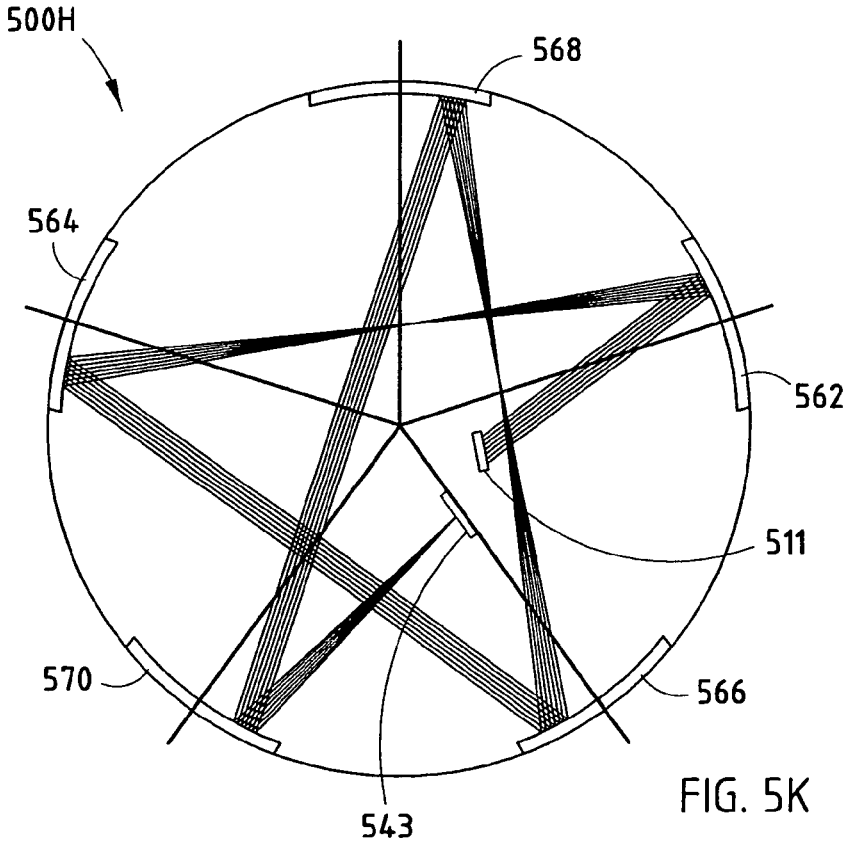

FIGS. 5J–5K demonstrate the high tolerance to mechanical errors that the sensor 500J can tolerate in positioning the light source 511. In spite of the light source 511 being moved significantly off-axis, all of the light rays still strike the receiver 543 at substantially the same location. This is an important characteristic for mass-production and obviates the need for adjusting the light source 511 location to a fine degree. As such, adjustment screws are not required for alignment of the position of the light source 511. Further, high tolerance for mechanical alignment of the light source 511 suggests a high tolerance for vibration and other sources of mechanical movement.

Figure 5L:
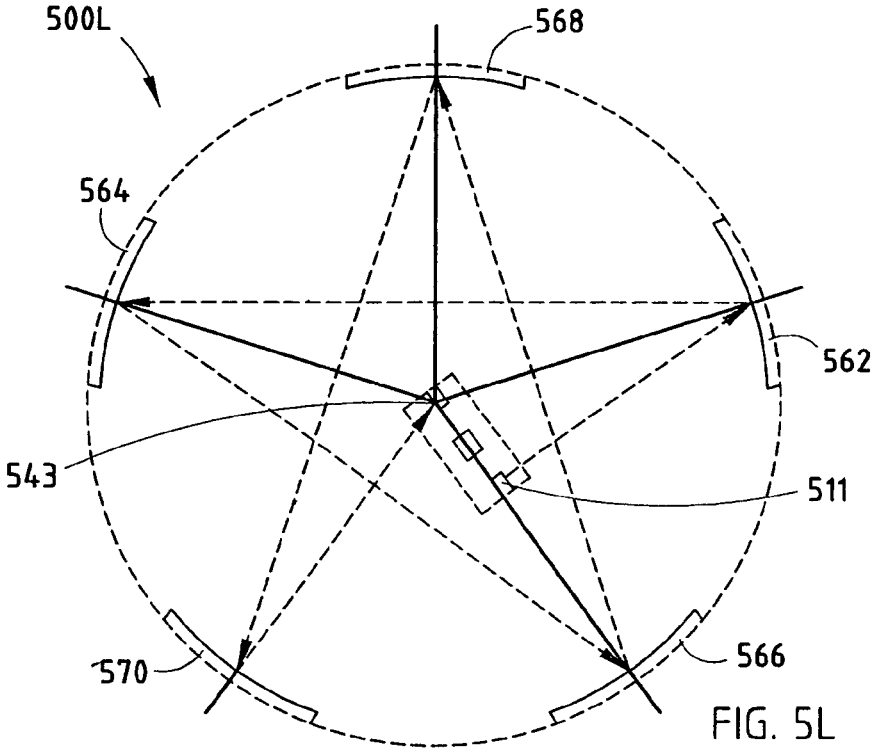

However, adjustments may be required to the idealized optical model described in FIG. 5H to accommodate physical realities. As previously discussed, the sensor 500H has all optical elements in the same plane, which requires the emitter to originate at the same point the light is received. In many situations, physical realities may not allow all of the optical components to be located in the same plane, as the light emitting and receiving components must not generally block any portion of the beam path. One of the least disruptive variations is shown in FIG. 5L. The only variation from the sensor 500H, depicted in FIG. 5H, is that mirror 570 has been tilted eighteen degrees off-axis, towards the center of the circular area containing the assembly. The receiver 543 is then placed at the center of the assembly rather than in-line with the emitter 511. The desirable optical characteristics of the sensor 500H are, for the most part, preserved by this change. This displacement technique allows for versatility in where the receiver 511 is located. As previously discussed, the light rays may also be offset in three dimensions as required to accommodate the components. This is accomplished by intentional tilting of the mirrors, which has a minimal adverse affect on the desirable optical characteristics of the sensor.

The focal points of the mirrors 562 and 570 may also be altered to accommodate the movement of the emitter 511 and the receiver 543 with respect to the mirrors 562 and 570. As will be appreciated, changing the focal point of spherical mirrors requires alterations to the radius of curvature of the mirrored surface. However, such changes may have a detrimental affect on mechanical stability of the sensor and, therefore, should be used sparingly.

As previously mentioned, shadows and other defects in the light beam caused by the physical construction of the emitter attenuate the average illumination level at the receiver. These defects may be ignored if their contribution to the average illumination level is stable over time. If not stable, the resulting change in average light levels will be indistinguishable from particles (or anti-particles) entering the test chamber. As an example, any mechanical movements that shift an optical defect over a different percentage of the photosensitive area of the receiver will cause a change in light intensity received, which affects the basic accuracy of the particle sensor. As such, sudden movements are especially troublesome.

One way to address this is to assure an extremely rigid assembly by using very stable materials, such as solid aluminum, and avoid any physical movements in the entire optical system that are not proportional to the basic geometry. A very large photoreceiver, with a large photosensitive area to capture all the light, is another solution. However, the materials used as photosensitive surfaces are usually too expensive to be made large enough to be of practical value. A less expensive method is to use a lens to concentrate the incoming beam into an area smaller than the photosensitive area of the receiver. Standard LED technology provides such a lens in most forms that are commercially available. By packaging the photosensitive receiver in an LED package, such as the T1 ¾ style, an integral condensing lens is generally provided. The MID-54419, manufactured by Unity Optoelectronics Technology, is one example of such a device.

The T1 ¾ package is designed to house an LED chip, not a photoreceiver. As such, the package does not allow the relatively large photochip to be mounted directly under the lens and is, therefore, offset to one side. This offset may be compensated for by tilting the device in relation to incoming light. The incoming light rays are then concentrated into an intense point of light, centered on, and smaller than, the photosensitive device within the T1 ¾ package. In this manner, small mechanical movements shift the light within the boundaries of the photosensitive area. This is beneficial for stabilizing the amount of light received from a light source that has defects in intensity. Since all of the defects are contained within an area smaller than the surface of the photoreceiver, small movements have a minimal affect on average light received.

Figure 5M:
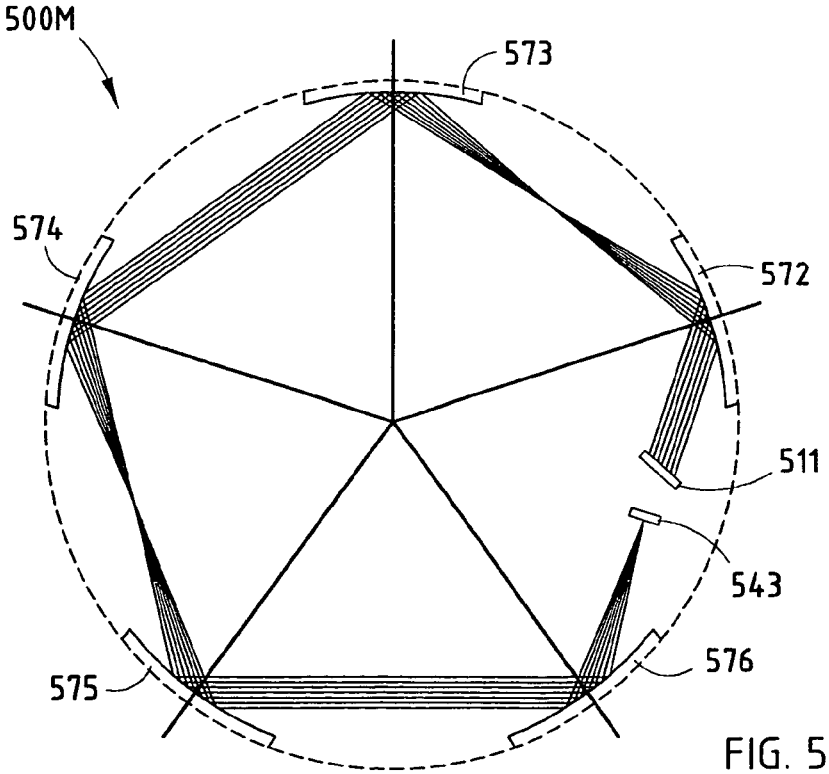

A sensor 500M, of FIG. 5M, demonstrates another useful orientation of the light source 511 and the receiver 543 to non-planar mirrors 572–576. In this case, the light source 511 is located fifty-four degrees off-axis to one of the five non-planar mirrors (in the case shown, mirror 572). The resulting beam length is shorter than the eighteen degree orientation previously described, but may prove beneficial in specific applications. The arrangement exhibits somewhat less mechanical stability than the eighteen degree version, but significantly more than assemblies with planar mirrors.

Depending on the design constraints, fewer or greater numbers of mirrors may be employed to achieve a beam length having the proper sensitivity. The angular spacing between the mirrors changes according to the number of reflections, but the mechanical benefits remain the same for, at least, any odd number of reflective surfaces. It is contemplated that an even number of reflections may be useful where mechanical stability is generally of less concern.

Figure 5N:
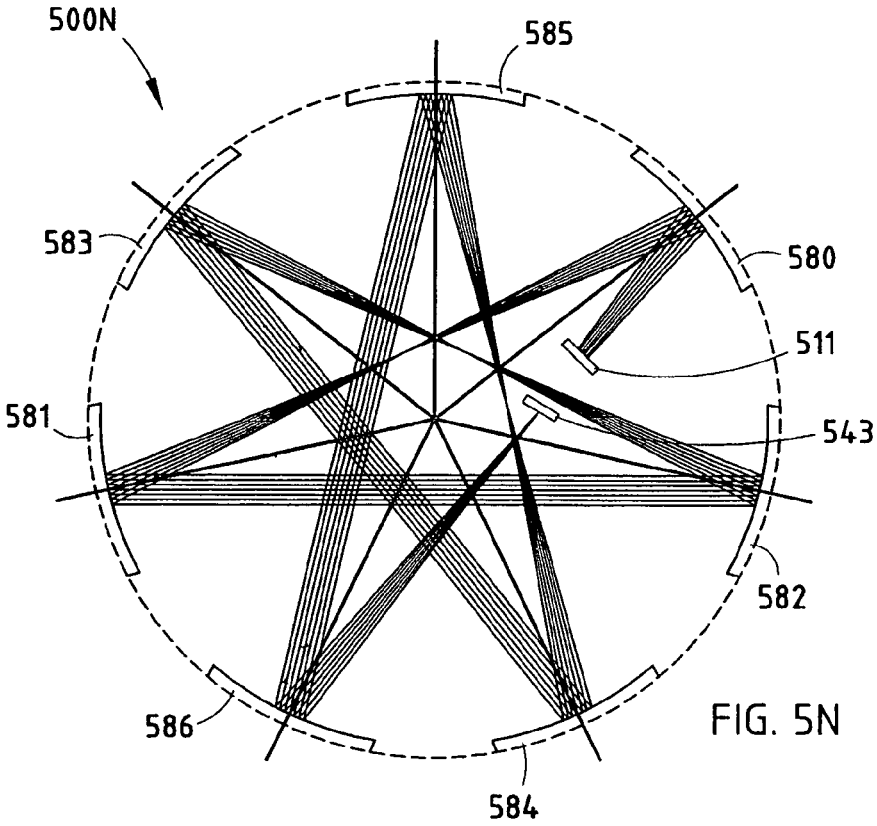

FIG. 5N depicts a sensor 500N that includes seven non-planar mirrors 580–586 that generally share the same optical benefits as the five mirror sensor 500H, of FIG. 5H, with an approximate beam length of 6.5 times the diameter of the circular area. As shown, two more non-planar mirrors are added to the arrangement disclosed in FIG. 5H. As such, the placement angles are preferably reduced from 72 degrees to 51.43 degrees. Further, the light source 511 is preferably placed at a 12.86 degree angle, rather than 18 degrees, in relation to the centerline of the mirror 580. With additional mirrors, e.g., 9, 11, 13, etc., a correspondingly longer beam is achieved, but efficiency and stability of the reflective surfaces becomes increasingly important.

Figure 5O:
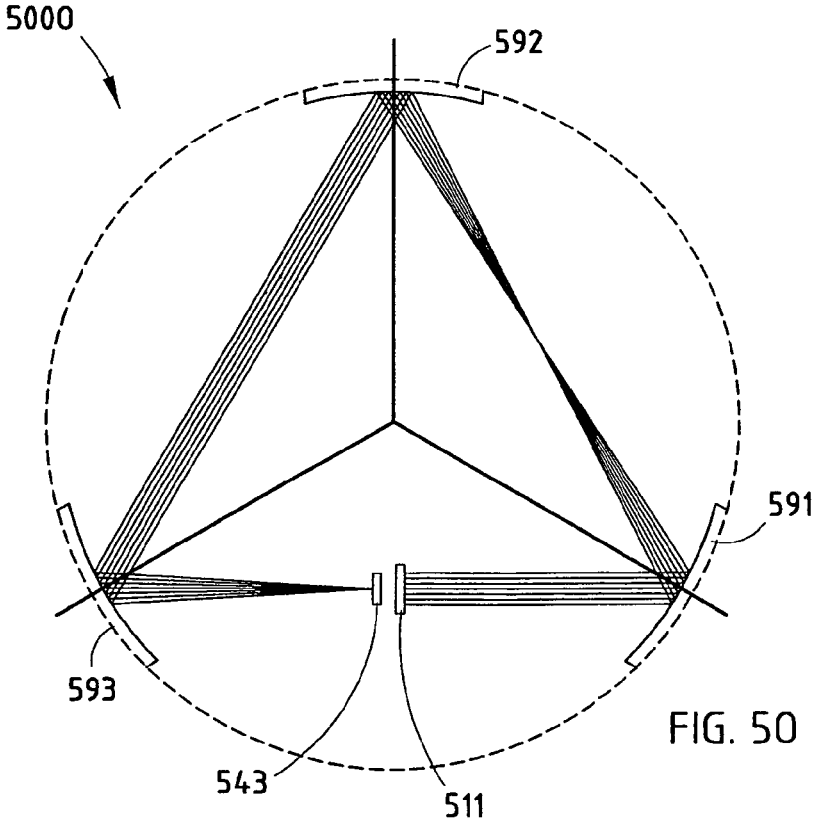

FIG. 5O shows an obscuration sensor 500O that implements three non-planar mirrors 591, 592 and 593 that share the same optical benefits as a five mirror sensor, with an approximate beam length of 2.5 times the diameter of the circular area. As constructed, two non-planar mirrors are removed from the arrangement disclosed in FIG. 5H. The placement angles are increased from 72 degrees to 120 degrees. The light source is preferably placed at a 30 degree angle, rather than 18 degrees, in relation to the centerline of the first mirror.

Figure 5P:
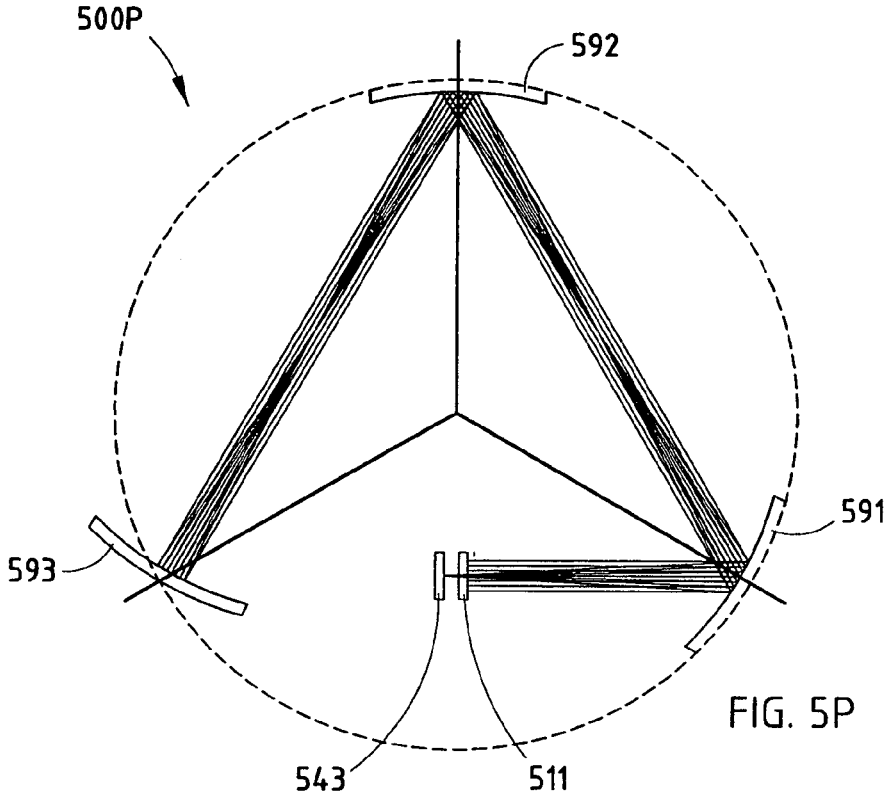
Figure 5Q:
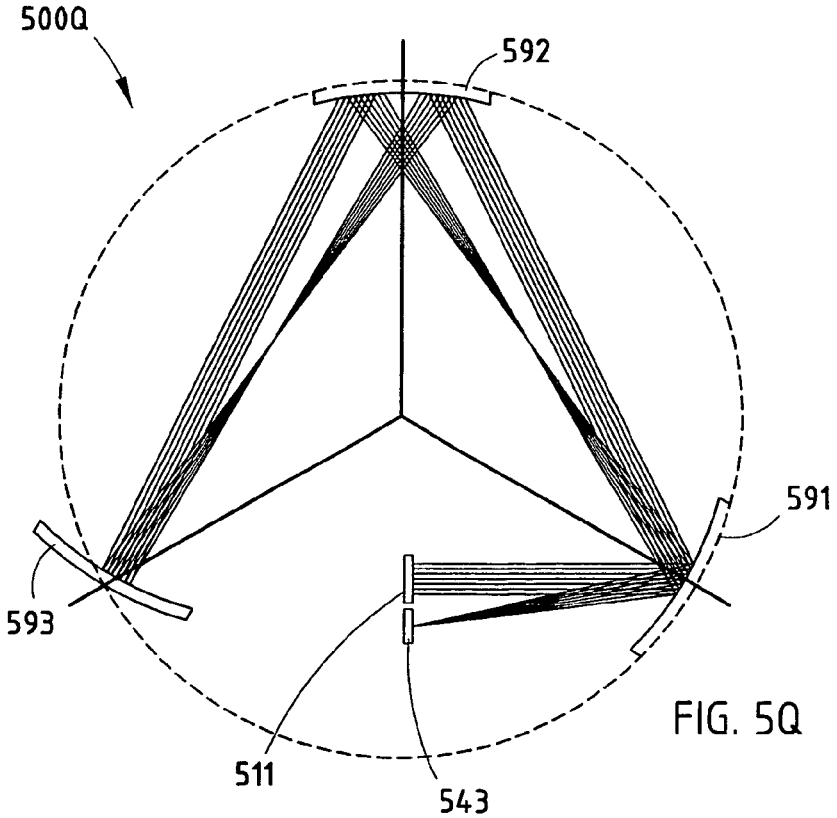
Figure 5R:
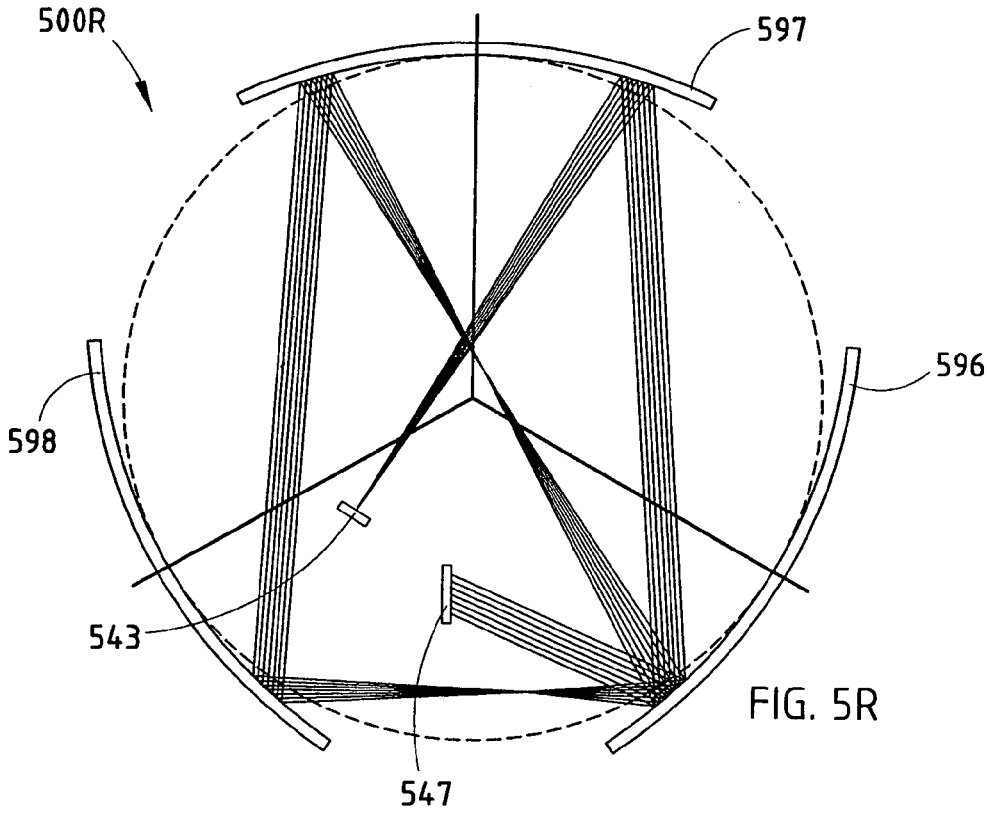

FIG. 5P depicts an obscuration sensor 500P that increases the beam length generated for mirrored surface by utilizing each non-planar mirror 591, 592 and 593 as a reflector more than once. As shown in FIG. 5P, the mirror 593 is rotated such that the centerline of the mirror 593 intersects the centerline of the mirror 592, rather than the center of the circular area. This modification reflects the light beam reaching the mirror 593 with modified positioning, back to the mirror 592 that originated the light. This sets up a loop that sends the light back to the light source 511 over the same path, creating a beam length equivalent to about five times the spacing between the individual mirrors. To avoid the emitter interfering with the returning light beam, further adjustments to the mirrors may be made to have the returning light follow a slightly different return path, as depicted in FIG. 5Q. Alternatively, the center of the emitter can be designed with an aperture that allows the reflected light to pass through the light source 511 to the receiver 543. In another embodiment, the mirror 593 of FIG. 5P is not redirected, however, both the centers of the receiver 543 and the light source 511 are designed with an aperture such that on the first reflection from the mirror 593 the light beam is converging and passes through the apertures, thus striking the mirrors 591, 592 and 593 a second time. On the second pass the light beam is collimated and is received by the receiver 543. As shown in FIGS. 5P–5Q, the multiple reflections may occur at the same physical space on a given mirror, or on separate areas of the same mirror. Further, as discussed above each mirror may facilitate two or more reflections per mirror. FIG. 5R depicts yet another obscuration sensor 500R that includes three non-planar mirrors 596, 597 and 598, a collimated light source 547 and the receiver 543.

When attempting to construct an obscuration sensor alone, there are many physical constraints to consider. When attempting to combine a scatter sensor with an obscuration sensor that monitors the same test chamber the constraints are even more challenging. The ability to relocate the light beam to another plane is, generally speaking, important in most practical designs.

There is some advantage to using mirrors with slightly diffused finishes. Although this reduces the efficiency of light transmission, requiring a more intense light source to properly illuminate the receiver, there are some advantages in long-term sensor stability. It should also be appreciated that the light receiver may also be configured to diffuse the light, provided by the light source, if desired. Dust accumulation on the mirrors is unavoidable in applications, such as early warning smoke detectors. Even when dust barriers, such as fine mesh screens at entry points into the test chamber are utilized, some dust generally enters and settles on the mirrors, which attenuates the light provided by the light source. This may affect the calibration of the sensor. If high-efficiency type mirrors are used, the early degradation due to dust is generally fairly rapid. If the mirrors are initially less efficient, the dust accumulation normally has a smaller effect on the light reaching the receiver. This less severe rate-of-change is less demanding on the sensor elements that insure continued calibration, as the sensor components age.

Any system that exposes the optical elements to an unfiltered atmosphere will experience degradation of optical qualities. Since the purpose of a particle sensor, as described herein, is to detect particles entering the test chamber, contamination of optical surfaces is unavoidable. An initial screen-type filter to block large particles from entering the sample space will generally delay contamination, but cannot completely avoid it. It has been experimentally shown that after exposure to black smoke particle densities of 11 percent per foot obscuration, the reflective surfaces degrade about 0.25 percent per mirror. With five reflections, this effect is multiplied as viewed by the receiver. While this reduction is semi-permanent, i.e., the oily residue from the smoke will evaporate over time, the particles remain.

For example, if each mirror has an initial optical efficiency of 85 percent a sensor with five mirrors will have an overall efficiency of $0.85^5$, or just 44.4 percent of emitted light reaches the receiver. With a 0.25 percent degradation per mirror due to smoke exposure, the sensor efficiency is $0.8475^5$, or 43.7 percent, which is a 0.7 percent reduction in overall efficiency. As stated above, this reduction is semi-permanent as the oily residue from the smoke will evaporate over time, but the particles remain. In terms of percent-attenuation of received light, the effect is 0.7/0.444=1.58 percent. (44.4 percent initial light is 100 percent of the received light).

As such, the interface to an obscuration sensor should adjust for these effects over time. It has been experimentally shown that the rate of contamination slows with subsequent smoke exposures, but never stops. Having the mirrors vertically oriented with respect to the earth results in less rapid and less severe dust accumulation.

However, at some level of dust accumulation, insufficient light will reach the receiver to allow proper operation of the sensor. This situation is typically handled by an algorithm in the controller. When the factory set calibration for clear air, i.e. 100 percent light, is diminished to a pre-determined level, the device may alert the end user of the condition by an audible, visible or similar alert indication indicating replacement or cleaning is required.

When implemented within a particle sensor, the scatter sensor measures the amount of light reflected by particles in the test atmosphere. In measuring the amount of reflected light, the scatter sensor uses the amount of energy indicated when no light is emitted from the scatter emitter as a reference. In contrast, the obscuration sensor measures the amount of energy received by light emitted from the obscuration emitter that directly strikes the photodetector. To determine the amount of obscuration, a zero obscuration value is desirable for comparison.

To determine the zero obscuration value an algorithm that tracks changes can be employed. For instance, an algorithm may evaluate a measurement on a regular basis, for example, once a day. If the value indicates clear air, this becomes the reference. However, if smoke is present, when the measurement is taken, the most recent clear air measurement is preferably used as the reference. Unfortunately, this technique does not account for abrupt changes to the environment, such as the UL dust test, and this technique requires long-term stability in the particle sensor.

As such, a generally better technique is to have the scatter detector provide the clear air reference. In fact, the obscuration sensor need not be used at all until the scatter sensor determines that some small amount of smoke is present. When the scatter sensor indicates some amount of smoke, the obscuration sensor is activated. The first measurement taken by the obscuration sensor then becomes the clear air reference and all measurements taken after this are compared to the clear air reference. If the smoke clears, the obscuration sensor is then preferably deactivated to save energy, which is desirable in battery operated environments. It should be appreciated that the clean air reference may also be provided by other sources, such as an ion sensor.

To determine the amount of time shift associated with a given density of smoke one must generally determine the relationship between the photocurrent and the smoke density, which generally varies with the design. With reference to the circuit 44 of FIG. 6, typical fixed values and the algorithms for determining the calculated values are set forth below:

Suitable exemplary constants for the particle detector are set forth below:

$Freq=1.60E+07$ Hz $C1=1.000E-09F$ $R3=3.000E+06\Omega$ $VDD=4.480E+00V$ $Iphoto2.5\%=1.200E-08A$ $Iphoto0\%=9.400E-07A$ $Idark=2.00E-09A$ $Igrass=1.20E-08A$ $Idarkcal=2.00E-09A$ It should be appreciated that the total capacitance includes both the capacitance of capacitor C1 and the capacitance of the receiver utilized (in this case, the capacitance of the receiver is about 12 pF). The above constants, which are dictated by the components utilized, are used in the scatter sensor (IR) algorithms as set forth below:

$$Tdarkcal=R3*C1*\ln(((VDD)/(VDD*9/32)+R3*Idarkcal)))$$

$$Tdark=R3*C1*\ln(((VDD)/(VDD*9/32)+R3*Idark)))$$

$$Tgrass=R3*C1*\ln(((VDD+(R3*Igrass))/((VDD*9/32)+(R3*Igrass)+(R3*Idark))))$$

$$Tgrass+smoke=R3*C1*\ln(((VDD+(R3*(Iphoto2.5\%+Igrass)))/((VDD*9/32)+(R3*(Iphoto2.5\%+Igrass))+(R3*Idark))))$$

$$IRgrassdelta=(Tdark-Tgrass)/Tclk$$

$$IRgrass+smoke=(Tdark-Tgrass+smoke)/Tclk$$

$$IRsmokedelta=IRgrass+smoke-IRgrass\ delta$$

$$REFCountIR=Tdark/Tclk$$

$$IRCount=Tgrass+smoke/Tclk$$

where Freq is the frequency at which the controller 80, as disclosed, operates and Tclk is the time period corresponding to Freq; VDD*9/32 is the charge/discharge threshold (i.e., level 108); Iphoto2.5% is the current through the receiver at 2.5% obscuration and is the point at which an alarm is normally sounded; Idark is the current through the receiver with no light; Igrass is the current through the receiver with no smoke; Idarkcal is the current through the receiver with no light at calibration; Tdarkcal is the time to reach the discharge threshold with no light at calibration; Tdark is the time to reach the discharge threshold with no light, otherwise; Tgrass is the time to reach the discharge threshold with the light on and no smoke; Tgrass+smoke is the time to reach the discharge threshold with the light on and smoke at 2.5% obscuration; Tdark/Tgrass provides a ratio; Tdark/Tgrass+smoke provides another ratio; IRgrassdelta is the count corresponding to the difference between Tdark and Tgrass; IRgrass+smoke is the count corresponding to the difference between Tdark and Tgrass+smoke; IRsmokedelta is the count corresponding to the difference between IRgrassdelta and IRgrass+smoke; REFCountIR is the count corresponding to Tdark; and IRCount is the count corresponding to Tgrass+smoke. It should be appreciated that it is desirable to control the value of VDD as the value is utilized in both the obscuration and scatter sensor algorithms.

The calculated values for the above variables, using the constants and algorithms set forth above, are:

$Tdarkcal=3.837E-03S$ $Tdark=3.837E-03S$ $Tgrass3.776E-03S$ $Tgrass+smoke=3.717E-03S$ IRgrassdelta=40.6

$IRgrass+smoke=79.7$

IRsmokedelta=39.1

REFCountIR=2558

IRount=2478

The above constants are also used in the obscuration sensor algorithms as set forth below:

$$Tbeamdark=R3*C1*\ln(VDD/(VDD*9/32)+R3*Idark))$$

$$T100\%=R3*C1*\ln((VDD-R3*Iphoto0\%)/((VDD*9/32)+R3*Idark))$$

$$Blue/GreenT80.6\%=R3*C1*\ln(VDD-R3*Iphoto0\%*0.806)/(VDD*9/32)+R3*Idark))$$

$$GreenT83.7\%=R3*C1*\ln((VDD-R3*Iphoto0\%*0.837)/(VDD*9/32)+R3*Idark))$$

$$REFCount=Tbeamdark/Tclk$$

$$PostBeamCount=T100\%/Tclk$$

$$Delta=REFCount-PostBeamCount$$

$$Blue/Green(UL\ 11\%)Delta=(Blue/GreenT80.6\%-T100\%)/Tclk$$

$$Green(UL\ 11\%)Delta=(GreenT83.7\%-T100\%)/Tclk$$

$$Blue/GreenIp(490\ nm)80.6\%=Iphoto0\%*0.806$$

$$GreenIp(570\ nm)83.7\%=Iphoto0\%*0.837$$

where Tbeamdark is the time to reach the charge threshold with no light; T100% is the time to reach the charge threshold with light and no smoke; REFCount is the count corresponding to Theamdark; PostBeamCount is the count corresponding to T100%; Delta is difference between REFCount and PostBeamCount; Blue/GreenIp(490 nm)80.6% corresponds to the receiver current at 80.6% atmosphere clarity as determined by the obscuration emitter, which occurs at 2.5% obscuration as determined by the scatter emitter and 11% obscuration referenced to UL standards; Greenlp(570 nm)83.7% corresponds to the receiver current at 83.7% atmosphere clarity as determined by the obscuration emitter (570 nanometer wavelength), which occurs at 2.5% obscuration as determined by the scatter emitter and 11% obscuration referenced to UL standards; Blue/GreenT80.6% is the time which produces count Blue/Green (UL11%), when a 490 nanometer obscuration emitter is used; GreenT83.7% is the time which produces count Green (UL 11%), when a 570 nanometer obscuration emitter is used; Blue/Green(UL 11%)Delta is the count corresponding to the difference between Blue/GreenT80.6% and T100%; and Green(UL 11%)Delta is the count corresponding to the difference between GreenT83.7% and T100%.

The calculated values for the obscuration sensor algorithms, using the constant values set forth above, are set forth below:

$T$beamdark=3.837$E$−03

$T$100%=8.23$E$−04

Blue/Green$T$80.6%=1.69$E$−03

Green$T$83.7%=1.56$E$−03

REFCount=2558

PostBeamCount=548

Delta=2009.4

Blue/Green($UL$ 11%)Delta=576.5

Green(UL 11%)Delta 494.7

Blue/Green$Ip$(490 nm)80.6%=7.58$E$−07

Green$Ip$(570 nm)83.7%=7.87$E$−07

With reference again to FIG. 6, exemplary algorithms for determining cycle times for the scatter, obscuration and dark cycles are set forth below:

$$IR\text{ Cycle: } T = R3C1\ln\left(\frac{VDD + i_d R3 + i_L R3}{(VDD + i_d R3 + i_L R3) - VREF}\right)$$

$$\text{Beam Cycle: } T = R3C1\ln\left(\frac{VDD - i_L R3}{(VDD + i_d R3) - VREF}\right)$$

$$\text{Dark Cycle: } T = R3C1\ln\left(\frac{VDD}{(VDD + i_d R3) - VREF}\right)$$

where VREF is (VDD*9/32).

The sensitivity to particle density is limited by the ability of the controller to resolve changes in time. Faster digital clock speeds generally translate into the ability to measure smaller changes in time. However, faster clock speeds also translate into more energy consumption by the controller. In cases where it is desirable to minimize energy consumption, the clock speed may be stopped or reduced between measurement cycles to conserve power. If a sleep mode is not available, circuitry to temporarily boost the clock speed to maximum for the measurement period and then back to a reduced speed for a majority of the time also conserves power.

Condensing humidity on the mirrors of the obscuration sensor has a dramatic effect on light levels at the receiver. As such, it may be desirable to provide a hydrophilic coating on the reflective surface of each mirror or position a heater adjacent to or on each mirror to substantially prevent fogging of the reflective surface. Condensing humidity can exceed the anticipated effects of even very high particle densities in the test chamber. As such, logic can suppress the alarm function for a predetermined time, if the apparent obscuration levels exceed a predetermined limit for reasonable particle densities. During this alarm suppression period, brief transient conditions caused by condensing humidity, would have time for the moisture to evaporate before a false high particle density indication occurs. In the case of an early warning smoke detector, the suppression period can prevent what would have been a false alarm. However, the duration of the suppression period should be chosen so as not to compromise safety.

When used as an early warning smoke detector, the possibility that the unit will be powered up in the presence of smoke should also be considered. Any automated means that compensates for offset errors at power-up, should not shift calibration excessively, when smoke is present at calibration time. A sensor so calibrated will generally exhibit degraded sensitivity to smoke.

Chambers used to create a sample test chamber for scatter sensors are usually made of black, intentionally non-reflective materials. A black material has the advantage of absorbing the unwanted light that passes the field of view of the receiver, preventing stray reflections. If allowed to occur, these reflections appear in the receiver output and are nearly indistinguishable from the output created by particles in the test chamber. In an early warning smoke detector this can lead to the alarm threshold shifting, resulting in false alarms.

A problem with using an interior black smoke sensor housing is that non-black dust is likely to accumulate on the inside surfaces over time. This greatly increases the stray reflections that find their way to the receiver. By starting with a smoke sensor constructed from more reflective materials, such as gray plastic; the amount of change from no-dust to a dusty surface is much less than if the interior housing of the sensor is black. With careful initial design, this can help stabilize the sensitivity to particles in the test chamber as the components age.

One of the greatest challenges of designing a combination obscuration/scatter sensor in one compact housing is preventing the two sensors from interacting within a confined space. The mirrors required for creating a compact beam sensor should be positioned such that light from the scatter emitter is not reflected to the receiver by other than particles in the test chamber. When using the same receiver for both obscuration and scatter modes, the choices become even more limited. Further limiting the physical choices are the constraints of high volume manufacturing, which should be considered for early warning smoke detectors. A low labor assembly compatible with PCB manufacturing processes, such as a wave or reflow solder system, is desirable. Because of the very sensitive measurements being made, a Faraday shield may be required to protect the receiver from outside electromagnetic interference. This shield is generally metallic and reflective and may reflect stray light to the receiver. Another restriction is that the end-product is wall or ceiling mounted, in the case of an early warning smoke detector, and is expected to be low profile for aesthetic and practical reasons. A smoke chamber that is small in a direction perpendicular to the mounting surface is, therefore, desirable. Particle entry should be nearly equally permissive into the test chamber from a 360 degree arc surrounding the test chamber. It is also generally desirable that the mirrors and system components not unduly impede entry of particles into the test chamber, based on the orientation to the flow of the particles into the test chamber.

One physical system that meets these varied requirements includes a mounting block (i.e., an optic block) for the three optical elements, the receiver (MID-54419), the scatter emitter (MIE-526A4U) and the beam emitter (MVL-5A4BG). A second component is the smoke cage base, which preferably supports a separate mirror assembly consisting of five non-planar mirrors, arranged in a circular pattern of 3⅛ inches diameter. The base preferably holds the mirrors in precise alignment to the optic block and forms a portion of the light-blocking labyrinth that forms the dark test chamber and, when practical, a molded filter screen, when molding constraints allow the formation of an integral filter screen. Alternatively, an optional non-integral filter screen may be installed external to all particle entry points. Either screen method should generally prevent larger particles, insects and the like from entering the test chamber. The last component is the test chamber cover, which completes the light labyrinth and preferably has anti-reflective grooves on its inner surface to dissipate unwanted scatter emitter reflections and is removable to expose the surfaces that may later need cleaning.

Figure 5S:
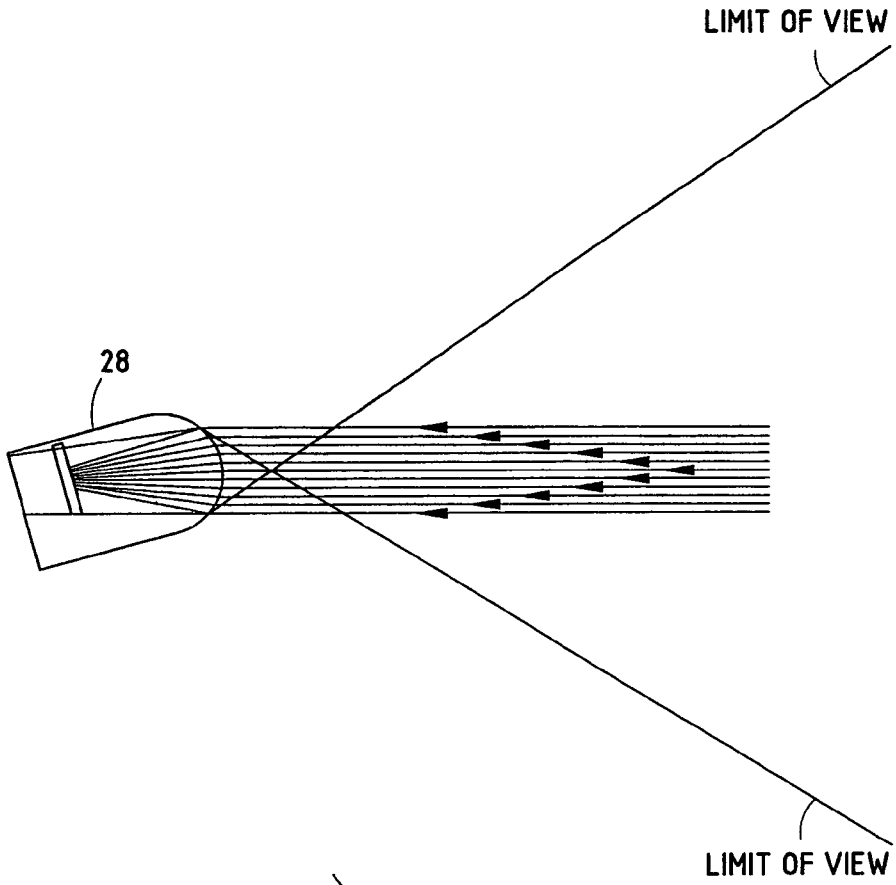
FIG. 5S is an isometric view depicting a field of view for an exemplary receiver.
Figure 5T:
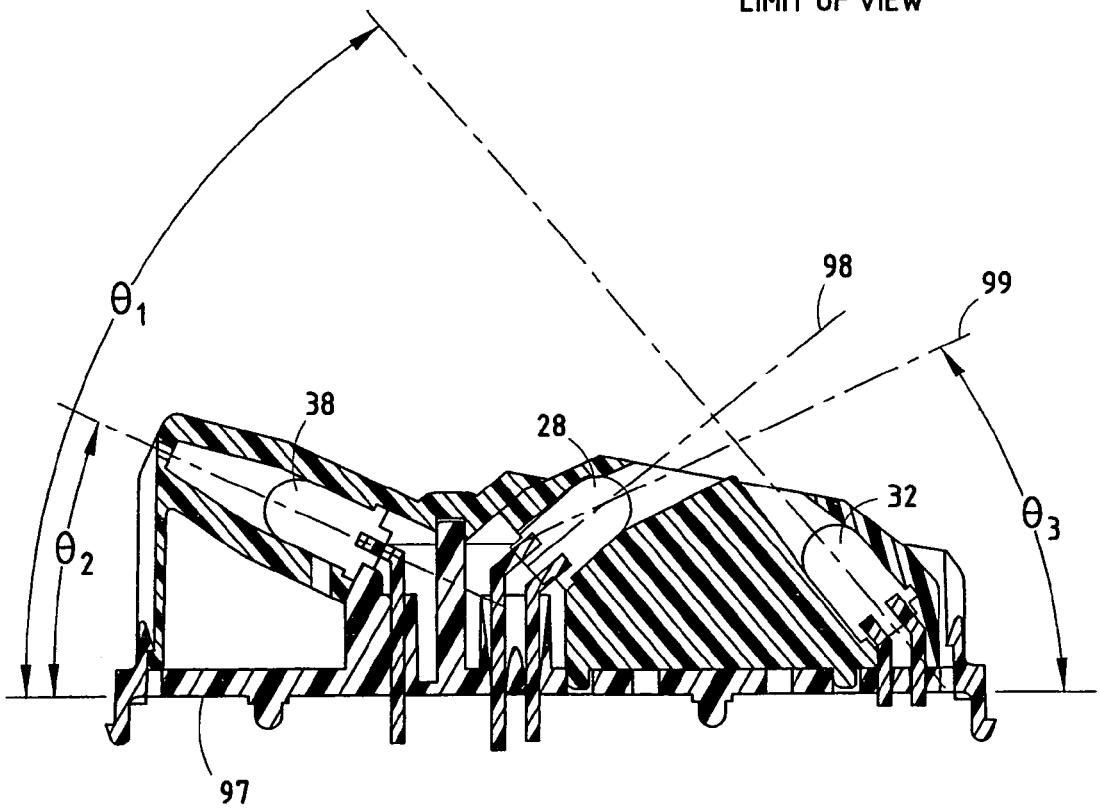
FIG. 5T is a cross-sectional view of an optic block, according to an embodiment of the present invention.

A preferred optic block places the three optoelectric components in a housing made of material that is opaque to the wavelengths of light being emitted. FIG. 5T is a cross-sectional view of an exemplary optic block 97, with the Faraday shield for receiver 28 not shown. The two emitters 32 and 38 and one receiver 28 are preferably held by the optic block 97 in a specific orientation, with the leads properly polarized and presented for direct insertion into a wiring substrate, e.g., a PCB, as a single component. Preferably, retaining snaps and guideposts secure and align the optic block 97 to the mounting substrate, which has an appropriate pattern of slots and holes to accept the optic block 97. Each optical component has corresponding apertures to allow light entry (or exit) only from a restricted field of view.

The optic block 97 limits the field of view for the receiver 28. However, this limitation is not necessarily uniform in all directions and conforms to the conditions within the test chamber, as function requires. The optic block 97 should be designed to not block incoming light from the obscuration emitter 38, yet it should block stray reflections from the scatter emitter 32. The blocking of light is used only as required, because sensitivity to particles in the test chamber may be attenuated by excessively restrictive apertures. It is desirable that the receiver 28 not have any test chamber surface within its field of view that also reflects direct light from the scatter emitter 32. Any such reflection is generally indistinguishable from particles in the test chamber and may be considered a noise component. The field of view for the receiver 28 is generally limited either by its own construction, as shown in FIG. 5S, or an aperture in the optic block 97, or a combination of both. The exemplary design exploits this combination to allow a large aperture for the obscuration beam, while adequately restricting light in the scatter mode.

The emission pattern for both emitters 32 and 38 is also generally restricted. In particular, the scatter emitter 32 light output is restricted in conjunction with the viewing field of the receiver 28, to assure no direct light reflects off any wall of the test chamber that is viewed by the receiver 28. A barrier separates the scatter emitter 32 from the receiver 28 such that there is no direct line-of-sight between the two. These two components are held in a specific orientation that preferably maximizes the electrical output of the scatter sensor in response to particles in the test chamber. In the case of the MID-54419 photodiode and the MIE-526A4U scatter emitter this orientation places the physical bodies of the scatter emitter 32 and the receiver 28 at about a ninety degree angle to one another. Further, this physical orientation places the maximum optical centerline 99 at 105 degrees between the scatter emitter 32 and receiver 28, as shown in FIG. 5T. The focal point of the receiver 28 is set to intersect the highest flux density region of the emission pattern of the scatter emitter 32. This point is the result of a combination of the T13/4 package lens, internal reflector cup and LED chip alignment to the reflector cup, emission pattern of the LED chip, and the insertion depth of the LED) chip in the package. The MID-526A4U has a stated light emission one-half intensity angle of 12.5 degrees. Stated another way, it emits a majority of the light energy in a 25 degree cone, with its vertex at the base of the package of the emitter. There is also stray light that results from total internal reflections that greatly exceed this angle. As such, it is desirable for the optic block aperture to block unwanted off-axis light from any surface viewed by the photodiode.

The receiver 28 is preferably placed with its physical centerline 98 at about a 40 degree incline with respect to the PCB, as shown in FIG. 5T. This requires the scatter emitter 32 to be at an angle ($\Theta_1$) of about 50 degrees, to maintain the 90 degree physical relationship. The distance between the receiver 28 and emitter 32 is best defined by a point in space, where the physical centerlines of the component packages intersect when extended along a line normal to the surface of the lens of each device. The MID-54419 receiver is ideally placed 8.2 mm from this point in space. The MIE-526A4U emitter is ideally placed 11.2 mm from this point. Compromises in these specific spacings may have to be made to allow proper molding of the optic block 97, particularly in maintaining proper wall thickness for the features that define field of view for these two components.

It should also be noted that the receiver 28, is rotated about its own centerline such that the optical centerline 99 is at about a 105 degree angle to the physical centerline of the scatter emitter 32. This greater than 90 degree optical angle slightly degrades the sensitivity of the receiver 28 to particles in the test chamber, but improves another aspect of the particle sensor in that the test chamber cover may be closer to the receiver 28 and emitter 32, without causing the two fields of view to intersect at the surface of the cover. This allows a properly functioning particle sensor to have an acceptably low profile. In the case of a combined scatter and obscuration receiver function, it places the receiver 28 at an angle optimized to receive light from a mirror assembly, which also may be located within the low profile. With respect to the mounting surface, a suitable angle ($\Theta_3$) is about 25 degrees as indicated in FIG. 5T.

The cover may generally be located at any height greater than about 20 mm above the optic block barrier that separates the receiver 28 and scatter emitter 32. Anti-reflective patterns in the cover surface facing the scatter emitter 32 may further assist in reducing unwanted stray reflections that may reach the receiver 28 by means other than particles in the test chamber. A portion of the light blocking labyrinth may also be part of this cover.

The rotation of the scatter emitter 32 about its centerline is generally less important, because the optical and physical centerlines are the same. There is some advantage to placing the wire bond structure within the scatter emitter 32, towards the barrier that separates the receiver 28 and emitter 32 as this places the wire bond shadow in an area that has a minimal affect on sensitivity to particles in the test chamber.

Referring to the obscuration emitter 38 as shown in FIG. 5T, it may be noted that the physical and optical centerline is established at an angle ($\Theta_2$) of about 25 degrees with respect to the mounting surface and collinear to the two components that form the scatter sensor. The emitter 38 lead frame is rotated 90 degrees with respect to the scatter emitter 32 orientation. This rotation is a manufacturing convenience and not generally critical to proper optoelectrical function. After allowances for optical barriers and electrical spacings within the optic block 97, the obscuration emitter 38 is preferably placed as near the receiver 28 as possible to keep the size relatively small and the beam length relatively long. The light that exits the emitter 38 is directed away from the receiver 28 and is generally not viewable by the receiver 28, unless reflections are introduced inside the test chamber. Preferably, an aperture is formed in front of the emitter 38 as part of the optic block 97. The aperture diameter and spacing from the emitter 38 may be adjusted for restricting light that exits the optic block 97. Even though the example indicates a fixed aperture, it should be evident that an adjustable aperture can be provided to control the amount of light allowed to exit the optic block 97. Because of variations within the obscuration emitter 38, it is best not to restrict the size of this aperture any more than functionally necessary as this may cause an unacceptably large variation in beam luminance levels from one assembly to the next when a fixed aperture is utilized.

As is described elsewhere, a mirror assembly is placed outbound such that the light exiting the obscuration emitter 38 is directed to the receiver 28 after multiple reflections. The choice of a 25 degree angle allows a 3⅛ inch diameter mirror assembly to perform this function, without the optic block 97 interfering with the resulting folded light beam. FIG. 5E demonstrates the relationship of the scatter emitter light path and the primary reflected light off the test chamber cover to the outbound mirrors. It has been confirmed experimentally what the drawing shows. The isolation between the two sensors, so arranged, is generally quite acceptable as very little light from the scatter emitter 32 is directed to the receiver 28 by introducing mirrors into the test chamber.

A Faraday shield may be added to the optic block 97 by several methods. The optic block 97 itself can be a cast metallic part or molded of plastic impregnated with RF absorbing materials. A preferred embodiment employs a simple plated steel sheet metal part that is folded to an appropriate shape to protect the receiver 28. This part should be machine solderable, and have a tab to make a connection to the ground reference circuitry on the underside of the PCB. This connection may be made to the unregulated, low voltage power source for the associated electronics rather than circuit common. This places the RF ground path ahead of the voltage regulator for the electronics, which further inhibits RF entry into sensitive circuits.

By combining the above-described elements, a compact, low profile, RF resistant, dual emitter, single receiver, particle sensor having low interaction between sensors, with 360 degree permissivity of particles may be produced by high volume manufacturing methods at relatively low labor and cost.

Figure 6:
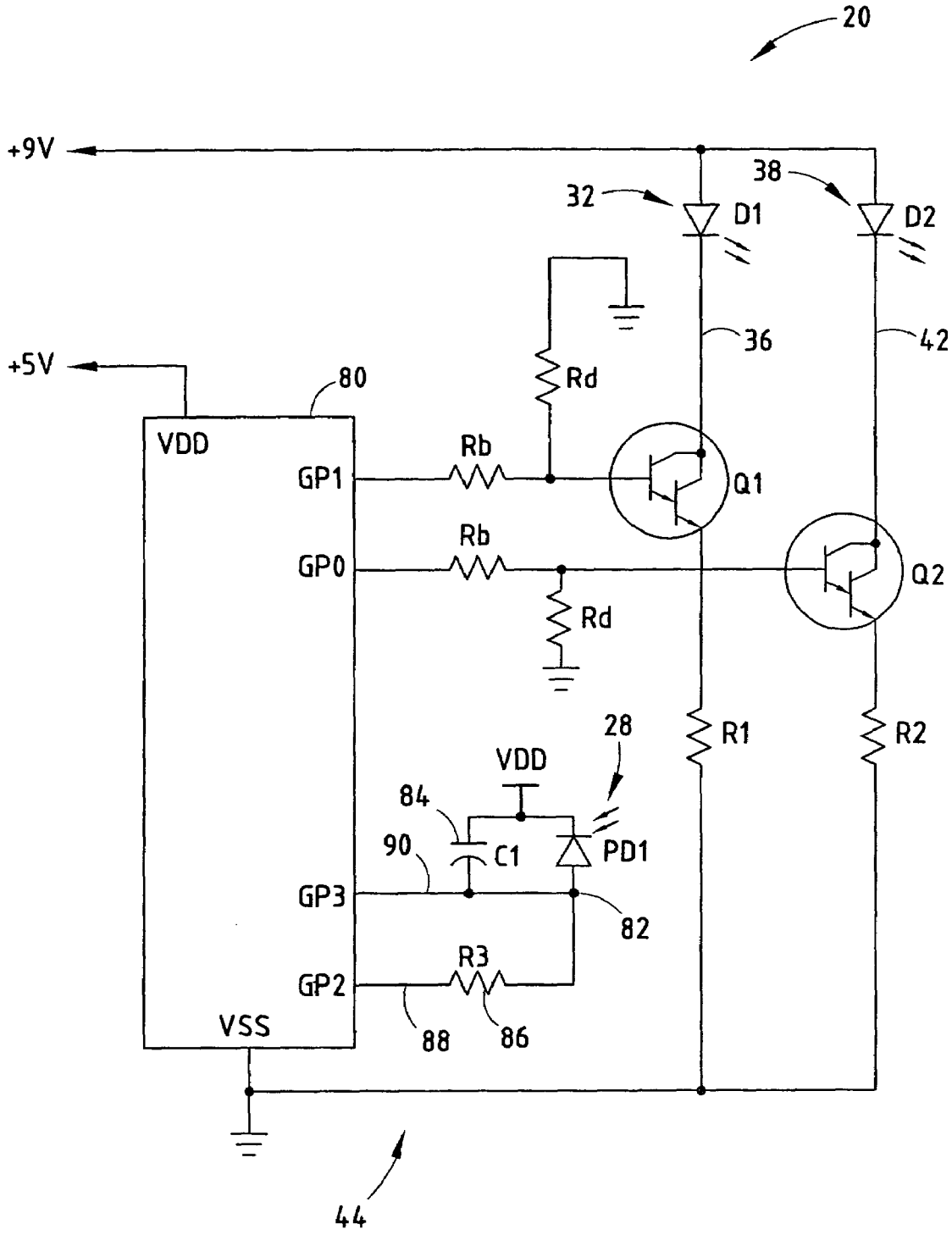
FIG. 6 is an electrical schematic diagram of a control circuit for a dual emitter smoke detector, according to an embodiment of the present invention.

Referring to FIG. 6, a schematic diagram of a control circuit 44 for a dual emitter smoke detector 20 is shown. A controller 80 (which may be a PIC16CE624, commercially available from Microchip Technology Inc.) is used to control the operation of the particle sensor. The scatter emitter 32, implemented as light emitting diode D1, is connected between a 9 volt supply and a collector of transistor Q1. A base of transistor Q1 is connected to an output (GP1) of the controller 80. An emitter of transistor Q1 is connected through resistor R1 to ground. Hence, the output GP1 generates scatter emitter signal 36. Similarly, obscuration emitter 38, implemented as light emitting diode D2, is connected between the 9 volt supply and a collector of transistor Q2. A base of transistor Q2 is connected to an output (GP0) of controller 80. An emitter of transistor Q2 is connected through a resistor R2 to ground. Hence, the output GP0 generates obscuration emitter signal 42. Each of the transistors Q1 and Q2 may comprise NPN, PNP, FET or MOSFET elements, or the like, and may for example be a part number MMBTA14LT1 Darlington pair commercially available from Motorola, Inc. of Schaumburg, Ill. Heat sinking each transistor Q1 and Q2 with its respective controlled emitter D1 and D2 results in temperature compensation such that the amount of light generated by emitters D1 and D2 is less dependent upon ambient temperature.

The receiver 28, implemented by photodiode PD1, is connected between supply voltage VDD and connection point 82. A capacitor C1, indicated by 84, is connected across the receiver 28. A resistor R3, indicated by 86, joins connection point 82 with a discrete output (GP2) of the controller 80, indicated by 88. The connection point 82 is also connected to a sense input 90 of the controller 80, labeled GP3. Preferably, the sense input 90 is connected to a comparator, having an adjustable reference threshold, within controller 80. Although the receiver 28 and the capacitor C1 are described as being connected between the supply VDD and connection point 82, it will be recognized that the capacitor C1 and the receiver 28 can alternatively be connected in parallel between connection point 82 and ground.

In one embodiment, scatter emitter 32 has a principal wavelength between 850 and 950 nanometers and obscuration emitter 38 has a principal emission wavelength between 430 and 575 nanometers. For example, light emitting diode D1 can be implemented using an MIE-546A4U, emitting light at a principal wavelength of 940 nanometers, available from Unity Optoelectronics Technology of Taipei, Taiwan. Light emitting diode D2 may be an MVL-504B, emitting light at a principal wavelength of 490 nanometers, also available from Unity Optoelectronics Technology. The intensity of the scatter emitter light 34 and the obscuration emitter light 40 are dependent upon the values of resistors R1 and R2, respectively. In this example, the resistance of the resistor R1 may be 7Ω and the resistance of the resistor R2 may be 16Ω. Photodiode PD1 may be, for example, a MID-56419, also available from Unity Optoelectronics Technology.

Figure 7:
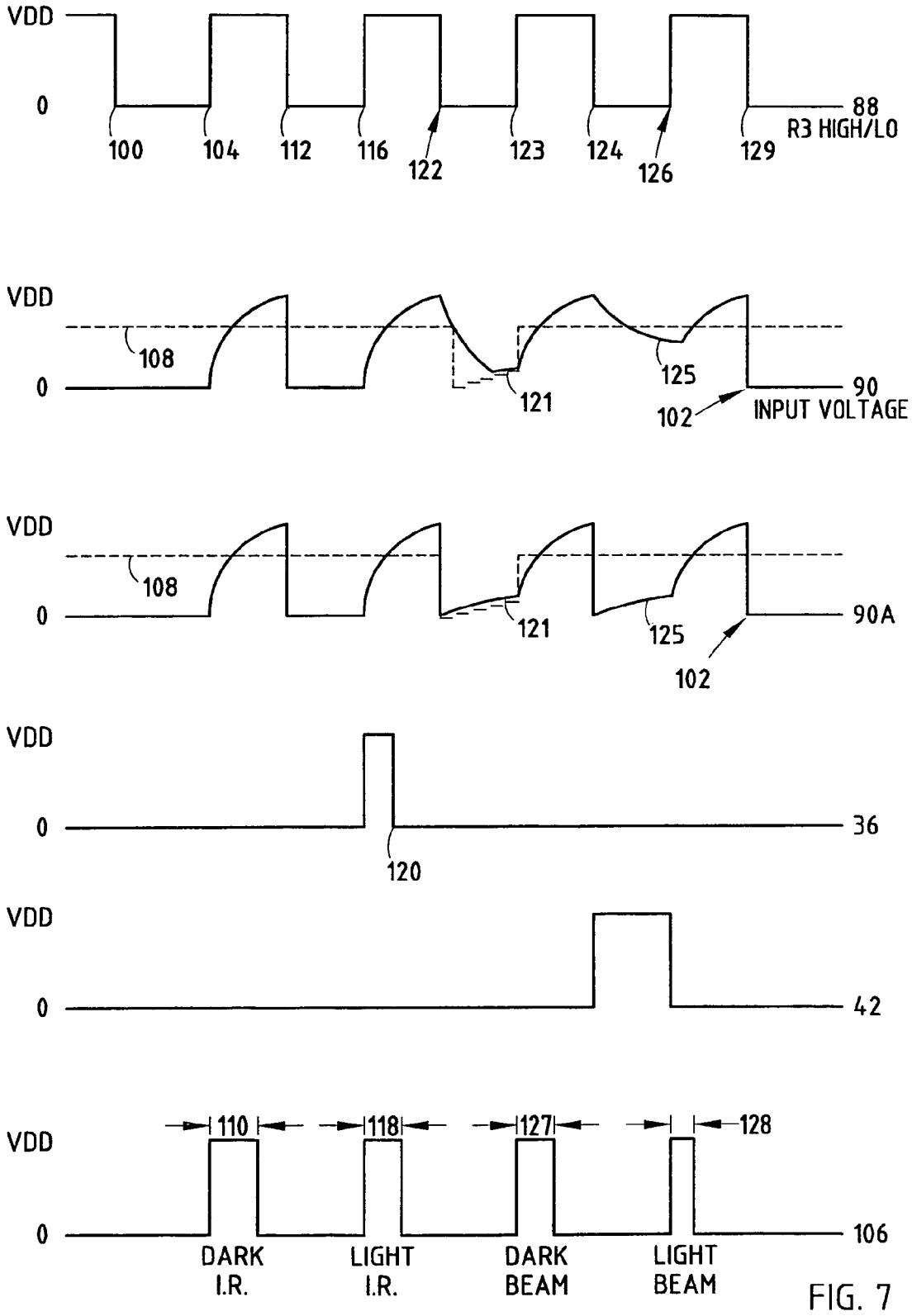
FIG. 7 is a timing diagram illustrating operation of the dual emitter smoke detector of FIG. 6.

Referring now to FIG. 7, a timing diagram illustrates operation of a dual emitter smoke detector. The timing diagram shows one cycle during which the following timing measurements are made: a dark scatter (IR) reference; an elapsed scatter (IR) time that is based on the scatter emitter light 34 impacting the receiver 28; a dark obscuration (beam) reference; and an elapsed obscuration (beam) time that is based on the amount of the obscuration emitter light 40 impacting the receiver 28. The cycle is repeated periodically, as desired. The discrete output 88 toggles between the supply VDD voltage and ground, and the sense input 90 toggles between high impedance and ground states. For convenience, asserting is referred to as applying supply VDD voltage and deasserting is referred to as grounding the terminal. An alternative sense input signal 90A is also shown. The sense input signal 90A is the same as the signal shown for sense input 90 with the exception that with the sense input signal 90A, the sense input 90 is pulled to ground at times 122 and 124. Pulling the sense input 90 to ground at times 122 and 124 tends to remove variations in the time measurements, as the capacitor 84 tends to charge (as opposed to discharge) more readily to an appropriate level.

More particularly, the discrete output 88 and the sense input 90 are deasserted by connection to ground potential at time 100. This causes the capacitor 84 to charge to approximately VDD. The discrete output 88 is asserted at time 104, at which time the sense input 90 is allowed to float, allowing the voltage across the capacitor 84 to discharge through the resistor 86. Discharge will also occur due to the dark current produced by the receiver 28, connected in parallel to the capacitor 84. Asserting the discrete output 88, and permitting the sense input 90 to float, triggers a counter within the controller 80 to begin counting clock pulses, as indicated by counter signal 106. The counter is halted when the sense input 90 crosses a programmable threshold level 108. A comparator (not shown) internal to the controller 80 compares the signal level on the sense input 90 to the level 108, which is set to a default level during most of the measurement cycle. A dark scatter reference 110 is the elapsed time between when the discrete output 88 is asserted and when the sense input 90 crosses the level 108, and indicates a dark current reference level of the receiver 28. This dark scatter reference 110 is used in the scatter detector measurement as described herein below.

The discrete output 88 and the sense input 90 are deasserted at time 112, causing charging of the capacitor 84. The discrete output 88 is asserted at time 116, at which time the sense input 90 is permitted to float. At the same time, the scatter emitter signal 36 is asserted, turning on the scatter emitter 32. The rate of discharge of the capacitor 84 is dependent upon the amount of the scatter emitter light 34 striking the receiver 28, as the capacitor 84 will discharge both through the resistor 86 and due to the current through the receiver 28. Asserting the discrete output 88 begins a counter within the controller 80, as indicated by the counter signal 106. The counter is turned off when the sense input 90 crosses the level 108. The elapsed scatter time 118, which is the elapsed time between asserting the discrete output 88 and when the sense input 90 crosses the level 108, is dependent upon the amount of the scatter emitter light 34 striking the receiver 28. The more reflective smoke particles that are present, the more light from the scatter emitter 32 that will strike the receiver 28, the more current that will be drawn through the receiver 28 and the shorter the time required to discharge the capacitor 84 to the point that the sense input 90 crosses the level 108. The scatter emitter signal 36 may be deasserted at time 120, following the elapsed scatter time 118, such that the scatter emitter 32 is turned off when the sense input 90 crosses the level 108.

At time 122 the output 88 is deasserted and the sense input 90 continues to float. The voltage level on the sense input 90 will drop to a level 121, which is proportional to the magnitude of the dark current present at the output 30 of the receiver 28, after an appropriate settling time for the capacitor 84. The settling time is selected to be the maximum amount of time expected for the capacitor 84 to become substantially settled, and may for example be approximately 10 to 15 milliseconds. The threshold level 108 is programmable to 1 of 32 different voltage levels. The magnitude range for the dark current is determined using this programmable threshold level. Initially, threshold level 108 is set to its lowest programmable value, and once the capacitor settling time has elapsed, a comparison is made to determine whether the voltage present on input 90 is higher than this lowest programmable level. If it is not, then the dark current magnitude is in the lowest range. If, however, the voltage present at the input 90 is higher than the lowest programmable level, the level 108 is incremented to its next level. If the voltage present on the sense input 90 is higher than the incremented reference level, the level 108 is incremented again, to a next programmable reference level. The sense input 90 is then compared to that reference level. The process of incrementing the reference level to its next sequential level, and comparing the voltage on the sense input 90 to that incremented sequential reference level, is repeated until the level on the input 90 is lower than the level 108 or the highest reference voltage is reached. The value to which level 108 must be raised in order to exceed the signal level on the input 90 is the obscuration dark current reference level, which is stored for later use in selecting an adjustment factor as described in greater detail herein below. The adjustment factor is used to compensate for temperature variations, thereby enhancing the accuracy of obscuration detector measurements made over a wider temperature range.

At time 123, the level 108 is returned to its default value, the discrete output 88 is asserted, permitting the capacitor 84 to discharge and the counter begins counting, as indicated by the counter signal 106, while the obscuration emitter signal 42 remains deasserted (i.e., the emitter 38 is off). The counter is turned off when the sense input 90 crosses the level 108. The dark obscuration reference 127, which is the elapsed time between asserting the discrete output 88 and when the sense input 90 crosses the level 108, is a reference dark current time count for the obscuration emitter 38. The dark obscuration reference 127 is used in the obscuration detector measurement as further described herein below.

At time 124, the discrete output 88 is deasserted, the sense input 90 continues to float, and the obscuration emitter signal 42 is asserted. Consequently, the capacitor 84 begins charging at the same time as the obscuration emitter 38 turns on. The capacitor 84 will charge to a potential such that the sense input 90 settles at voltage level 125, which voltage level is dependent upon the amount of light striking the light receiver 28. If no smoke is present, the emitter light 40 reaches the receiver 28 without substantial blockage, inducing a large current in the receiver 28, resulting in a high voltage level 125 at time 126. When more smoke is present, less emitter light 40 reaches the receiver 28, allowing the sense input 90 to reach a lower voltage 125 at time 126. At time 126, the discrete output 88 is asserted, while the sense input 90 floats, and the obscuration emitter 38 is turned off, causing the capacitor 84 to discharge through the resistor 86 and the receiver 28. The time required for the capacitor 84 to discharge to the point that the sense input 90 crosses the level 108 is inversely related to the amount of the emitter light 40 striking the receiver 28 between time 124 and time 126. As noted above, the more smoke present while the obscuration emitter 38 is on, the lower the voltage 125 at the sense input 90. The lower the voltage at time 126, the more time will be required to discharge the capacitor 84 to the point that the sense input 90 crosses above the level 108. The measurement of elapsed obscuration time 128 is initiated upon deasserting the discrete output 88. At that time, a counter within the controller 80 begins counting, as indicated by the counter signal 106. The counter is turned off when the sense input 90 crosses the level 108. The elapsed obscuration time 128, between asserting the discrete output 88 and when the sense input 90 crosses over the level 108, indicates the amount of the obscuration emitter light 40 striking the receiver 28 during the interval from time 126 until the sense input 90 crosses the level 108. Preferably, measurements 110, 118, 127 and 128 are taken within a short period of time to properly compensate for dark current in the receiver 28. The elapsed obscuration time 128 is used in the obscuration detector measurement as described herein below.

Although not illustrated, it will be recognized that the length of time required to complete each measurement cycle can be reduced. Those skilled in the art will appreciate that if the times 112, 122, 124 and 129 are preset, the time period between asserting and deasserting the output 88 must be longer than the longest expected time required for the voltage on the sense input 90 to cross the level 108. To reduce the cycle time, the time periods 112, 122, 124 and 129 are preferably set dynamically as follows. As soon as the sense input 90 crosses the level 108, the control input 88 is deasserted. As a consequence, the times 112, 122, 124 and 129 need not be set in advance, and they will occur at the earliest possible time for actual measurement conditions.

Figure 11:
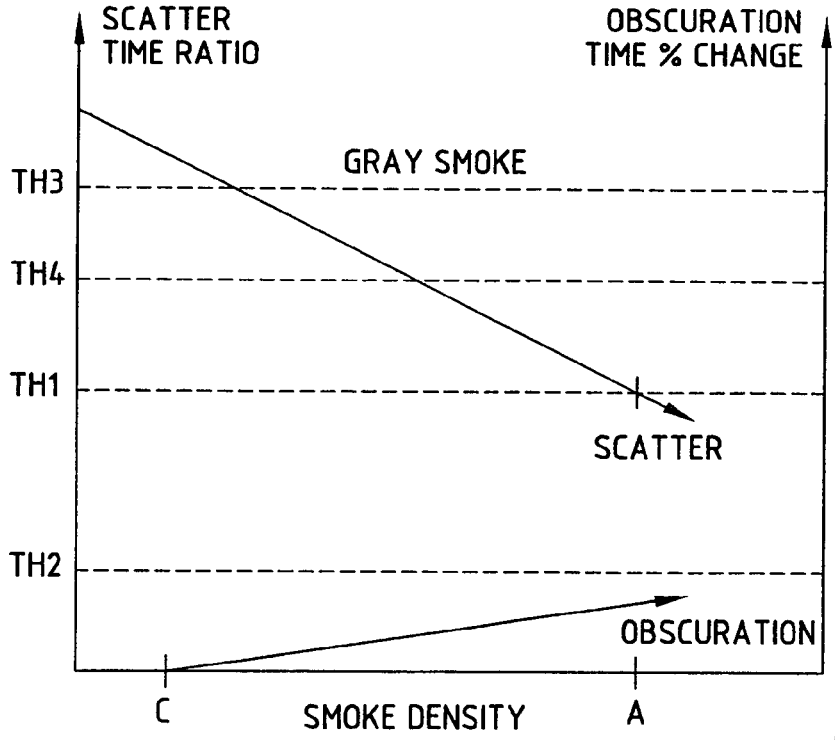
FIG. 11 is a chart illustrating the operation of the dual emitter smoke detector when gray smoke is present.
Figure 12:
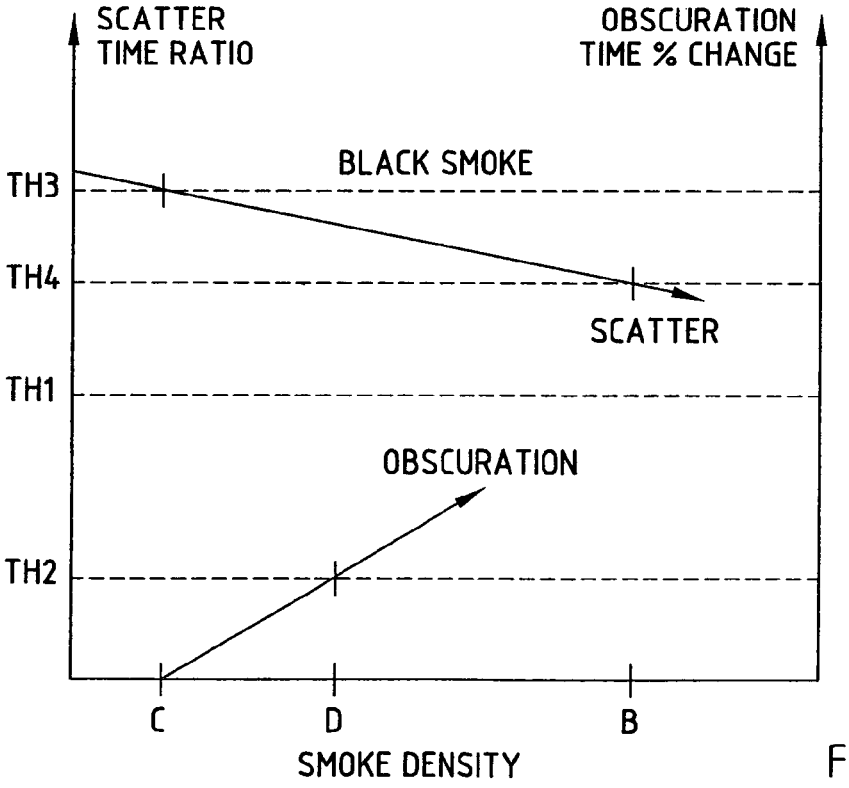
FIG. 12 is a chart illustrating the operation of a dual emitter smoke detector when black smoke is present.
Figure 13:
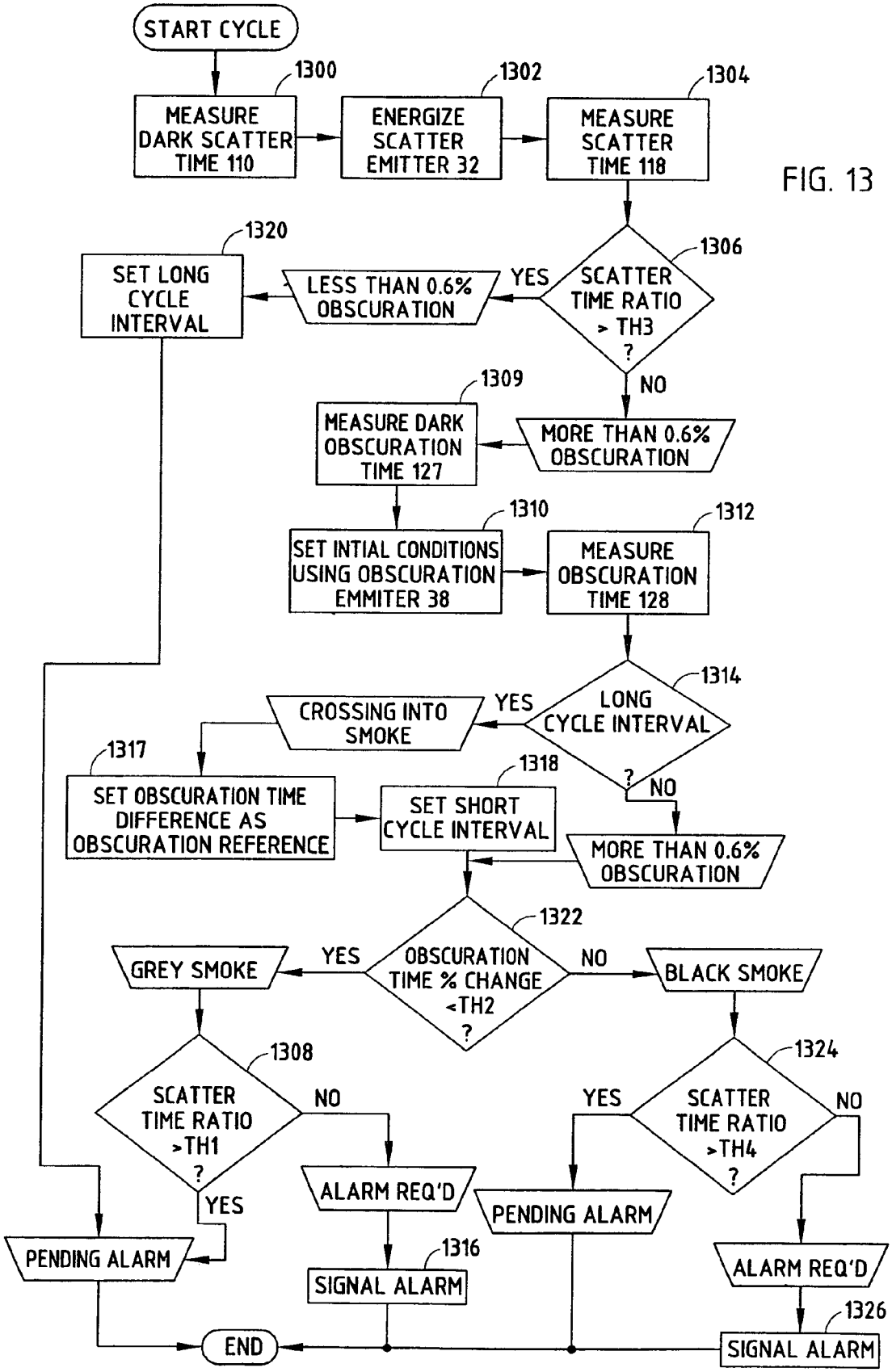
FIG. 13 is a flow chart illustrating operation of the controller of FIG. 6, when implemented as a smoke detector.

The operation of the smoke detector 20 will now be described with reference to FIGS. 6, 7, and 11 through 13. FIGS. 11 and 12 graphically illustrate the operation of the obscuration detector, using the obscuration emitter 38 and the light receiver 28, and the scatter detector, using scatter emitter 32 and the receiver 28, when gray smoke and black smoke are present in the test chamber. FIG. 13 is a flow chart illustrating an exemplary smoke detector sensor cycle implemented under the control of the controller 80. The trapezoid boxes that are not numbered are comments provided to assist understanding, and are not steps in the operation of the controller 80. In each sensor cycle, the dark scatter time 110 is measured, as described above, in step 1300. The scatter emitter 32 is energized at time 116, as indicated in step 1302, and the elapsed scatter time 118 is then measured, as described above, as indicated in step 1304. The scatter ratio, which is the ratio of the elapsed scatter time 118 to the dark scatter reference 110, is compared to a threshold TH3. As can be seen in FIG. 11, in the presence of gray smoke, the time required for the capacitor 84 to discharge while scatter emitter 32 generates light quickly decreases as the density of the smoke particles increases. This occurs because the amount of light from the emitter 32 that strikes the receiver 28 after being reflected off of the smoke particles increases with increasing gray smoke density. This comparison to threshold TH3 is made to determine whether the obscuration level is expected to be above or below 0.6%. If the scatter detector measurement is above the threshold TH3, the cycle interval is set to a long interval as indicated in step 1320, and the cycle ends.

If the scatter emitter is below the threshold TH3 (point C in FIGS. 11 and 12) as determined in step 1306, the dark obscuration reference 127 is measured, as indicated in step 1309. The initial conditions are set using the obscuration emitter 38, as indicated in step 1310. The initial conditions are set by turning the obscuration emitter 38 on and letting the capacitor 84 settle to a level 125. The elapsed obscuration time 128 is measured, in step 1312, by turning the emitter 38 off and measuring how long it takes for the voltage at terminal 82 to cross the level 108. In step 1314, the state of the cycle interval is evaluated. If the cycle interval is long, the obscuration reference is set to the difference between the elapsed obscuration time 128 and the dark obscuration reference 127, as indicated in step 1317. This is the reference level taken at point C, as it is the first time the obscuration measurement is made after the scatter ratio crosses the threshold TH3. Additionally, the short cycle interval is set in step 1318, so that measurements will be taken more often. The controller 80 then determines whether the obscuration percentage change is below threshold TH2 in step 1322. If it is, the controller 80 determines whether the scatter ratio dropped below the threshold TH1, as indicated in step 1308, while the emitter 32 is generating light. If it has dropped below the threshold TH1, the smoke detect signal is generated as indicated in step 1316. A suitable alarm, such as an audible, visual, and/or electrical signal can then be generated.

If it is determined in step 1308 that the scatter ratio has not dropped below threshold TH1, although it is below TH3, and the obscuration measurement is below threshold TH2 as determined in steps 1306 and 1322, the smoke detector enters a pending alarm state and the cycle ends.

If it is determined in step 1322 that the obscuration percentage change is greater than threshold TH2, the scatter emitter ratio is compared to a threshold TH4, in step 1324. If the scatter time ratio is above TH4, the alarm condition continues to be pending, such that the measurement cycle is repeated more often, and the cycle ends. If the scatter ratio is below threshold TH4, an alarm detect signal is made, as indicated in step 1326, and the cycle ends. As can be seen from FIGS. 11 and 12, when gray smoke is present, the time required for the capacitor 84 to discharge while the emitter 32 is generating light decreases much more quickly than when black smoke is present. As a consequence, the scatter detector requires a greater smoke density to cross the threshold TH1 in the presence of black smoke, as compared to gray smoke. The smoke detector 20 uses the obscuration detector measurement to alter the scatter emitter threshold to TH4, which allows the smoke detector to react more quickly. In the presence of gray smoke, the scatter ratio crosses threshold TH1 well before the obscuration difference crosses threshold TH2. In the presence of black smoke, however, the obscuration difference crosses threshold TH2 for a lower smoke density than that where the scatter ratio crosses threshold TH1. The smoke detector 20 thus permits dynamic adjustment of the scatter emitter threshold from TH1 to TH4 to allow faster reaction by the scatter detector in the presence of black smoke.

Although the scatter detector and obscuration detector can operate independently, several advantages are gained by using them together as described above. For example, the short length of the obscuration detector light path from the emitter 38 to the receiver 28 affects its sensitivity. By using the scatter detector threshold TH3 as a precondition to using the obscuration detector, the reliability of the obscuration detector is increased despite the relatively short length of the path for the obscuration emitter light 40. Using the obscuration detector to reset the scatter emitter alarm threshold to TH4 improves the sensitivity of the scatter detector in the presence of black smoke while helping to avoid false alarms which would result if the scatter detector threshold is always low. Additionally, the scatter detector can operate alone during most cycles as the obscuration detector need only be used after the scatter detector ratio reaches threshold TH3. This reduces the overall current drain of the smoke detector under non-alarm conditions, which is particularly advantageous for battery-operated smoke detectors.

It is envisioned that the smoke detector sensor cycle is repeated periodically, and that each cycle lasts for a very short period of time. For example, the cycle may be repeated once every 5 to 45 seconds and can, for example, occur once every 8 seconds. The cycle may last between 0.05 and 0.2 second and may, for example, last approximately 0.1 second. The timing of the cycle is chosen to reduce power consumption without detrimentally impacting the response time of the smoke detector 20. Additionally, it is envisioned that the cycle is repeated at a higher rate, set in step 1318, such as once every 1 to 5 seconds, when the scatter ratio drops below the threshold TH3, until the scatter ratio rises above the threshold TH3, as determined in step 1306, at which time the interval between sampling cycles is reset to the longer interval in step 1320, such as the exemplary once every 8 second interval described above.

An example of how the thresholds TH1-TH4 can be selected will now be provided. The threshold TH1 can be selected as follows. A scatter detector is placed in gray smoke having a density that causes a UL beam to detect approximately 2.5% obscuration/foot. "UL beam" refers to a beam detector test performed according to Underwriter's Laboratory (UL) test standards, such as UL268. The scatter detector measurement is made. The scatter detector measurement in that smoke density is used for the threshold TH1 of the smoke detector. The threshold TH3 is selected in a similar manner. The scatter detector is placed in gray smoke having a density such that UL beam will detect approximately 0.6% obscuration/foot. The scatter detector measurement in that density of smoke is threshold TH3. Threshold TH4 is also selected in the same manner. The scatter detector is placed in gray smoke having a density such that a UL beam will detect approximately 1.25% obscuration/foot. The scatter detector measurement in that smoke density is the threshold TH4 for the smoke detector. The threshold TH2 is selected to correspond to approximately a 4% light reduction, which due to the short path length for light 40, corresponds to approximately 6% obscuration/foot in the presence of black smoke as measured by a UL beam. For a new smoke detector operating using these thresholds in the presence of black smoke, the light from the obscuration emitter 38 is expected to be at approximately 98% of full intensity when it impacts receiver 28 at the time when the scatter detector ratio crosses threshold TH3. As long as the scatter detector detects at least this level of smoke, the obscuration emitter 38 continues to operate, and the sensing cycle is repeated at the higher repetition rate. When the threshold TH2 is exceeded, the detector changes the scatter detector alarm threshold to be more sensitive, by using threshold TH4 instead of threshold TH1. Those skilled in the art will recognize that the thresholds are merely exemplary, and that other thresholds can be used. Additionally, smoke detectors can be tailored for use in controlled environments by the selection of the threshold levels. For example, if the smoke detector is intended for use in a controlled environment where fuels (e.g., gasoline or kerosene) are stored, such that fires are expected to always have a high black smoke content, the thresholds TH1–TH3 can be selected such that the smoke detector is more sensitive to black smoke without producing excessive false alarms. Those skilled in the art will also recognize that the actual smoke density thresholds for any particular smoke detector can vary due to aging of the smoke detector, environmental conditions, part tolerances, and the like.

It is further envisioned that instead of having two unique alarm thresholds, TH1 and TH4, the alarm threshold could be proportionally adjusted by the amount of black smoke composition present, (i.e. TH4'=$f$(Scatter, Obscuration). To obtain an alarm at a consistent smoke density the function $f$(Scatter, Obscuration) can be implemented using a look-up table. Table 1 provides exemplary values for a five point look-up table.

TABLE 1

| Scatter | Obscuration |
|---|---|
| 1.25 | 4 |
| 1.56 | 3.16 |
| 1.87 | 2.5 |
| 2.18 | 1.78 |
| 2.5 | 1.1 |

Figure 15:
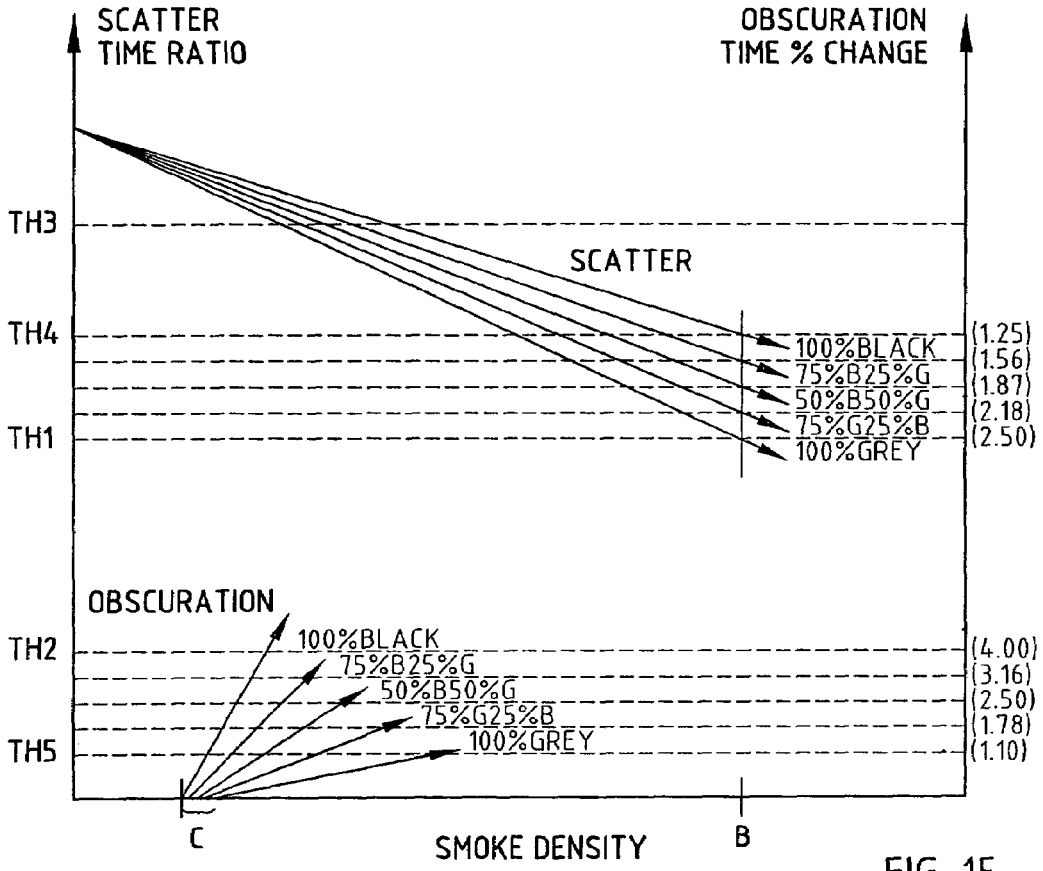
FIG. 15 is a chart illustrating a smoke detector including additional dynamic scatter detector measurement thresholds.

The table represents the smoke detect threshold level TH1 or TH4' for the scatter detector as the obscuration detector percent change measurements vary. Thus, when the obscuration measurement detects a 1.1 percent change, the scatter emitter threshold is TH1. As mentioned above, TH1 is the scatter emitter measurement taken in a smoke density that produces a 2.5 percent obscuration in a UL beam measurement. As the obscuration measurement rises, the smoke detect threshold for the scatter detector rises. When the obscuration detector measurement crosses 1.78 percent change, the scatter emitter threshold is raised to TH4'. For this obscuration measurement, TH4' is a scatter emitter measurement taken in a smoke density that produces a 2.18 percent obscuration in a UL beam measurement. When the obscuration detector measurement crosses 2.5 percent change, the scatter emitter threshold is raised to the next threshold TH4'. For this obscuration measurement, TH4' is a scatter emitter measurement taken in a smoke density that produces a 1.87 percent obscuration in a UL beam measurement. When the obscuration detector measurement crosses 3.16 percent change, the scatter emitter threshold is raised to the next threshold TH4'. For this obscuration measurement, TH4' is a scatter emitter measurement taken at a smoke density that produces a 1.56 percent obscuration in a UL beam measurement. When the obscuration detector measurement crosses 4 percent change, the scatter emitter threshold is raised to the next threshold TH4'. For this obscuration measurement, TH4' is a scatter emitter measurement taken in a smoke density that produces a 1.25 percent obscuration in a UL beam measurement. Thus it can be seen that as the obscuration measurement rises, the scatter detector smoke detect threshold rises proportionally. In operation, if the scatter measurement corresponds to a smoke level of greater than 2.5% obscuration/foot as measured by the UL beam, then an alarm would be generated regardless of the obscuration detector measurement as the threshold for the scatter detector measurement will be TH1. For scatter measurements that indicate a smoke level of less than 2.5% obscuration/ft, as measured by the UL beam, the alarm would be generated based on the evaluation of TH4'=$f$(Scatter, Obscuration). The different measurement thresholds TH4' permit the smoke detector to produce a smoke detect signal in approximately the same smoke density (reference B in FIG. 15) regardless of the percentage of black and gray smoke. The reference levels are selected such that a smoke detect signal will be generated at point B for reference level TH1 if the smoke has 0% black smoke. The respective reference levels for TH4' are selected such that a smoke detect signal will be generated at density B in FIG. 15 for: 25% black smoke; 50% black smoke; 75% black smoke; and 100% black smoke. Alternatively, it should be appreciated that the obscuration sensor can be utilized to generate an alarm and the scatter sensor can be utilized to vary the alarm threshold associated with the obscuration sensor. For example, if TH2 is a nominal alarm threshold for the obscuration sensor, the alarm threshold may be changed from TH2 to TH5 when the scatter sensor response crosses TH1. Alternatively, an ion sensor can be used to adjust the alarm threshold of the obscuration sensor when the ion sensor crosses a predetermined threshold. It should also be recognized that the scatter threshold can alternately be generated as a direct function of the slope of the obscuration detector measurement.

The control system described with regards to FIGS. 6 and 7 may be adapted to any number of emitters. The signal-to-noise ratio (SNR) is an important consideration in selecting the level 108. The level 108 is selected as permitted by the controller 80 so that substantial voltage changes do not produce small time differences. However, if the level 108 is too large, even very small variations in the voltage will result in substantial time differentials, such that the circuit is highly susceptible to noise. It is envisioned that the level 108 can be more than one-half of the supply VDD voltage used to charge the capacitor 84, and more particularly on the order of $7/8^{th}$ of the voltage VDD. As noted above, the voltage is supplied to one input of an internal comparator, the other input of which is connected to the sense input 90. It is envisioned that a different level 108 may be used to determine the dark reference level and the light levels from each emitter 32 and 38. For example, the level 108 for the scatter detector may be lower than the level 108 for the obscuration detector to account for the lower SNR in the signal received from the scatter emitter 32.

In one embodiment a ratio of the received emitter light to the dark reference level at different times is used to compensate for variations in the value of the capacitor 84, and some of the affects of aging and temperature. A first ratio of the received emitter light 34 and 40 to the dark reference level under no smoke conditions is stored in controller 80. During use, a new ratio of received emitter light 34 and 40 to the dark reference level is obtained. In particular, the calibrated measurement ratio used can be:

$$(T_{118}/T_{110})/(T_{118Ref}/T_{110Ref}),$$

where $T_{118}$ is the measured elapsed scatter time 118 and $T_{110}$ is the measured dark scatter reference 110 time at a sampling time, and $T_{118Ref}$ is the elapsed scatter time 118 and $T_{110Ref}$ is the dark reference for a stored reference level. In particular, the reference ratio $T_{118Ref}/T_{110Ref}$ is a stored calibration value representing a no smoke condition. This ratio-to-ratios represents the percentage of smoke present. An initial reference ratio value can be set and stored for the scatter and/or obscuration detector when the smoke detector is manufactured. Over time, the reference ratio can be altered to reflect changing performance characteristics of the smoke detector components, and to compensate for the presence of dirt, such as dust, in the test chamber. These adjustments can be made by incremental compensation of the reference ratio in proportion to the gradual drift in measured ratios that do not produce an alarm indication. Thus, if the measured scatter and obscuration ratios at different sampling times drift up or down over a period of time, the associated reference thresholds can be adjusted to a higher or lower value to reflect that drift. Adjustments in the reference ratio would not be made for those measurements that result in a pending alarm or actual alarm condition. By using a ratio of the new received light-to-dark level ratio and the old light-to-dark level ratio removes the effects of long-range drift in the capacitor 84 and compensates for temperature variations, which affects are cancelled by the ratio.

Variations in the characteristics of the obscuration detector may also be compensated for automatically. The obscuration detector uses a percent change calculation to detect a pending alarm condition. In particular, the following relationship is used:

$$(O_{Ref}-O_{Dif})/O_{Ref}$$

where $O_{Ref}$ is an obscuration reference and $O_{Dif}$ is an obscuration difference. The obscuration difference is $T_{127}-T_{128}$. The obscuration reference is the obscuration difference recorded when the scatter measurement crosses threshold TH3. By using a percentage change threshold, instead of an absolute measurement, variations in the performance of the emitter 38 and the receiver 28, whether caused by temperature variations, aging, dirt, or the like, can be compensated for during measurement.

Many configurations for sensing received light are possible. Each of these configurations generally includes the controller 80 with the discrete output 88 and the sense input 90. In some implementations, the discrete output 88 and the sense input 90 share a common input/output port with the capacitor 84 connected to the discrete output 88. In these embodiments, a path for current extends between the capacitor 84 and the light receiver 28 and a voltage sense path extends from the capacitor 84 to the sense input 90. In these embodiments, the sense input is allowed to float while the discrete output changes from VDD to ground, for example.

Figure 8:
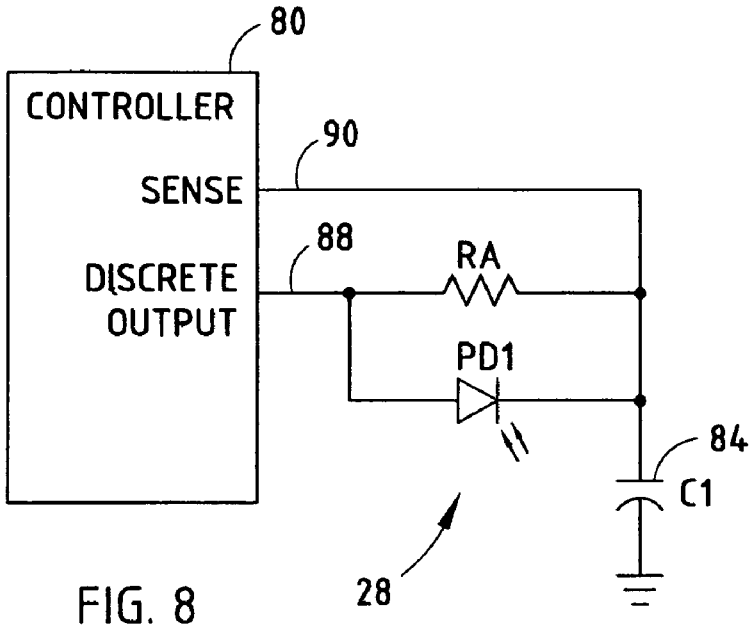
FIG. 8 is an electrical schematic diagram of a light receiver driving and sensing circuit.

Referring now to FIG. 8, a schematic diagram of a light receiver driving and sensing circuit according to an alternate embodiment is shown. Resistor RA is connected in parallel with the receiver 28 between the discrete output 88 and the capacitor 84. The capacitor 84 is directly connected between the sense input 90 and ground. It should be appreciated that the signals at the output 88 and the input 90 are inverted relative to the signals shown in FIG. 7, and further that the input 90 can float throughout the sensing cycle.

Figure 9:
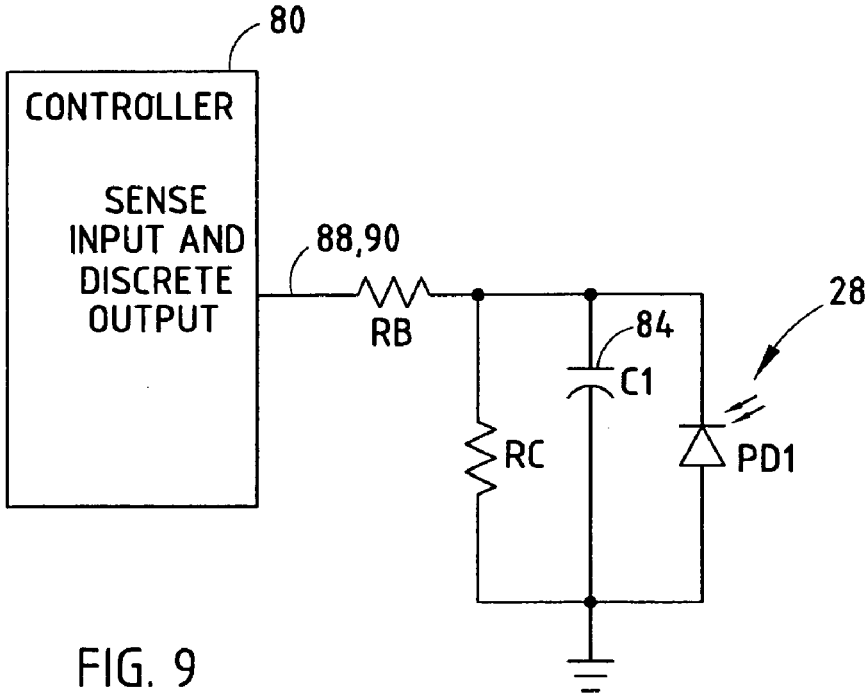
FIG. 9 is an electrical schematic diagram of a light receiver circuit with a combined driving and sensing port.

Referring now to FIG. 9, a schematic diagram illustrates a light receiver circuit with a combined driving and sensing port, according to another embodiment. A resistor RB is connected between combined discrete output 88 and sense input 90 and the parallel combination of a resistor RC, the receiver 28, and the capacitor 84. In this embodiment, it is envisioned that the voltage VDD is applied to terminal 88, 90 during charging and that terminal 88, 90 floats otherwise. Thus, the terminal 88, 90 is indicative of the capacitor 84 voltage, which over time is dependent upon the rate at which current is discharged by the capacitor 84, which is in turn dependent on the current in the receiver 28.

Figure 10:
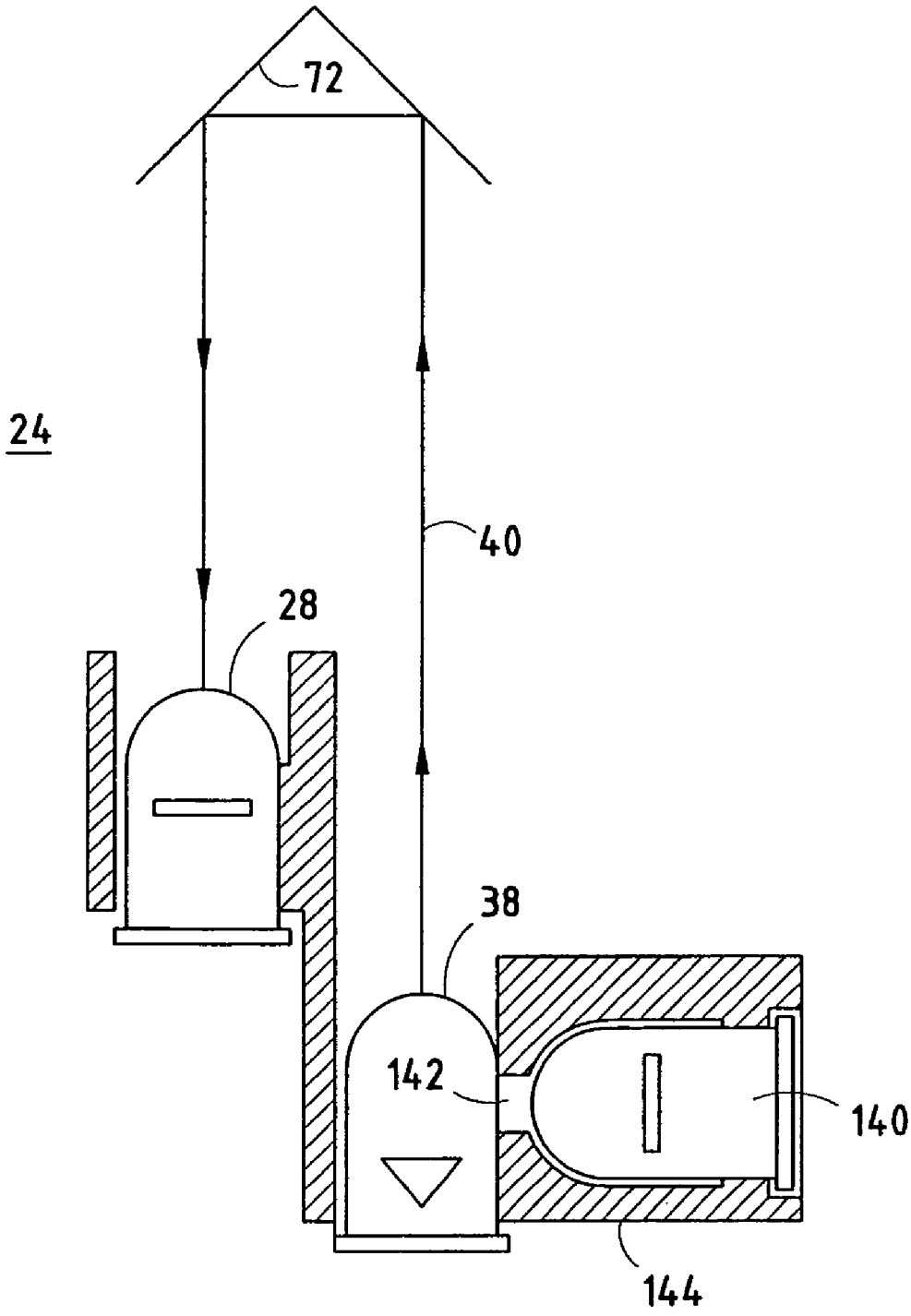
FIG. 10 is an electrical schematic diagram of a dual emitter smoke detector including an optional reference receiver.
Figure 14:
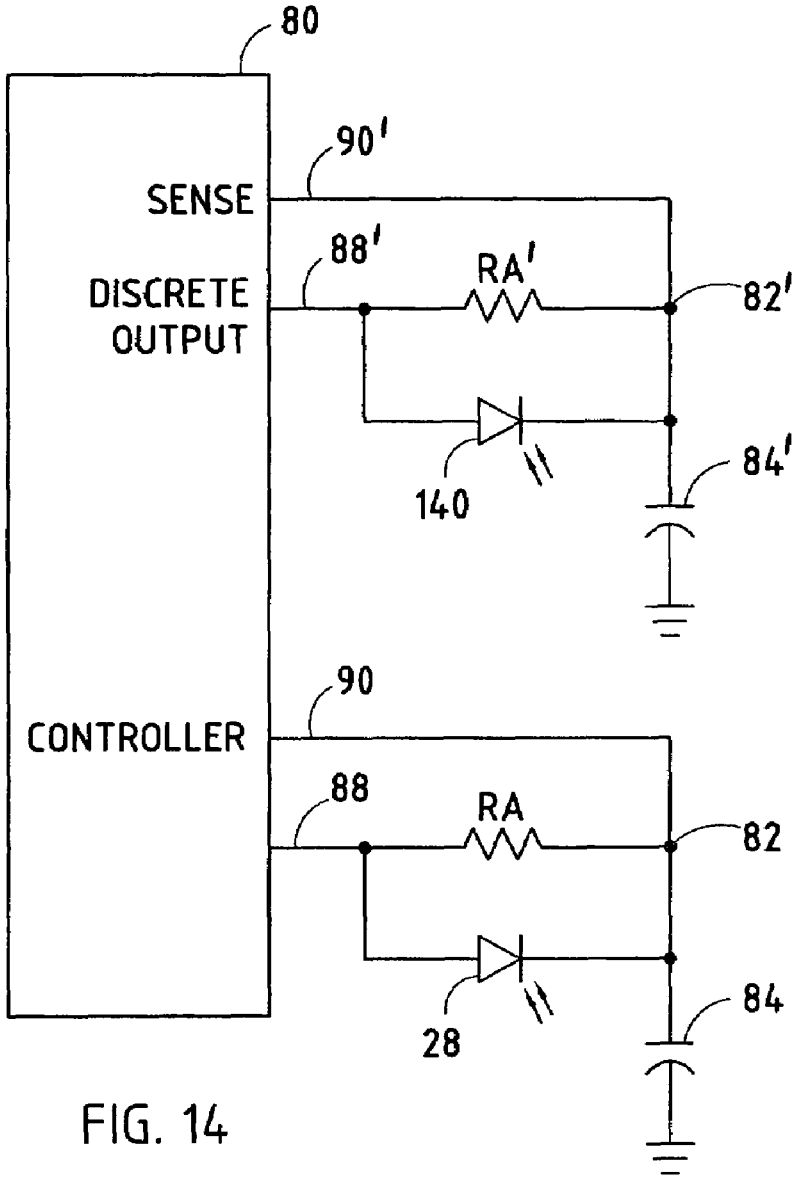
FIG. 14 is an electrical schematic illustrating the electrical connection for an optional reference receiver according to FIG. 10.

Referring now to FIG. 10, a partial schematic diagram of another embodiment of a dual receiver smoke detector is shown. A second receiver 140 is positioned such that light 142 from the obscuration emitter 38 travels along an isolated path different from the light 40, the isolated path is free from smoke in the test atmosphere 24. This may be accomplished by producing a sealed cavity in housing 144 between the obscuration emitter 38 and the receiver 140, by inserting a light pipe between the obscuration emitter 38 and the receiver 140, or the like. The receiver 140 is connected in parallel with resistor RA' (FIG. 14) between output 88' of the controller 80 and terminal 82'. A capacitor 84' is connected between ground and the terminal 82'. A sense input 90' is connected to the terminal 82'. The capacitor 84', the resistor RA' and the receiver 140 may be identical to the capacitor 84, the resistor RA and the receiver 28, respectively. The controller 80 determines the intensity of the light 142 emitted by the obscuration emitter 38 by monitoring sense input 90'. The controller 80 then uses the determined intensity of the light 142 emitted by the obscuration emitter 38 and the intensity of the light 40 passing through test atmosphere 24 to more accurately determine the presence of smoke as detected by the obscuration detector. Responsive to the obscuration emitter 38, the difference between the time measurements made from the receiver 140 and the time measurements made from the receiver 28 is indicative of the amount of smoke particles in the test chamber. Such an arrangement compensates for variations in the performance of the emitter 38 and the receiver 28.

It is envisioned that improved performance can also be obtained by normalizing for dark current, as an alternative to the ratio-of-ratios technique described above, for those measurements made responsive to the scatter emitter 32, using the dark current voltage 121 range measurement made during the time interval 122 to 123 (FIG. 7). Each of the voltage ranges of the comparator is associated with a respective calibration factor stored in the memory of controller 80.

These calibration factors are stored at the factory and are preselected based on measurements taken using a smoke detector under test conditions. The calibration factor for one of the voltage ranges, the normal voltage range, has a value of 1. The calibration factors for each of the other voltage ranges are selected to compensate for the amount that the dark current is expected to vary the actual measurement of elapsed scatter time 118 relative to measurement of elapsed scatter time 118 in the normal voltage range. By multiplying the stored calibration factor by the measured ratio of $T_{118}/T_{110}$, the measured result can be normalized to compensate for the affects of dark current. This is particularly important since the dark current in the receiver 28 is normally highly sensitive to temperature, which significantly impacts on the discharge time of the capacitor 84.

Alternatively, it is envisioned that the stored factor can be multiplied by level 108, to vary the level 108 such that the larger the dark current voltage 121 measured during period 122 to 123, the higher the level 108 during the measurement of the elapsed scatter time 118. It will be recognized that the dark current voltage 121 measurement taken during period 122 to 123 can be taken prior to time period 116, if the level 108 is to be adjusted during measurement of the elapsed scatter time 118.

It will be recognized by those skilled in the art that the PIC16CE624 microprocessor from Microchip Technology includes an internal comparator and a resistor network providing 32 reference levels for the internal comparator. The voltage at terminal 82 is compared to each of these reference levels to determine between which of the 32 reference voltages the dark current voltage 121 of the capacitor 84 settles as noted above. The PIC16CE624 microcontroller advantageously includes 32 reference levels that divide the overall voltage range between $V_{DD}$ and ground into non-uniform, contiguous ranges, the smaller ranges providing finer resolution where the dark current voltage 121 on capacitor 84 is likely to settle. However, the reference voltages could alternately be at uniform, contiguous intervals, if desired.

Figure 16:
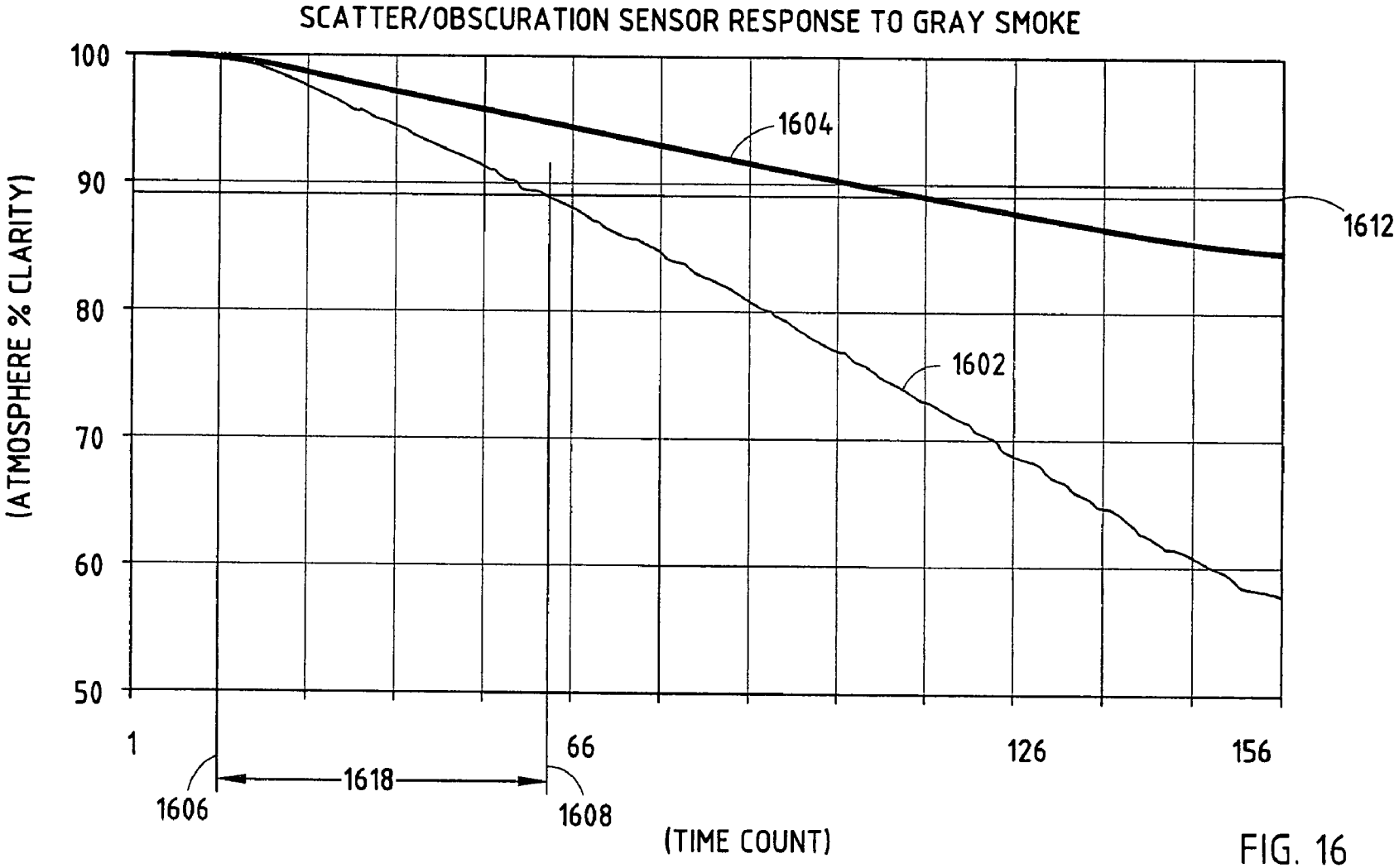
FIGS. 16–17 are charts illustrating an exemplary response of a particle sensor, that includes a scatter sensor and an obscuration sensor, to gray and black smoke, respectively.

FIG. 16 shows an exemplary response of a scatter sensor and an obscuration sensor to gray smoke, when combined within a smoke detector. As shown in FIG. 16, the scatter sensor produces a response curve 1602 and the obscuration sensor produces a response curve 1604. As shown, the curve 1602 provides an alarm when the curve 1602 crosses an alarm threshold 1612. Thus, the curve 1602 provides an alarm sooner than the curve 1604. A time to alarm 1618 is determined by the time that elapses between when the smoke level exceeds a smoke threshold 1606 and when the curve 1602 crosses the alarm threshold 1612, at time 1608.

Figure 17:
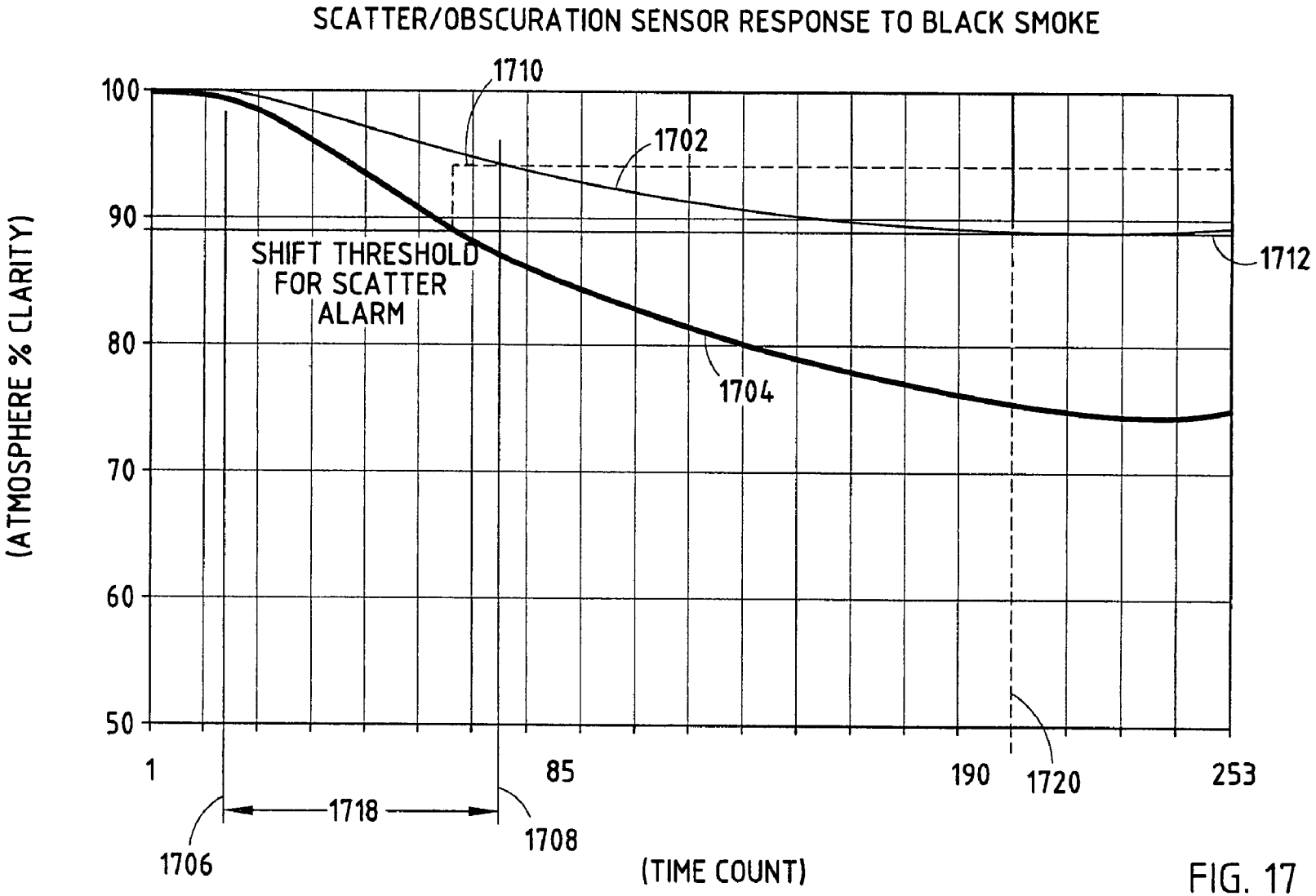

Turning to FIG. 17, an exemplary response of a scatter sensor and an obscuration sensor to black smoke, when combined within a smoke detector, is illustrated. As shown in FIG. 17, the scatter sensor produces a response curve 1702 and the obscuration sensor produces a response curve 1704. When the curve 1704 crosses an alarm threshold 1712, the threshold for the scatter sensor is modified to occur at a shifted alarm threshold 1710. As shown, the curve 1702 provides an alarm when the curve 1702 crosses the shifted alarm threshold 1710. Thus, when the smoke detector provides an alarm based on the scatter sensor, the alarm occurs sooner when the alarm threshold 1712 is adjusted to the shifted alarm threshold 1710. If the alarm threshold is not adjusted, an alarm does not occur until time 1720, which is considerably after time 1708. A time to alarm 1718 is determined by the time that elapses between when the smoke level exceeds a smoke threshold 1706 and when the curve 1702 crosses the shifted alarm threshold 1710, at time 1708. Thus, when the obscuration sensor detects a predetermined black smoke level by crossing the alarm threshold 1712, the threshold for the scatter sensor is shifted to occur at a lower (i.e., at a higher atmosphere clarity) gray smoke level.

Two separate smoke sources were used to create the charts of FIGS. 16 and 17. In both cases, the smoke was introduced into a test chamber that is large in comparison to the sensors. The smoke particles were introduced into the test chamber at a steady rate, and the smoke density increased at a steady rate. Burning cotton wick was used to create a light gray smoke, which represented a slow smoldering fire, such as a cigarette against a mattress. A kerosene lamp was intentionally misadjusted to produce black smoke particles, which represented fast burning, flaming fires. The differences in reflectivity between these particles causes the dissimilar sensors to react on different slopes, relative to one another, as the smoke density increases. In an actual fire, the smoke type can change rapidly. In a typical case, when a cigarette in contact with a mattress reaches a certain point, flames may erupt and change the smoke type being emitted.

As previously mentioned, the goal of an early warning detector is to sound an alarm in the presence of low levels of smoke. The charts demonstrate that the scatter sensor is superior when detecting an increasing density of gray smoke, while the obscuration sensor is superior when detecting an increasing density of black smoke. As such, a combination of the two optical detection techniques provides an alarm, for either type of smoke, earlier than either technique alone can provide without generally increasing the likelihood of false alarms.

As is well known, light sources (e.g., LEDs) within a given lot may produce varying brightness levels. While such light sources are generally useable to some degree, when the light striking a given light receiver (e.g., a photodiode) is brighter than can be measured the brightness of the light source must be reduced such that a difference in energy received by a light receiver can be related to the amount of particles within a test chamber of a particle sensor. One method of reducing the light level output by a light source is to use a serial potentiometer to reduce the current through the light source (e.g., an obscuration emitter). However, in a production environment, this solution is not particularly attractive as each potentiometer may require mechanical adjustment. Thus, a technique has been developed which limits the on-time of the obscuration emitter to establish an initial condition for an obscuration measurement. Using the same initial condition allows the amount of energy that is lost due to particles in the test chamber to be accurately measured irrespective of the difference in the intensity of the light source.

Figure 18:
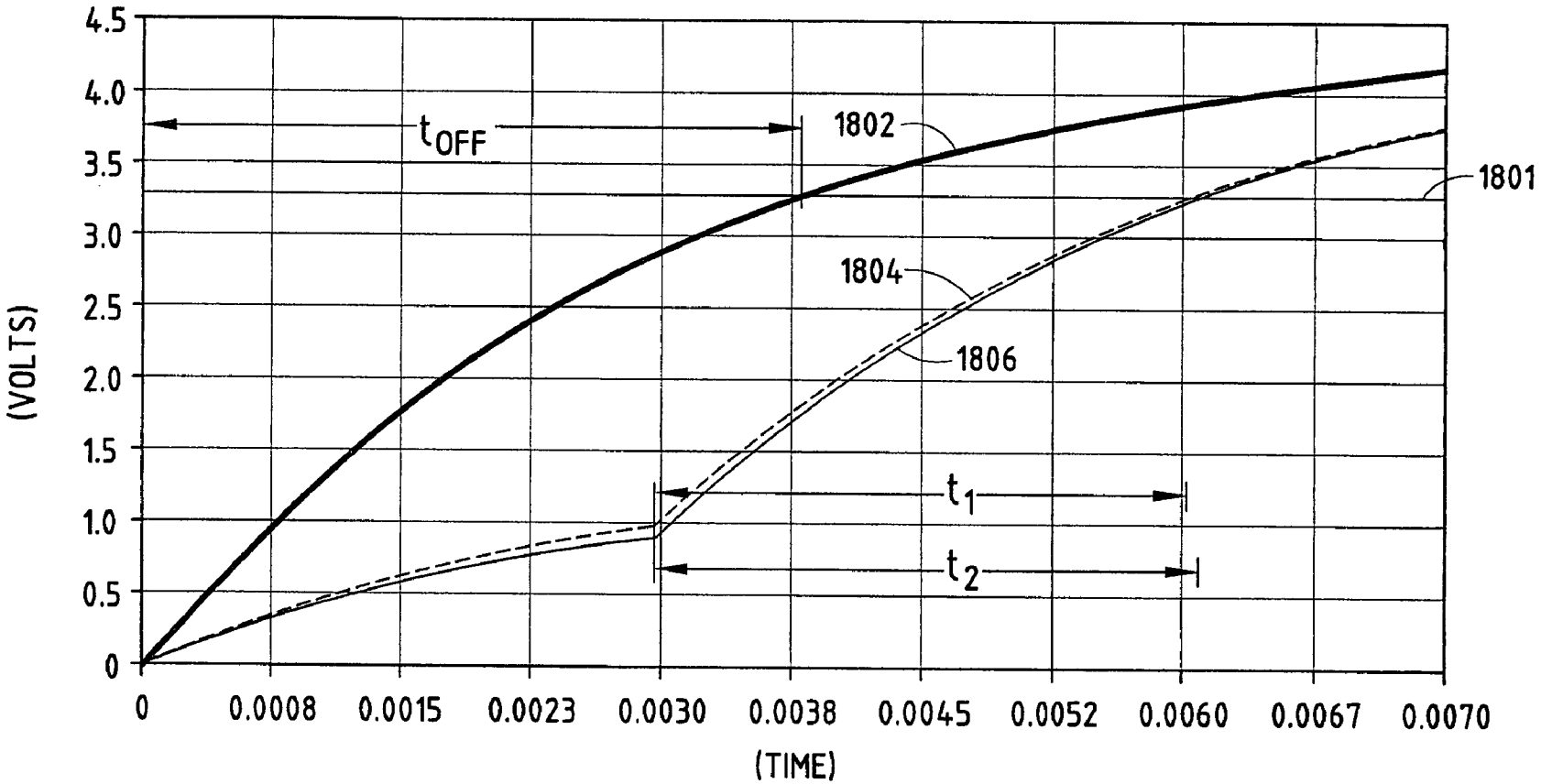
FIGS. 18–20 are charts illustrating the implementation of a process for utilizing light sources of varying intensities in a particle sensor, according to the present invention.

FIG. 18 depicts a chart illustrating the implementation of a process for utilizing a bright LED in an obscuration sensor, according to an embodiment of the present invention. As shown, a reference voltage curve 1802, without smoke in the test chamber, is initially generated to obtain an off-time ($t_{off}$). The off-time $t_{off}$ is obtained by charging the capacitor 84 from zero volts and measuring the time it takes to cross a voltage threshold 1801, in this case about 3.25 volts. A bright LED curve 1804, which is the response caused by a bright LED, shows how a first time ($t_1$) is determined. The first time $t_1$ is determined by measuring the time from an initial condition (which is established by turning on the obscuration emitter for an appropriate time), in this case about 1.0 volt, until the curve 1804 crosses the threshold 1801. This is the measurement obtained when the obscuration emitter is initially activated after the scatter emitter/receiver combination indicates some particle activity in the test chamber. A 'no smoke' reference level is then set to the difference between $t_{off}$ and $t_1$. As smoke accumulates in the test chamber a bright LED smoke curve 1806 provides a second time ($t_2$). The second time $t_2$ is obtained in a manner similar to $t_1$, with the difference being that the initial condition for $t_2$ has a slightly lower starting voltage due to the reduced light striking the light receiver (i.e., a photodiode), due to the presence of particles in the test chamber. The smoke level is then set to difference between $t_{off}$ and $t_2$. When the percent change of ($t_{off}$–$t_2$) to ($t_{off}$–$t_1$) exceeds a predetermined amount (for example, four percent), the sensitivity of the scatter emitter/receiver combination is altered by, for example, altering the scatter alarm threshold.

Figure 19:
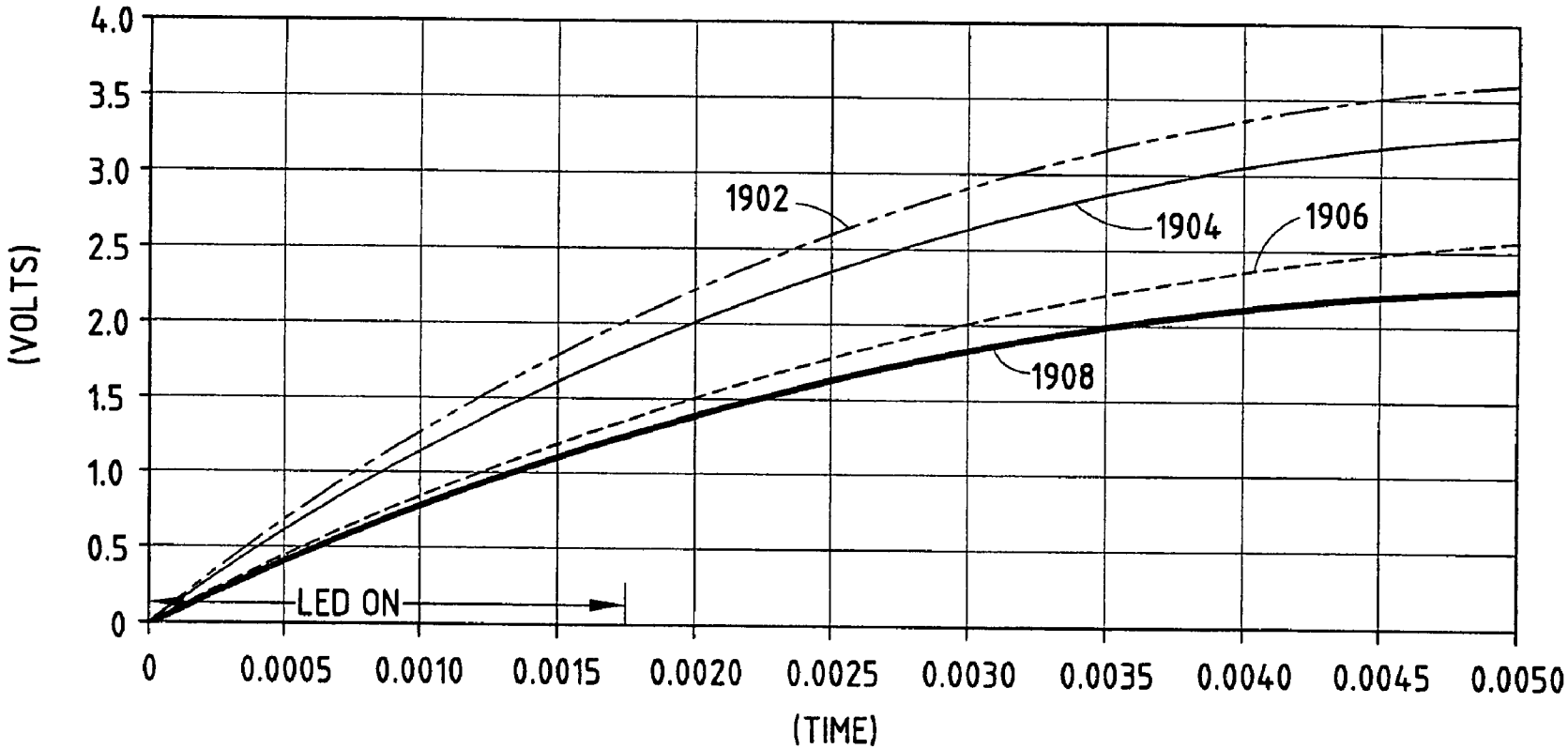

FIG. 19 depicts a chart with four ascending curves 1902, 1904, 1906 and 1908 that represent the voltage across the capacitor 84 for an exemplary bright LED and an exemplary dim LED, with and without smoke, respectively. This chart illustrates how a bright LED can be utilized, according to an embodiment of the present invention. That is, when an LED is too bright, its on-time is limited (in this example to about 0.00175 seconds). Without adjustment, the bright LED would be on for the same amount of time as the dim LED (in this example about 0.0003 seconds). Without compensation, the dim LED achieves an initial condition of about 2 volts at 0.0003 seconds, whereas the bright LED achieves an initial condition of about 2.8 volts at 0.0003 seconds.

Figure 20:
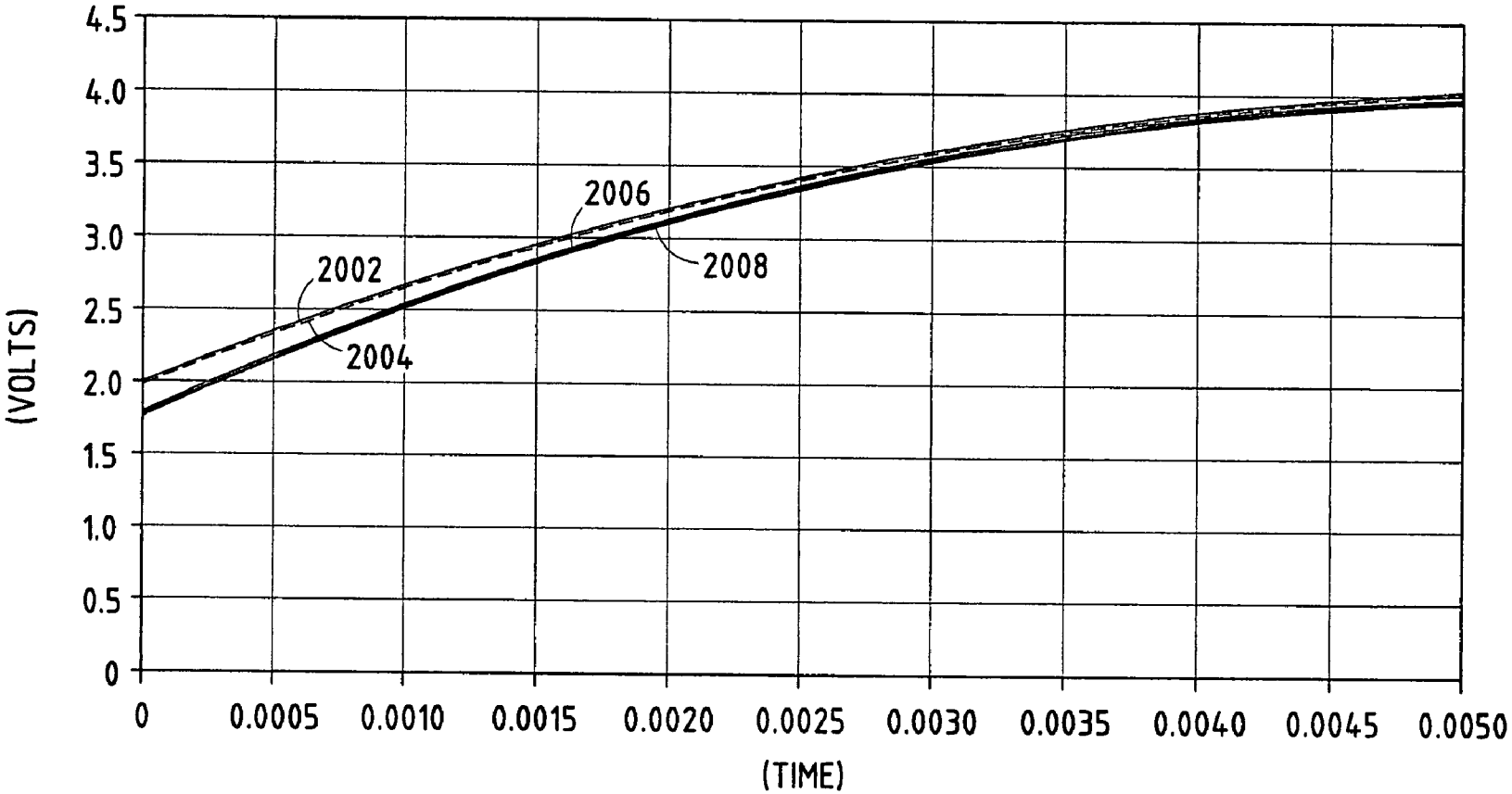

FIG. 20 shows a chart that illustrates that the influence of smoke is the same for a bright LED and a dim LED when the on-time for the bright LED is limited such that an appropriate initial condition (e.g., about 2.0 volts) is selected for the bright LED. As shown in FIG. 20, both the bright and dim curves produce the same response. That is, the Vbright and Vdim curves 2002 and 2004, without smoke, are overlaid producing the top lines and the Vbright and Vdim curves 2006 and 2008, with smoke, are overlaid producing the bottom curve.

Figure 21:
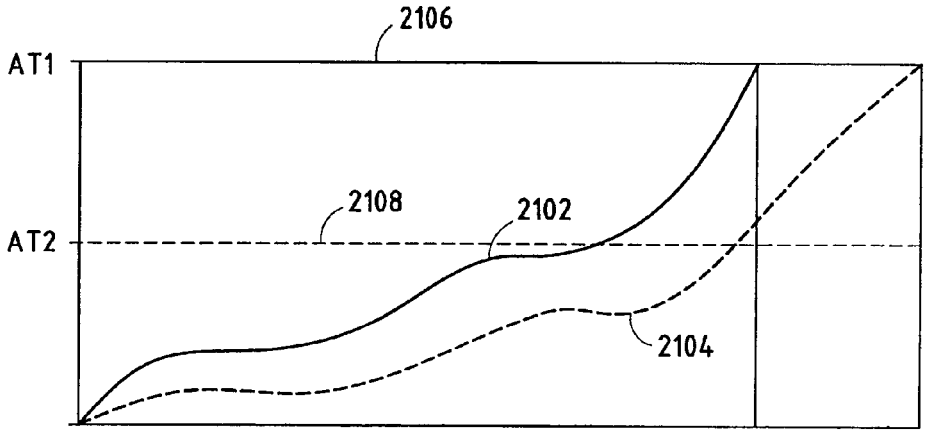
FIG. 21 is a chart illustrating the adjustment of the sensitivity of a particle sensor, according to still another embodiment of the present invention.

FIG. 21 shows a chart that illustrates that the sensitivity of a particle sensor can be altered by changing an alarm threshold, from, for example, a first alarm threshold (AT1) 2106 to a second alarm threshold (AT2) or by changing the current supplied to an emitter from, for example, a first current 2104 to a second current 2102.

Accordingly, an improved particle sensor (e.g., a smoke detector) has been disclosed that provides a reliable smoke detect signal without excessive false alarm signals. While embodiments have been illustrated and described, it is not intended that these embodiments illustrate and describe all possible forms of the invention. For example, it is envisioned that the obscuration detector could cause the controller to issue a smoke detect signal when the percent change crosses threshold TH2, rather than changing the scatter detector threshold from TH1 to TH4 when the obscuration detector crosses threshold TH2. Accordingly, the above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

What is claimed is:

1. A compact particle sensor for detecting suspended particles, comprising:

a housing providing a test chamber, the housing including at least one opening for admitting particles into the test chamber while simultaneously substantially preventing outside light from entering the test chamber;

a light source positioned for supplying a light beam in the test chamber;

a light receiver positioned to receive the light beam supplied by the light source; and at least three optical elements positioned to direct the light beam from the light source to the receiver, wherein at least one of the at least three optical elements is a mirror.

2. The sensor of claim 1, wherein the at least three optical elements include at least three non-planar mirrors, and wherein the non-planar mirrors are substantially located in a first plane and the light source and the receiver are substantially located in a second plane such that the light source and the receiver do not block the light beam as it is reflected between the mirrors.

3. A compact particle sensor for detecting suspended particles comprising:

a housing providing a test chamber, the housing including at least one opening for admitting particles into the test chamber while simultaneously substantially preventing outside light from entering the test chamber;

a light source positioned for supplying a light beam in the test chamber;

a light receiver positioned to receive the light beam supplied by the light source; and at least three optical elements positioned to direct the light beam from the light source to the receiver, wherein the sensor is contained within a three and one-eighth inch diameter circle and the optical length between the light source and the receiver is at least about seven inches.

4. The sensor of claim 3, wherein the optical length between the light source and the receiver is at least about fourteen inches.

5. The sensor of claim 3, wherein the optical length between the light source and the receiver is at least about twenty-one inches.

6. The sensor of claim 1, wherein the optical elements are spherical mirrors.

7. The sensor of claim 1, wherein the at least three optical elements include at least three planar mirrors, and wherein the planar mirrors, the light source and the receiver are substantially located in a single plane, and wherein the light source and the receiver are positioned to not block the light beam as it is reflected between the mirrors.

8. The sensor of claim 1, wherein the at least three optical elements include three planar mirrors that are utilized to reflect the light beam from the light source to the receiver.

9. The sensor of claim 1, wherein the at least three optical elements include at least three mirrors each including a reflective surface that reflects the light beam from the light source to the receiver, and wherein each of the mirrors includes at least one of a hydrophilic coating on the reflective surface and a heater positioned to substantially prevent fogging of the reflective surface due to humidity.

10. A compact particle sensor for detecting suspended particles, comprising:

a housing providing a test chamber, the housing including at least one opening for admitting particles into the test chamber while simultaneously substantially preventing outside light from entering the test chamber;

a light source positioned for supplying a light beam in the test chamber;

a light receiver positioned to receive the light beam supplied by the light source; and a plurality of optical elements positioned to direct the light beam from the light source to the receiver, wherein the sensor is contained within no greater than about a three and one-eighth inch diameter circle and the optical length between the light source and the receiver is at least about seven inches.

11. The sensor of claim 10, wherein the optical length between the light source and the receiver is at least about fourteen inches.

12. The sensor of claim 11, wherein the optical length between the light source and the receiver is at least about twenty-one inches.

13. A compact particle sensor for detecting suspended particles, comprising:

a housing providing a test chamber, the housing including at least one opening for admitting particles into the test chamber while simultaneously substantially preventing outside light from entering the test chamber;

a light source positioned for supplying a light beam in the test chamber;

a light receiver positioned to receive the light beam supplied by the light source; and at least two non-planar optical elements positioned to direct the light beam from the light source to the receiver, wherein at least one of the at least two non-planar optical elements is a mirror.

14. The sensor of claim 13, wherein the at least two non-planar optical elements include three non-planar mirrors, and wherein the non-planar mirrors are substantially located in a first plane and the light source and the receiver are substantially located in a second plane such that the light source and the receiver do not block the light beam as it is reflected between the mirrors.

15. The sensor of claim 13, wherein the optical elements are spherical mirrors.

16. A compact particle sensor, comprising:

a housing providing a test chamber, the housing including at least one opening for admitting particles into the test chamber while substantially preventing outside light from entering the test chamber;

a scatter emitter/receiver combination positioned such that any portion of the light emitted by the scatter emitter that is reflected off of particles suspended in the chamber and received is proportional to the amount of high reflectivity particles present in the chamber;

an obscuration emitter/receiver combination positioned such that any portion of the light emitted by the obscuration emitter that is received is inversely proportional to the amount of low reflectivity particles present in the chamber;

at least three optical elements positioned to direct the light emitted by the obscuration emitter to the receiver of the obscuration emitter/receiver combination; and a controller coupled to the scatter emitter/receiver combination and the obscuration emitter/receiver combination, the controller using the amount of particles sensed by the obscuration emitter/receiver combination to alter the sensitivity of the scatter emitter/receiver combination.

17. The sensor of claim 16, wherein the scatter emitter/receiver combination and the obscuration emitter/receiver combination share a common receiver.

18. The sensor of claim 16, wherein the controller is also configured to change a sensor cycle when a high reflectivity particle level crosses an initial scatter emitter threshold, and wherein the rate of the sensor cycle determines the frequency with which at least one of the scatter emitter and obscuration emitter emits light.

19. The sensor of claim 18, wherein the controller causes the obscuration emitter to generate light only after the high reflectivity particle level crosses the initial scatter emitter threshold.

20. The sensor of claim 19, wherein a scatter emitter alarm threshold is modified to occur at a lower high reflectivity particle level when an obscuration emitter threshold is exceeded thus altering the sensitivity of the scatter emitter/receiver combination.

21. The sensor of claim 19, wherein the intensity of the light emitted by the scatter emitter is increased when an obscuration emitter threshold is exceeded thus altering the sensitivity of the scatter emitter/receiver combination.

22. The sensor of claim 16, wherein the at least three optical elements include at least three non-planar mirrors that are substantially located in a first plane, and wherein the obscuration emitter/receiver combination and the scatter emitter/receiver combination are substantially located in a second plane such that the obscuration emitter/receiver combination and the scatter emitter/receiver combination do not block the light beam as it is reflected between the mirrors.

23. A compact particle sensor for detecting suspended particles, comprising:

a housing providing a test chamber, the housing including at least one opening for admitting particles into the test chamber while simultaneously substantially preventing outside light from entering the test chamber;

a light source positioned for supplying a light beam in the test chamber;

a light receiver positioned to receive the light beam supplied by the light source; and a plurality of non-planar optical elements positioned to direct the light beam from the light source to the receiver, wherein the light beam travels a path from the light source to the receiver that does not lie a single plane.

24. The sensor of claim 23, wherein the plurality of optical elements include a plurality of non-planar mirrors that are substantially located in a first plane, and wherein the light source and the light receiver are substantially located in a second plane such that the light source and the light receiver do not block the light beam as it is reflected between the mirrors.

25. The sensor of claim 23, wherein the sensor is contained within about a three and one-eighth inch diameter circle and the optical length between the light source and the light receiver is at least about seven inches.

26. The sensor of claim 25, wherein the optical length between the light source and the light receiver is at least about fourteen inches.

27. The sensor of claim 25, wherein the optical length between the light source and the light receiver is at least about twenty-one inches.

28. The sensor of claim 23, wherein the light beam crosses itself when travelling from the light source to the light receiver.

29. The sensor of claim 23, wherein the plurality of non-planar optical elements include a plurality of non-planar mirrors.

30. A compact particle sensor for detecting suspended particles, comprising:

a housing providing a test chamber, the housing including at least one opening for admitting particles into the test chamber while simultaneously substantially preventing outside light from entering the test chamber;

a light source positioned for supplying a light beam in the test chamber;

a light receiver positioned to receive the light beam supplied by the light source; and a plurality of non-planar optical elements positioned to direct the light beam from the light source to the receiver, wherein the light beam crosses itself when travelling from the light source to the light receiver.

31. The sensor of claim 30, wherein the light beam travels a non-planar path from the light source to the light receiver.

32. The sensor of claim 30, wherein the non-planar optical elements are spherical mirrors.

33. A compact particle sensor for detecting suspended particles, comprising:

a housing providing a test chamber, the housing including at least one opening for admitting particles into the test chamber while simultaneously substantially preventing outside light from entering the test chamber;

a light source positioned for supplying a light beam within the test chamber;

a light receiver positioned to receive the light beam supplied by the light source; and at least three optical elements positioned to direct the light beam from the light source to the receiver, wherein the light beam alternately converges and diverges between the optical elements when travelling from the light source to the light receiver.

34. The sensor of claim 33, wherein the at least three optical elements includes three non-planar mirrors.

35. The sensor of claim 34, wherein the non-planar mirrors are concave mirrors.

36. The sensor of claim 35, wherein the concave mirrors are spherical mirrors.

37. A compact particle sensor for detecting suspended particles, comprising:

a housing providing a test chamber, the housing including at least one opening for admitting particles into the test chamber while simultaneously substantially preventing outside light from entering the test chamber;

a light source positioned for supplying a light beam in the test chamber;

a light receiver positioned to receive the light beam supplied by the light source; and at least three optical elements positioned to direct the light beam from the light source to the receiver, wherein a path length of the light beam between the light source and the receiver is at least about two times the smallest dimension of the test chamber.

38. The sensor of claim 37, wherein the path length of the light beam between the light source and the receiver is at least about two times the largest dimension of the test chamber.

39. The sensor of claim 37, wherein the path length of the light beam between the light source and the receiver is at least about four and one-half times the smallest dimension of the test chamber.

40. The sensor of claim 37, wherein the path length of the light beam between the light source and the receiver is at least about four and one-half times the largest dimension of the test chamber.

41. The sensor of claim 37, wherein the test chamber is circular.

42. A compact particle sensor for detecting suspended particles, comprising:

a housing providing a test chamber, the housing including at least one opening for admitting particles into the test chamber while simultaneously substantially preventing outside light from entering the test chamber, wherein an interior color of the housing that provides the test chamber is non-black;

a light source positioned for supplying a light beam in the test chamber;

a light receiver positioned to receive the light beam supplied by the light source; and a plurality of optical elements positioned to direct the light beam from the light source to the receiver.

43. The sensor of claim 42, wherein the plurality of optical elements include at least three non-planar mirrors, and wherein the non-planar mirrors are substantially located in a first plane and the light source and the receiver are substantially located in a second plane such that the light source and the receiver do not block the light beam as it is reflected between the mirrors.

44. The sensor of claim 42, wherein the sensor is contained within a three and one-eighth inch diameter circle and the optical length between the light source and the receiver is at least about seven inches.

45. The sensor of claim 44, wherein the optical length between the light source and the receiver is at least about fourteen inches.

46. The sensor of claim 44, wherein the optical length between the light source and the receiver is at least about twenty-one inches.

47. The sensor of claim 42, wherein the optical elements are spherical mirrors.

48. A compact particle sensor for detecting suspended particles, comprising:

a housing providing a test chamber, the housing including at least one opening for admitting particles into the test chamber while simultaneously substantially preventing outside light from entering the test chamber;

a light source positioned for supplying a light beam in the test chamber;

a light receiver positioned to receive the light beam supplied by the light source, wherein the light receiver includes a Faraday shield that shields the receiver from outside electromagnetic interference; and a plurality of optical elements positioned to direct the light beam from the light source to the receiver.

49. The sensor of claim 48, wherein the optical elements are spherical mirrors.

* * * * *